US007926894B2

(12) United States Patent
Nunokawa

(10) Patent No.: US 7,926,894 B2
(45) Date of Patent: Apr. 19, 2011

(54) PRINTING APPARATUS, PRINTING METHOD, PROGRAM AND PRINTING SYSTEM

(75) Inventor: Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 1280 days.

(21) Appl. No.: 10/589,820

(22) PCT Filed: Jul. 27, 2005

(86) PCT No.: PCT/JP2005/013759

§ 371 (c)(1),
(2), (4) Date: Aug. 17, 2006

(87) PCT Pub. No.: WO2006/013764

PCT Pub. Date: Feb. 9, 2006

(65) Prior Publication Data

US 2007/0165073 A1 Jul. 19, 2007

(30) Foreign Application Priority Data

Aug. 3, 2004 (JP) ..... 2004-226846

(51) Int. Cl.
*B41J 2/205* (2006.01)

(52) U.S. Cl. ..... 347/15; 347/11; 347/10; 347/9; 347/57

(58) Field of Classification Search ..... 347/15, 347/8, 5, 9, 57, 10–12
See application file for complete search history.

(56) References Cited

U.S. PATENT DOCUMENTS

| | | | | |
|---|---|---|---|---|
| 6,142,598 | A | 11/2000 | Iwasaki et al. | |
| 6,312,096 | B1 | 11/2001 | Koitabashi et al. | |
| 2001/0030671 | A1 * | 10/2001 | Fujimori | 347/19 |
| 2004/0046832 | A1 | 3/2004 | Kuwahara | |

FOREIGN PATENT DOCUMENTS

| | | | |
|---|---|---|---|
| EP | 0 885 732 | A1 | 12/1998 |
| EP | 1 040 925 | A2 | 10/2000 |
| JP | 6-191041 | A | 7/1994 |
| JP | 11-10842 | A | 1/1999 |
| JP | 11-010842 | A | 1/1999 |

* cited by examiner

*Primary Examiner* — Matthew Luu
*Assistant Examiner* — Henok Legesse
(74) *Attorney, Agent, or Firm* — Sughrue Mion, PLLC

(57) ABSTRACT

A printing apparatus can improve the image quality by improving uneven print density or graininess. A printing apparatus is provided with (A) a carry mechanism that carries a medium along a predetermined direction, (B) a nozzle that performs a moving and ejecting operation for ejecting ink toward the medium while moving relatively with respect to the medium during an interval of a carry operation by the carry mechanism, and (C) a signal output section that outputs a first timing defining signal defining a periodical timing for ejecting ink from the nozzle toward a position corresponding to a pixel configuring an image to be printed, and a second timing defining signal defining a periodical timing for ejecting ink from the nozzle toward a position displaced from the position corresponding to a pixel configuring an image to be printed, wherein the signal output section outputs either the first timing defining signal or the second timing defining signal for each moving and ejecting operation.

13 Claims, 35 Drawing Sheets

| | N1 | Q1 | N2 | Q2 | N3 | Q3 | N4 | Q4 |
|---|---|---|---|---|---|---|---|---|
| L1 | 1 | | | 17 | 9 | | | 25 |
| L2 | | 22 | 6 | | | 30 | 14 | |
| L3 | 11 | | | 27 | 3 | | | 19 |
| L4 | | 32 | 16 | | | 24 | 8 | |
| L5 | 5 | | | 21 | 13 | | | 29 |
| L6 | | 18 | 2 | | | 26 | 10 | |
| L7 | 15 | | | 31 | 7 | | | 23 |
| L8 | | 28 | 12 | | | 20 | 4 | |

| | N1 | Q1 | N2 | Q2 | N3 | Q3 | N4 | Q4 |
|---|---|---|---|---|---|---|---|---|
| L1 | 1 | | 17 | | 9 | | 25 | |
| L2 | | 22 | | 6 | | 30 | | 14 |
| L3 | 11 | | 27 | | 3 | | 19 | |
| L4 | | 32 | | 16 | | 24 | | 8 |
| L5 | 5 | | 21 | | 13 | | 29 | |
| L6 | | 18 | | 2 | | 26 | | 10 |
| L7 | 15 | | 31 | | 7 | | 23 | |
| L8 | | 28 | | 12 | | 20 | | 4 |

| | Q1 | Q2 | Q3 | Q4 | Q5 | Q6 | Q7 | Q8 |
|---|---|---|---|---|---|---|---|---|
| | N1 | N2 | N3 | N4 | N5 | N6 | N7 | N8 |
| L1 | 1 | 85 | 25 | 61 | 13 | 73 | 37 | 49 |
| L2 | 72 | 48 | 84 | 12 | 60 | 36 | 96 | 24 |
| L3 | 47 | 71 | 11 | 83 | 35 | 59 | 23 | 95 |
| L4 | 94 | 10 | 70 | 34 | 82 | 22 | 58 | 46 |
| L5 | 9 | 93 | 33 | 69 | 21 | 81 | 45 | 57 |
| L6 | 56 | 32 | 92 | 20 | 68 | 44 | 80 | 8 |
| L7 | 31 | 55 | 19 | 91 | 43 | 67 | 7 | 79 |
| L8 | 78 | 18 | 54 | 42 | 90 | 6 | 66 | 30 |
| L9 | 17 | 77 | 41 | 53 | 5 | 89 | 29 | 65 |
| L10 | 64 | 40 | 76 | 4 | 52 | 28 | 88 | 16 |
| L11 | 39 | 63 | 3 | 75 | 27 | 51 | 15 | 87 |
| L12 | 86 | 2 | 62 | 26 | 74 | 14 | 50 | 38 |

FIG. 23D

PRINTING APPARATUS, PRINTING METHOD, PROGRAM AND PRINTING SYSTEM

TECHNICAL FIELD

The present invention relates to printing apparatuses, printing methods, programs and printing systems that print images by ejecting ink onto media.

BACKGROUND ART

Inkjet printers are known as printing apparatuses that print images by ejecting ink onto media. Generally, an inkjet printer can print color images on media by ejecting two or more different colors of ink such as yellow (Y), cyan (C), magenta (M), and black (K).

When printing an image on a medium, such an inkjet printer forms dots by ejecting ink toward positions corresponding to pixels forming the image to be printed. Accordingly, the image printed on the medium is configured by a large number of dots. Here, various printing modes such as an interlaced mode or an overlap mode, for example, are employed in inkjet printers as a method to eject ink toward positions corresponding to each of the pixels of an image to be printed (See JP-A-6-191041).

DISCLOSURE OF INVENTION

Incidentally, when ejecting ink toward the positions corresponding to pixels configuring an image to be printed in order to print that image on a medium, such an inkjet printer sometimes forms a plurality of dots by ejecting ink a plurality of times for one pixel. The purpose of this is to express a color in various gradation levels using a single color of ink by forming a plurality of dots for one pixel, which enables expressing a variety of colors even when the ejection amount of ink cannot be changed stepwise.

However, a problem described below occurs when ink is ejected a plurality of times for one pixel in this way. Specifically, even if ink is ejected for the same pixel, the position on a medium on which ink ejected first lands differs from the position on the medium on which ink subsequently ejected lands. Consequently, there was a case that the position of a dot formed by ink ejected first is displaced significantly from the position of a dot formed by ink subsequently ejected. When the positions in which dots are formed are significantly displaced like this, the position of a dot formed by ink subsequently ejected sometimes overlaps with the position of a dot formed for another pixel, thus causing a problem that dots are not arranged in a balanced manner. When dots are not arranged in a balanced manner, the image quality of the printed image has been adversely affected, such as occurrence of uneven print density or graininess.

The present invention has been devised in consideration of these issues, and it is an object thereof to arrange dots that configure an image to be printed in a balanced manner to improve the image quality of the printed image.

A primary aspect of the present invention for achieving the above-described issue is a printing apparatus that includes:

(A) a carry mechanism that carries a medium along a predetermined direction, (B) a nozzle that performs a moving and ejecting operation for ejecting ink toward the medium while moving relatively with respect to the medium during an interval of a carry operation by the carry mechanism, (C) a signal output section that outputs a first timing defining signal defining a periodical timing for ejecting ink from the nozzle toward a position corresponding to a pixel configuring an image to be printed, and a second timing defining signal defining a periodical timing for ejecting ink from the nozzle toward a position displaced from the position corresponding to a pixel configuring an image to be printed, wherein the signal output section outputs either the first timing defining signal or the second timing defining signal for each moving and ejecting operation.

Other features of the present invention become clear by the description of the present specification with reference to the accompanying drawings.

BRIEF DESCRIPTION OF DRAWINGS

FIG. 23D is a diagram describing an image printing method.

Figure 1:
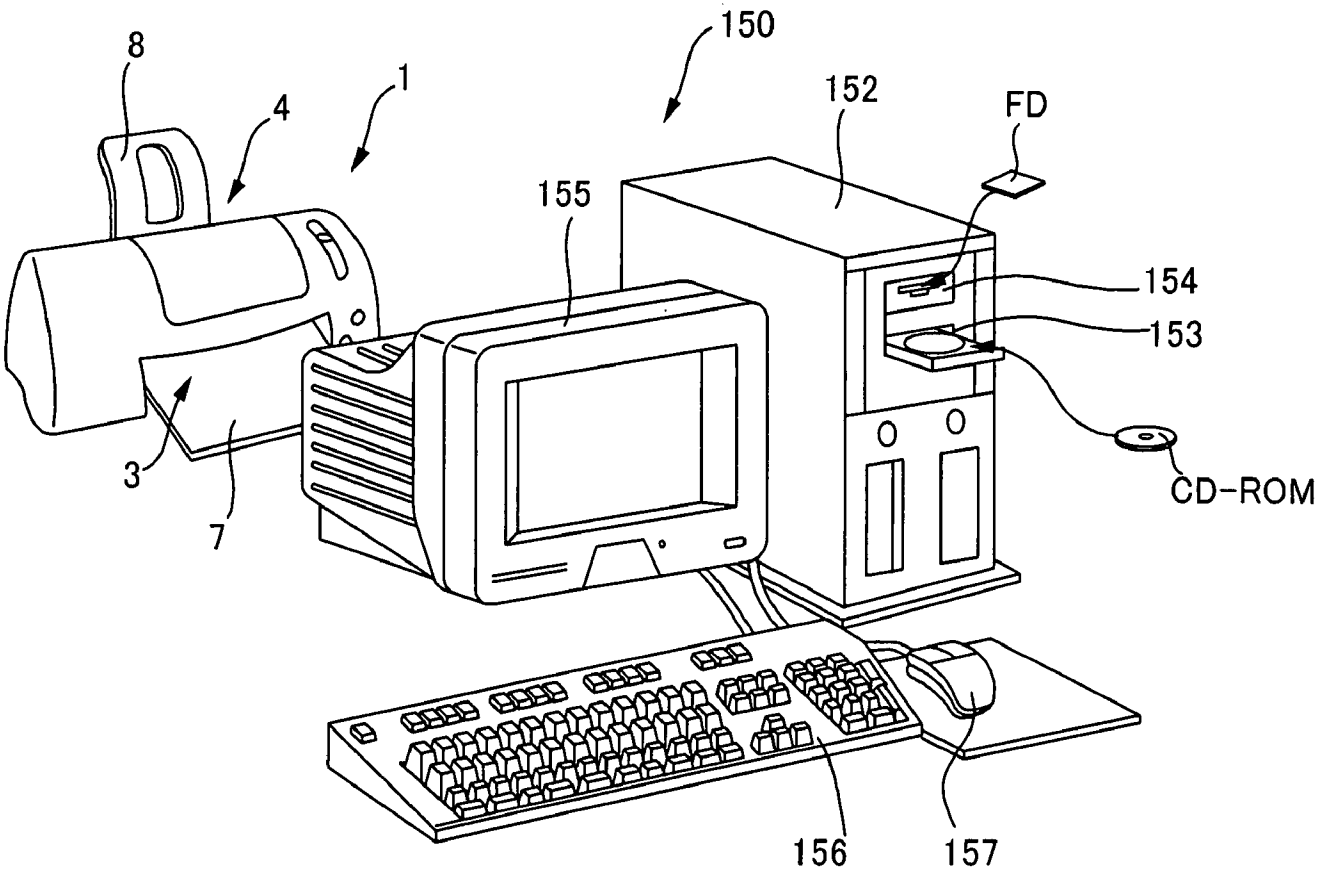
FIG. 1 is an explanatory diagram of an overall configuration of a printing apparatus according to an embodiment of the present invention.

Major reference numerals used in the drawings are described below.

1 inkjet printer, 3 paper-discharge section, 4 paper-supply section, 7 paper-discharge tray, 8 paper-supply tray, 11A paper insert opening, 11B roll paper insert opening, 13 paper-supply roller, 14 platen, 15 carry motor, 17A carry roller, 17B paper-discharge roller, 18A free roller, 18B free roller, 21 head, 30 cleaning unit, 31 pump device, 35 capping device, 41 carriage, 42 carriage motor, 44 pulley, 45 timing belt, 46 guide rail, 48 ink cartridge, 51 linear encoder, 53 paper detection sensor, 122 buffer memory, 124 image buffer, 126 controller, 127 main memory, 128 carriage motor controller, 129 EEPROM, 130 carry controller, 132 head drive section, 134 rotary encoder, 150 system, 152 computer, 153 CD-ROM drive unit, 154 floppy disk drive unit (FDD), 155 display device, 156 keyboard, 157 mouse, 160 application program, 162 video driver, 164 printer driver, 166 resolution conversion processing section, 168 color conversion processing section, 170 halftone processing section, 172 rasterization processing section, 211Y yellow nozzle group, 211M magenta nozzle group, 211C cyan nozzle group, 211K black nozzle group, 220 drive circuit, 222 original drive signal generating section, 224 first shift register, 226 second shift register, 228 latch circuit group, 230 data selector, 452 light-emitting diode, 454 collimator lens, 456 detection processing section, 458 photodiode, 460 signal processing circuit, 462A comparator, 462B comparator, 464 linear encoder code plate, 466 detecting section

BEST MODE FOR CARRYING OUT THE INVENTION

===Overview of the Disclosure===

At least the following matters will be made clear by the explanation in the present specification and the description of the accompanying drawings.

A printing apparatus, comprising:

(A) a carry mechanism that carries a medium along a predetermined direction;

(B) a nozzle that performs a moving and ejecting operation for ejecting ink toward the medium while moving relatively with respect to the medium during an interval of a carry operation by the carry mechanism;

(C) a signal output section that outputs a first timing defining signal defining a periodical timing for ejecting ink from the nozzle toward a position corresponding to a pixel configuring an image to be printed, and a second timing defining signal defining a periodical timing for ejecting ink from the nozzle toward a position displaced from the position corresponding to a pixel configuring an image to be printed, wherein the signal output section outputs either the first timing defining signal or the second timing defining signal for each moving and ejecting operation.

In such a printing apparatus, ink can be ejected toward, in addition to a position corresponding to a pixel configuring an image to be printed in response to the first timing defining signal, to a position displaced from the position corresponding to a pixel configuring an image to be printed in response to the second timing defining signal, therefore, it is possible to arrange dots in a balanced manner and improve the image quality by improving uneven print density or graininess.

In such printing apparatus, it is possible that the first timing defining signal and the second timing defining signal are output alternately from the signal output section. By outputting the first timing defining signal and the second timing defining signal alternately, it is possible to arrange dots in a balanced manner and improve the image quality by improving uneven print density or graininess.

In such printing apparatus, it is possible that a displacement width between the position corresponding to the pixel and the displaced position is narrower than a spacing between pixels configuring an image to be printed. With such narrow displacement width, it is possible to control the dot arrangement at a resolution higher than the resolution of an image to be printed. Therefore, it is possible to arrange dots in a balanced manner and further improve the image quality by improving uneven print density or graininess.

In such printing apparatus, it is possible that the displacement width is a half of the spacing between pixels configuring an image to be printed. If the displacement width is a half of the spacing of pixels, it is possible to control the dot arrangement at a resolution higher than the resolution of an image to be printed. Therefore, it is possible to further improve the image quality by improving uneven print density or graininess.

In such printing apparatus, it is possible that ink is ejected successively two or more times from the nozzle according to a certain timing defined by at least one of the first defining timing signal and the second defining timing signal. In such case as well, it is possible to arrange dots in a balanced manner and improve the image quality by improving uneven print density or graininess.

In such printing apparatus, it is possible that of the ink ejected successively two or more times from the nozzle according to the certain timing, ink ejected first is ejected toward the position corresponding to the pixel or the displaced position. By ejecting ink in this manner, it is possible to arrange dots in a more balanced manner. As a result, the image quality can be further improved.

In such printing apparatus, it is possible that when ink is ejected successively two or more times from the nozzle according to the certain timing, a spacing between a position on the medium on which ink ejected first lands and a position on the medium on which ink ejected last lands is wider than a spacing between pixels configuring an image to be printed. When the distance between the positions on which ink ejected each time lands is wider than the spacing between pixels configuring the image to be printed, it is possible to arrange dots in a more balanced manner and further improve the image quality.

In such printing apparatus, it is possible that when ink is ejected successively two or more times from the nozzle according to the certain timing, the quantity of ink ejected each time differs. Even when the amount of ink ejected each time differs, it is possible to arrange dots in a more balanced manner and further improve the image quality.

In such printing apparatus, it is possible that the moving and ejecting operation for ejecting ink to be ejected toward a position corresponding to a certain pixel configuring the image and ink ejected toward a position displaced from such position is different from the moving and ejecting operation for ejecting ink to be ejected toward a position corresponding to another pixel adjacent to the certain pixel in a moving direction of the nozzle and a position displaced from such position. With such printing apparatus, it is possible to arrange dots in a more balanced manner and further improve the image quality.

In such printing apparatus, it is possible that the printing apparatus is provided with a plurality of the nozzles. Even if a plurality of the nozzles are provided, it is possible to arrange dots in a more balanced manner and further improve the image quality.

A printing apparatus comprising:

(A) a carry mechanism that carries a medium along a predetermined direction;

(B) a nozzle that performs a moving and ejecting operation for ejecting ink toward the medium while moving relatively with respect to the medium during an interval of a carry operation by the carry mechanism;

(C) a signal output section that outputs a first timing defining signal defining a periodical timing for ejecting ink from the nozzle toward a position corresponding to a pixel configuring an image to be printed, and a second timing defining signal defining a periodical timing for ejecting ink from the nozzle toward a position displaced from the position corresponding to a pixel configuring an image to be printed, wherein the signal output section outputs either the first timing defining signal or the second timing defining signal is output for each of the moving and ejecting operation, wherein (E) the first timing defining signal and the second timing defining signal are output alternately from the signal output section, (F) a displacement width between the position corresponding to the pixel and the displaced position is narrower than a spacing between pixels configuring an image to be printed, (G) the displacement width is a half of the spacing between pixels configuring an image to be printed, (H) ink is ejected successively two or more times from the nozzle according to a certain timing defined by at least either one of the first defining timing signal and the second defining timing signal, (I) of the ink ejected successively two or more times from the nozzle according to the certain timing, ink ejected first is ejected toward the position corresponding to the pixel or the displaced position, (J) when ink is ejected successively two or more times from the nozzle according to the certain timing, a spacing between a position on the medium on which ink first ejected lands and a position on the medium on which ink last ejected lands is wider than a spacing between pixels configuring an image to be printed, (K) when ink is ejected successively two or more times from the nozzle according to the certain timing, the quantity of ink ejected each time differs, (L) the moving and ejecting operation for ejecting ink to be ejected toward a position corresponding to a certain pixel configuring the image to be printed and ejected toward a position displaced from such position, is different from the moving and ejecting operation for ejecting ink to be ejected toward a position corresponding to another pixel adjacent to the certain pixel in a moving direction of the nozzle, and a position displaced from such position, and (M) provided with a plurality of the nozzles.

A printing method comprising:

a step of carrying a medium along a predetermined direction;

a step of performing a moving and ejecting operation for ejecting ink toward the medium from a nozzle while moving the nozzle relatively with respect to the medium, during an interval of carrying the medium;

a step of outputting a first timing defining signal defining a periodical timing for ejecting ink from the nozzle toward a position corresponding to a pixel configuring an image to be printed;

a step of outputting a second timing defining signal for defining a periodical timing to eject ink from the nozzle toward a position displaced from the position corresponding to a pixel configuring an image to be printed; and a step of selecting either the first timing defining signal or the second timing defining signal as a signal to be output for each moving and ejecting operation.

A program that executes a step of carrying a medium along a predetermined direction, a step of performing a moving and ejecting operation for ejecting ink toward the medium from a nozzle while moving the nozzle relatively with respect to the medium, during an interval of carrying the medium, a step of outputting a first timing defining signal defining a periodical timing for ejecting ink from the nozzle toward a position corresponding to a pixel configuring an image to be printed, a step of outputting a second timing defining signal defining a periodical timing for ejecting ink from the nozzle toward a position displaced from the position corresponding to a pixel configuring an image to be printed, and a step of selecting either the first timing defining signal or the second timing defining signal as a signal to be output for each moving and ejecting operation.

A printing system comprising a computer and a printing apparatus capable of communicating with the computer, wherein the printing apparatus includes:

a carry mechanism that carries a medium along a predetermined direction;

a nozzle that performs a moving and ejecting operation for ejecting ink toward the medium while moving relatively with respect to the medium, during an interval of a carry operation by the carry mechanism, and a signal output section that outputs a first timing defining signal defining a periodical timing for ejecting ink from the nozzle toward a position corresponding to a pixel configuring an image to be printed, and a second timing defining signal defining a periodical timing for ejecting ink from the nozzle toward a position displaced from the position corresponding to a pixel configuring an image to be printed, wherein the signal output section outputs either the first timing defining signal or the second timing defining signal for each moving and ejecting operation.

===Outline of Printing Apparatus===

A printing apparatus according to an embodiment of the present invention is described with an inkjet printer 1 serving as an example.

FIG. 1 shows the inkjet printer 1. The inkjet printer 1 is communicably connected to a computer 152 by wired or wireless connections and so forth. It should be noted that, a system 150 which consists of the inkjet printer 1 and the computer 152 corresponds to a printing system.

The computer 152 is various types of computers such as a personal computer or the like, and generally, is internally provided with various types of arithmetic processing units such as a CPU, various types of memories such as a RAM or a ROM, a hard disk drive apparatus (not shown) and various types of drive apparatuses such as a CD-ROM drive unit 153, a floppy disk drive unit (FDD) 154 and so on. In addition, besides these, the computer 152 has a display device 155 such as a CRT display, an input device such as a keyboard 156 and a mouse 157 connected to it.

The computer 152 reads out programs from various types of memories and drive apparatuses, and performs each of the programs under various types of operating systems (Operating System: OS). As the program controlling the ink jet printer 1 connected to the computer 152, a printer driver is included in the programs performed here. This printer driver is a program installed on the computer 152 via communication lines such as an internet, or a storage medium such as a CD-ROM or a floppy disk (FD) and so forth. The computer 152 can fulfill its function as so called printing control apparatus which controls the inkjet printer 1 (printing apparatus), by installing this printer driver in the computer 152. The function of this printer driver is described in detail.

===Printer Driver===

<About Printer Driver>

Figure 2:
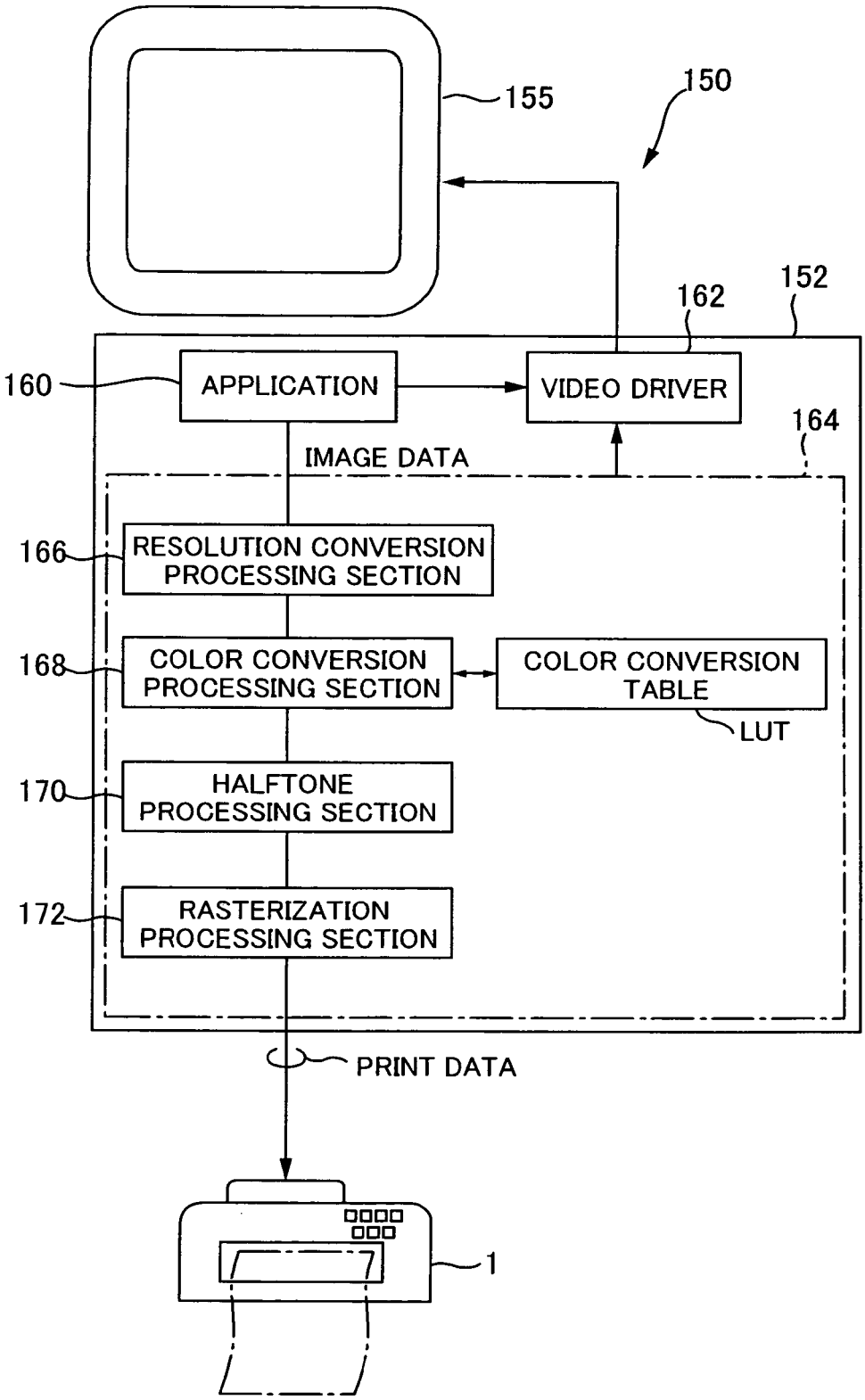
FIG. 2 is an explanatory diagram describing the outline of processes performed by a printer driver.

Outline of the process of the printer driver is described. FIG. 2 schematically describes the process of the printer driver. In the computer 152, various computer programs such as a video driver 162, an application program 160, and a printer driver 164 are performed under the operating system installed in the computer 152. The video driver 162 has a function, for example, of displaying a user interface or the like on the display device 155 by following a display command from the application program 160 or the printer driver 164. The application program 160 has a function, for example, of performing image editing or the like, and creates data relating to images (an image data). A user can give an order of printing an image edited by the application program 160 via the user interface of the application program 160. The application program 160 outputs image data to the printer driver 164 when receiving a print order.

The printer driver 164 receives image data from the application program 160, converts the image data into print data, and outputs the print data to the inkjet printer 1. Here, "print data" refers to data which is in a format that can be interpreted by the inkjet printer 1, and is data that includes various types of command data and pixel data. Also, the command data refers to data for ordering the inkjet printer 1 to carry out a specific operation. Furthermore, pixel data refers to data relating to pixels which configure an image to be printed (print image), for example, the data which relates to a dot formed on a position on a medium S corresponding to a certain pixel (data for dot color and size, and so on).

The printer driver 164 is provided with a resolution conversion processing section 166, a color conversion processing section 168, a halftone processing section 170, and a rasterization processing section 172 in order to convert image data output from the application program 160 into print data. Following are descriptions of various types of processes performed by each of the processing sections 166, 168, 170, and 172 of the printer driver 164.

The resolution conversion processing section 166 performs a resolution conversion process of converting image data (text data, image data, and so forth) output from the application program 160 into a resolution at the time of printing on a medium S. The resolution conversion process is, for example, converting the resolution of the image data received from the application program 160 into the resolution of 720×720 dpi, when the resolution of printing an image on a paper is specified as 720×720 dpi. It should be noted that, after the resolution conversion process, the image data is multi-gradation RGB data (256 gradations, for example) expressed in RGB color space. Hereinafter, the RGB data obtained by subjecting image data to resolution conversion processing is referred to as "RGB image data".

The color conversion processing section 168 performs a color conversion process in which the RGB data is converted into CMYK data expressed in CMYK color space. It should be noted that, the CMYK data is the data which corresponds to the ink colors which the inkjet printer 1 possesses. This color conversion process is performed, by the printer driver 164 referring to a table in which the gradation values of RGB image data correspond to the gradation values of CMYK image data (a color conversion look-up table LUT). By this color conversion process, the RGB data for each pixel are converted into the CMYK data which corresponds to ink color. It should be noted that, after the color conversion process, data is CMYK data with 256 gradations expressed in CMYK color space. Hereinafter, CMYK data obtained by subjecting RGB image data to color conversion processing is referred to as "CMYK image data".

The halftone processing section 170 performs a halftone process in which the data in a high number of gradations is converted to data in a number of gradations that can be formed by the inkjet printer 1. Halftone processing is, for example, a process in which data expressing 256 gradations are converted to 1-bit data expressing two gradations or 2-bit data expressing four gradations. In halftone processing, the pixel data is created such that the inkjet printer 1 can form dots in a dispersed manner, using methods such as dithering, gamma correction, and error diffusion. During halftone processing, the halftone processing section 170 references a dither table when performing the dithering, references a gamma table when performing the gamma correction, and references an error memory for storing diffused error when performing the error diffusion. Data subjected to halftone processing has a resolution (for example, 720×720 dpi) equivalent to the above-mentioned described RGB data. The data subjected to halftone processing is constituted by, for example, 1-bit or 2-bit data for each pixel. Hereinafter, in regard to the data subjected to halftone processing, 1-bit data is referred to as binary data, and 2-bit data is referred to as multi-value data.

The rasterization processing section 172 performs a rasterization process so that data such as the binary data or the multi-value data obtained after the halftone process at the halftone processing section is changed in the order to be transferred to the inkjet printer 1. Thus, the data subjected to rasterization process processing is output to the inkjet printer 1.

<Regarding the Settings of the Printer Driver 164>

Figure 3:
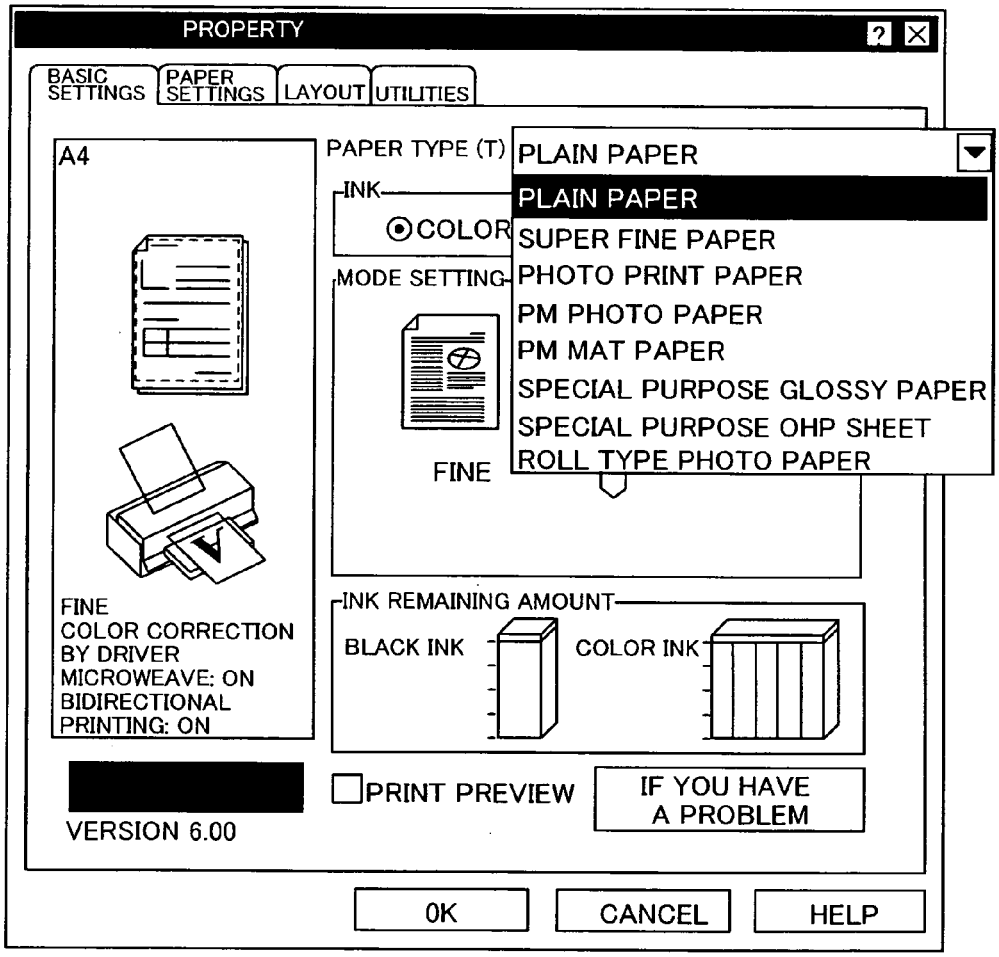
FIG. 3 is an explanatory diagram of a user interface of the printer driver.

FIG. 3 is an explanatory diagram of the user interface of the printer driver 164. The user interface of the printer driver 164 is displayed on the display device 155 via the video driver 162. The user can use the keyboard 156 or the mouse 157 to perform various types of settings of the printer driver 164.

From this screen, the user can select the print resolution (dot spacing when printing). For example, the user can select from this screen 720 dpi or 360 dpi as the print resolution. The printer driver 164 performs resolution conversion processing in accordance with the selected resolution and converts image data to print data.

Furthermore, from this screen, the user can select the print paper (medium) to be used for printing. For example, the user can select a plain paper or a glossy paper as the print medium. Since the way ink is absorbed and the way ink dries varies if the type of medium (paper type) varies, the amount of ink suitable for printing also varies. For this reason, the printer driver 164 converts image data to print data in accordance with the selected paper type.

Furthermore, from this screen, the user can select the type of the image to be printed. Here, for example, the user can select "color printing" or "monochrome printing" as the type of the image to be printed.

The user can also select the print mode from this screen. The printer driver 164 converts image data to print data, such that the data is in a format corresponding to the print mode selected by the user. A detailed explanation of the print modes that can be selected by the user is given further below.

In this way, the printer driver 164 converts the image data to the print data in accordance with conditions that are set via the user interface. It should be noted that, in addition to performing various types of settings of the printer driver 164, the user can also be notified, through this screen, of such information as the amount of ink remaining in ink cartridges.

===Configuration of the Inkjet Printer 1===

As shown in FIG. 1, the inkjet printer 1 has a structure in which a medium S, such as a print paper or the like, that is supplied from the rear side is discharged to the front side. At its rear side, the inkjet printer 1 is provided with a paper-supply section 4 in which the medium S to be printed is set. This paper-supply section 4 is provided with a paper-supply tray 8 for supporting the medium S. Also, at its front side, the inkjet printer 1 is provided with a paper-discharge section 3 onto which the printed medium S is discharged. This paper-discharge section 3 is provided with a paper-discharge tray 7 for holding the printed medium S that has been discharged.

Figure 4:
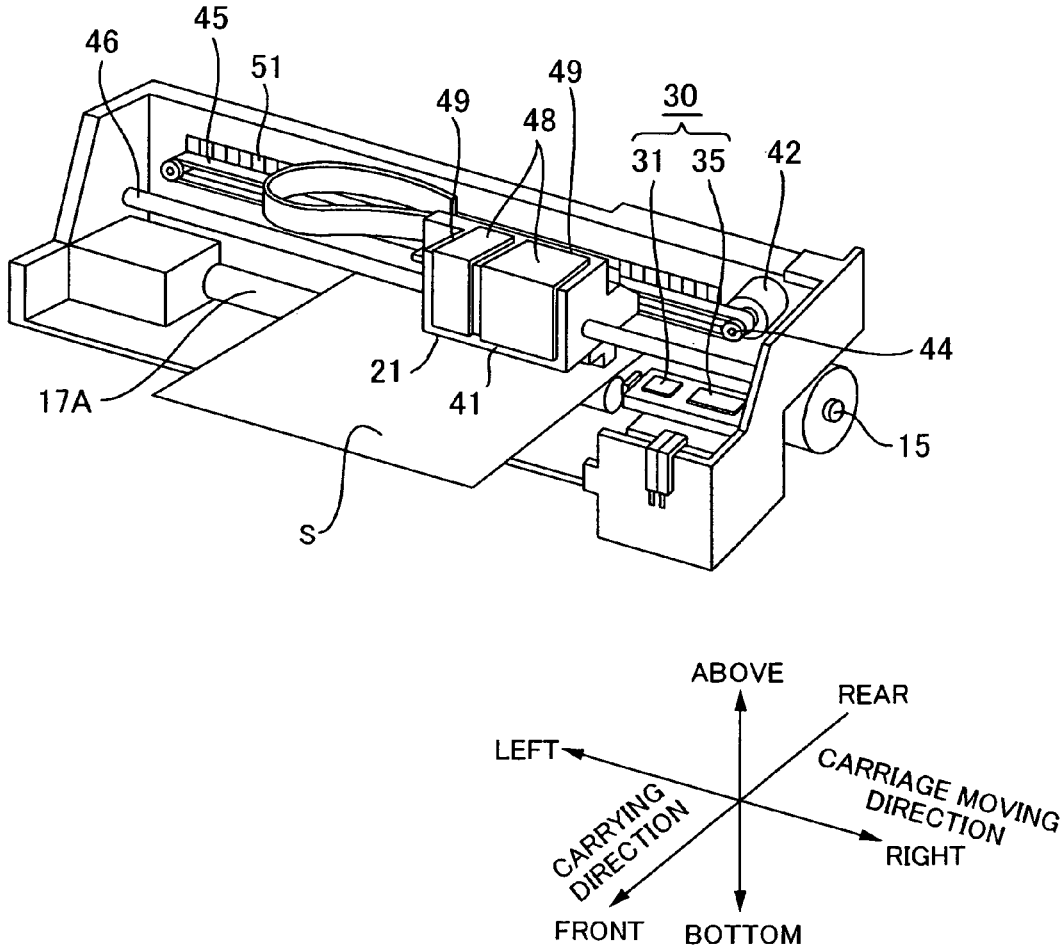
FIG. 4 is a perspective view showing the internal configuration of an inkjet printer.
Figure 5:
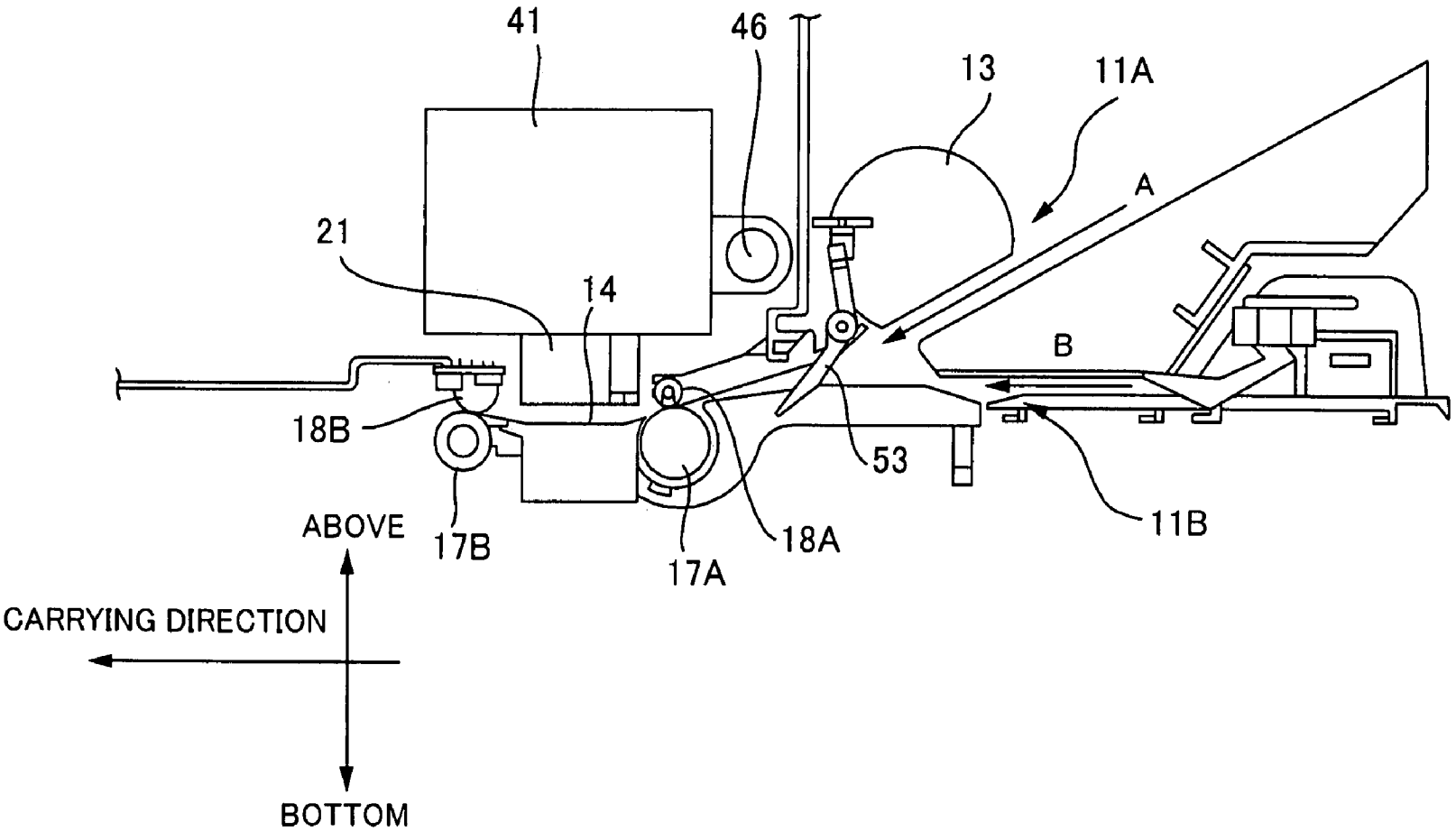
FIG. 5 is a vertical cross-sectional view showing the internal configuration of the inkjet printer.
Figure 6:
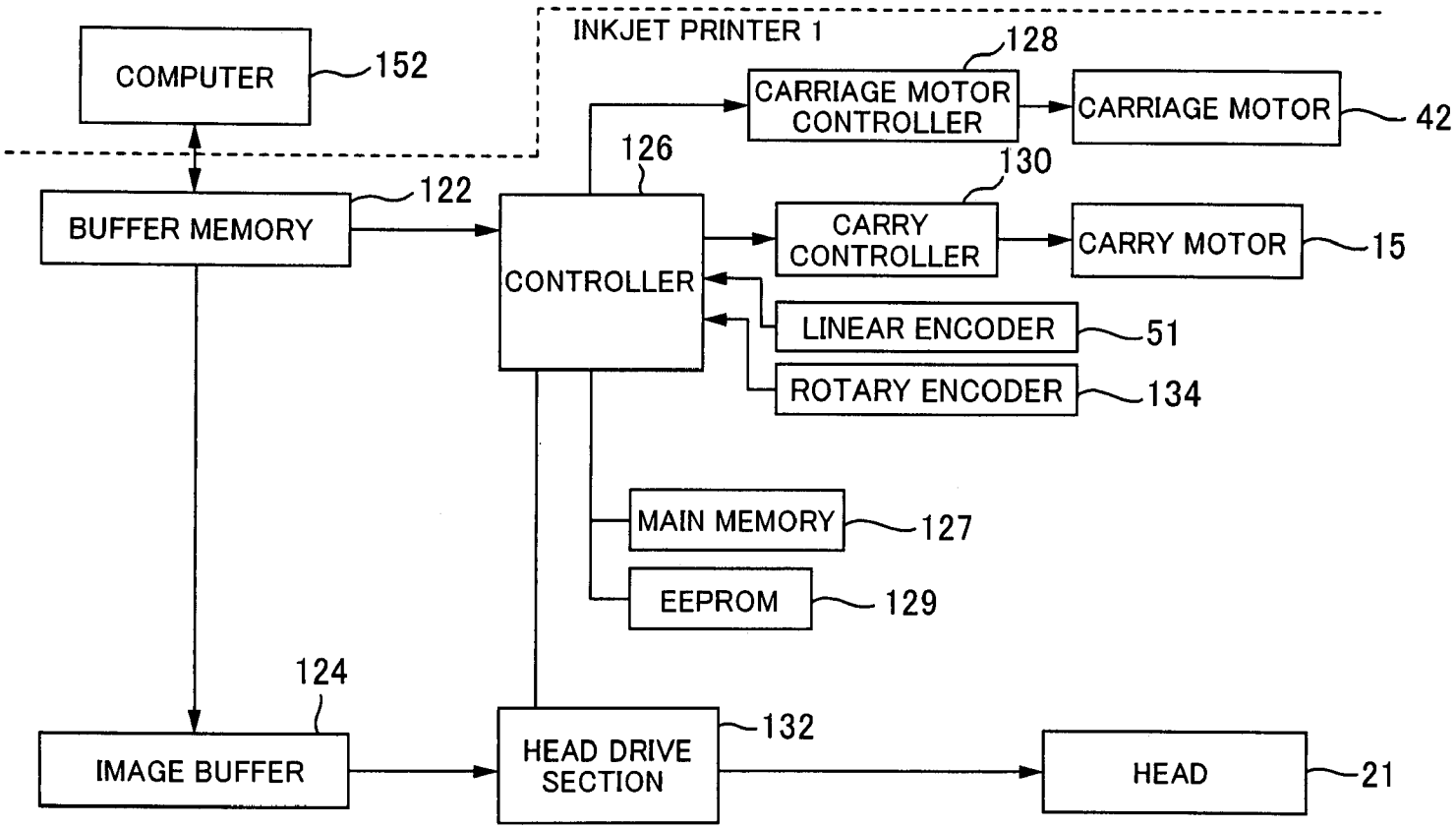
FIG. 6 is a block diagram describing the system configuration of the inkjet printer.

The following is a description of the internal configuration of the inkjet printer 1. FIGS. 4 to 6 illustrate the internal configuration of the inkjet printer 1. FIG. 4 illustrates a printing mechanism of the inkjet printer 1. FIG. 5 illustrates a carry mechanism of the inkjet printer 1. FIG. 6 is a block diagram illustrating the system configuration of the inkjet printer 1.

As shown in FIG. 4, the inkjet printer 1 is provided internally with a carriage 41. The carriage 41 is provided so that it can move relatively along the left-to-right direction in FIG. 4 (also referred to as "carriage movement direction"). A carriage motor (hereafter also referred to as "CR motor") 42, a pulley 44, a timing belt 45, and a guide rail 46 are provided in the vicinity of the carriage 41. The carriage motor 42 is constituted by a DC motor or the like and functions as a drive source for moving the carriage 41 relatively along the carriage movement direction (left-to-right direction). The timing belt 45 is connected to the carriage motor 42 via the pulley 44. A part of the timing belt 45 is connected to the carriage 41, and moves the carriage 41 relatively along the carriage movement direction (left-to-right direction) by rotational drive of the carriage motor 42. The guide rail 46 guides the carriage 41 along the carriage movement direction (left-to-right direction).

In addition, a linear encoder 51 for detecting the position of the carriage 41, a carry roller 17A for carrying the medium S in a direction that intersects the moving direction of the carriage 41 (hereinafter also referred to as carrying direction, corresponds to "predetermined direction"), and a carry motor 15 for driving the carry roller 17A rotationally are provided in the vicinity of the carriage 41.

On the other hand, the carriage 41 is provided with an ink cartridges 48 that contain various types of ink and a head 21 that carries out printing on the medium S. The ink cartridges 48 contain ink of various colors such as yellow (Y), magenta (M), cyan (C), and black (K), for example, and are mounted in a cartridge mounting section 49 provided in the carriage 41 in a removable manner. Furthermore, in this embodiment, the head 21 carried out printing by ejecting ink onto the medium S. For this reason, a large number of nozzles for ejecting ink are provided in the head 21. A detailed description of the ink ejecting mechanism of the head 21 is given later.

Additionally, a cleaning unit 30 for clearing clogging of the nozzles of the head 21 is provided inside the inkjet printer 1. The cleaning unit 30 has a pump device 31 and a capping device 35. The pump device 31 is a device that sucks out ink from the nozzles in order to overcome clogging of the nozzles of the head 21, and is operated by a pump motor (not shown). The capping device 35 is for sealing the nozzles of the head 21 when printing is not being performed (for example during standby), so that the nozzles of the head 21 are kept from clogging.

The following is a description of the configuration of a carry section of the inkjet printer 1. As shown in FIG. 5, the carry section has a paper insert opening 11A and a roll paper insert opening 11B, a paper-supply motor (not shown), a paper-supply roller 13, a platen 14, a carry motor (hereinafter, also referred to as "PF motor") 15, a carry roller 17A and a paper-discharge roller 17B, and a free roller 18A and a free roller 18B. Of these, the carry motor 15, the carry roller 17A, the paper-discharge roller 17B and the like correspond to a carry mechanism.

The paper insert opening 11A is where the medium S is inserted. The paper-supply motor (not shown) is a motor for carrying the medium S that has been inserted into the paper insert opening 11A into the inkjet printer 1, and is constituted by a pulse motor, etc. The paper-supply roller 13 is a roller for automatically carrying the medium S automatically that has been inserted into the paper insert opening 11A into the inkjet printer 1 in the arrow direction A (arrow direction B in case of roll paper) in the figure, and is driven by the paper-supply motor. The paper-supply roller 13 has a transverse cross-sectional shape that is substantially the shape of the letter D. Since the peripheral length of a circumference portion of the paper-supply roller 13 is set longer than the carrying distance to the carry motor 15, so that by using this circumference portion, the medium S can be carried up to the carry motor 15.

The medium S that has been carried by the paper-supply roller 13 abuts against a paper detection sensor 53. This paper detection sensor 53 is positioned between the paper-supply roller 13 and the carry roller 17A, so that it detects the medium S that is supplied by the paper-supply roller 13.

The medium S that is detected by the paper detection sensor 53 is carried to the platen 14. The platen 14 is a support section that supports the medium S on which printing is being performed. The carry motor 15 is a motor for carrying paper, which is an example of the medium S, in the carrying direction of the paper and is constituted by a DC motor. The carry roller 17A is a roller for carrying the medium S that has been carried into the inkjet printer 1 by the paper-supply roller 13 to a printable region, and is driven by the carry motor 15. The free roller 18A is provided in a position that is in opposition to the carry roller 17A, pushes the medium S toward the carry roller 17A by sandwiching the medium S between itself and the carry roller 17A.

The paper-discharge roller 17B is a roller for discharging the medium S for which printing has finished to outside the inkjet printer 1. The paper-discharge roller 17B is driven by the carry motor 15 by a gear wheel that is not shown in the drawings. The free roller 18B is provided in a position that is in opposition to the paper-discharge roller 17B, and pushes the medium S toward the paper-discharge roller 17B by sandwiching the medium S between itself and the paper-discharge roller 17B.

The following is a description concerning the system configuration of the inkjet printer 1. As shown in FIG. 6, the inkjet printer 1 is provided with a buffer memory 122, an image buffer 124, a controller 126, a main memory 127, and an EEPROM 129. The buffer memory 122 receives and temporarily stores various types of data such as print data sent from the computer 152. Also the image buffer 124 obtains the received print data from the buffer memory 122 and stores it. Furthermore, the main memory 127 is constituted by a ROM or a RAM, for example.

On the other hand, the controller 126 reads out a control program from the main memory 127 and performs overall control of the inkjet printer 1 in accordance with the control program. The controller 126 of the present embodiment is provided with a carriage motor controller 128, a carry controller 130, a head drive section 132, a rotary encoder 134, and the linear encoder 51. The carriage motor controller 128 performs drive control of the carriage motor 42 for such aspects as rotational direction, number of rotations, torque and the like. Furthermore, the head drive section 132 performs drive control of the head 21. The carry controller 130 controls various drive motors that are arranged in the carry system, such as the carry motor 15 that rotationally drives the carry roller 17A.

Print data that has been transferred from the computer 152 is temporarily held in the buffer memory 122. Necessary information contained in the print data held here is read out by the controller 126. Based on the information that is read out, the controller 126 controls each of the carriage motor controller 128, the carry controller 130, and the head drive section 132 in accordance with a control program, while referencing output from the linear encoder 51 and the rotary encoder 134.

Print data of a plurality of color components received by the buffer memory 122 is stored in the image buffer 124. The head drive section 132 obtains the print data of the various color components from the image buffer 124 in accordance with control signals from the controller 126, and drives the drive control of the various color nozzles provided in the head 21 based on the print data.

===Configuration of the Head===

Figure 7:
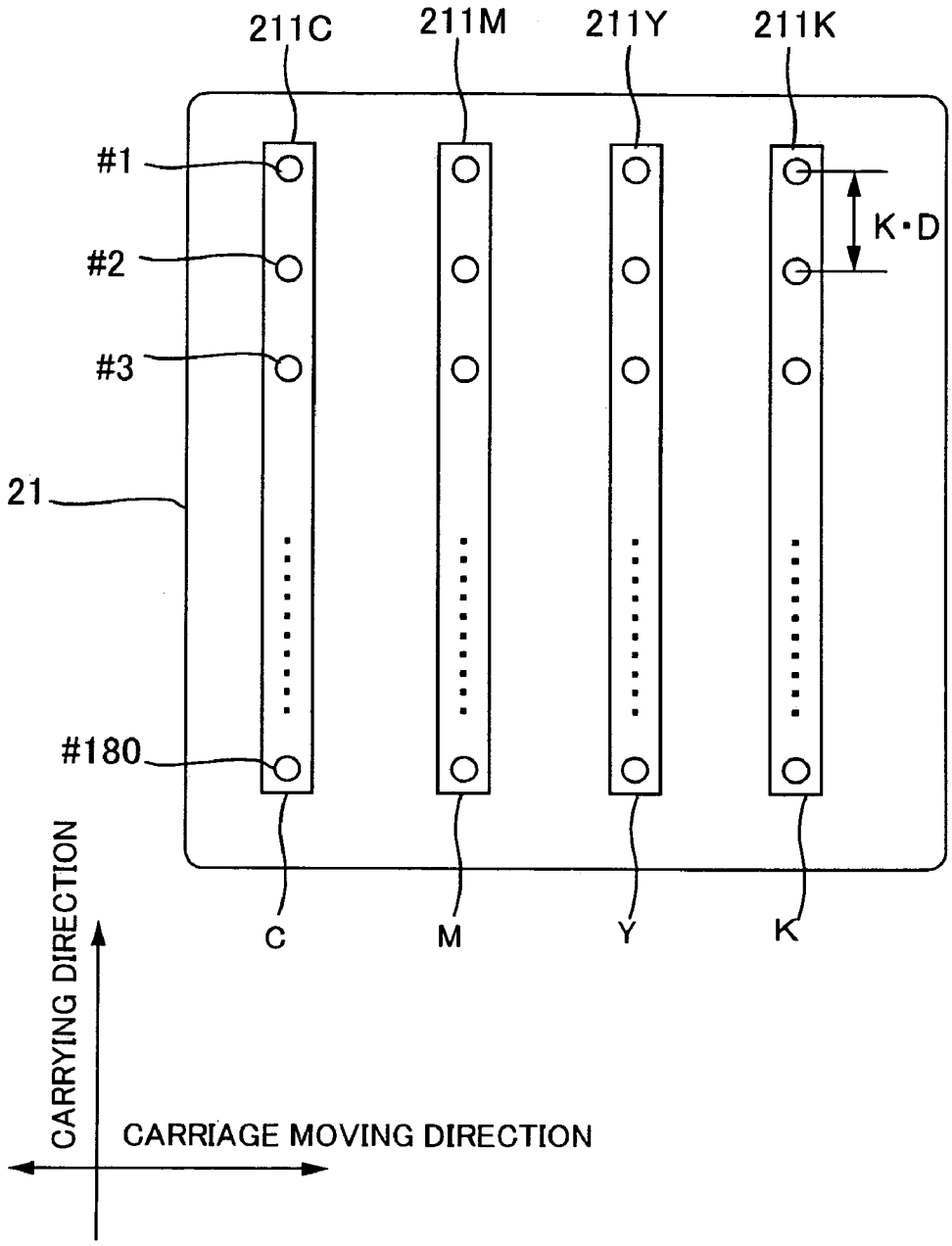
FIG. 7 is an explanatory diagram showing an arrangement of nozzles of a head.

FIG. 7 shows the arrangement of the nozzles in the lower surface of the head 21. As shown in this drawing, a plurality of types of nozzle groups 211Y, 211M, 211C, and 211K for ejecting ink of different colors are provided in the lower surface of the head 21. In this embodiment, a yellow nozzle group 211Y for ejecting yellow (Y) ink, a magenta nozzle group 211M for ejecting magenta (M) ink, a cyan nozzle group 211C for ejecting cyan (C) ink, and a black nozzle group 211*k* for ejecting black (k) ink are provided in the head 21 as nozzle groups.

Each of the nozzle groups 211Y, 211M, 211C, and 211K are provided with a plurality (in this embodiment, 180) of nozzles #1 to #180 as ejection openings for ejecting the ink. These nozzle groups 211Y, 211M, 211C and 211K are arranged in the moving direction of the carriage 41 at a mutual interval. The nozzle groups 211Y, 211M, 211C and 211K are arranged such that their positions in the carrying direction are aligned. That is, the nozzles #1 to #180 of each of the nozzle groups 211Y, 211M, 211C and 211K are arranged such that nozzles with the same numbers are positioned at the same positions in the carrying direction. Here, the nozzle spacing (nozzle pitch) of each of the nozzle groups 211Y, 211M, 211C and 211K is each set evenly to "k D". Here, D is the minimum dot pitch in the carrying direction (in other words, the spacing at the highest resolution of the dots formed on the medium S). Also, k is an integer of 1 or more. For example, if the nozzle pitch is 120 dpi (1/120 inch), and the dot pitch in the carrying direction is 360 dpi (1/360), then k=3.

The nozzles #1 to #180 in each of the nozzle groups 211Y, 211M, 211C, and 211K are assigned a number (#1 to #180) that becomes smaller the more downstream the nozzle is in the carrying direction of the medium S. That is, the nozzle #1 is positioned more downstream in the carrying direction than the nozzle #180. Also, a paper width sensor 54 is provided in substantially the same position as the nozzle #180 that is on the most upstream side, as regards its position in the carrying direction. Each nozzle #1 to #180 is provided with a piezo element (not shown) as a drive element for driving those nozzles #1 to #180 and letting it eject ink.

When a voltage of a predetermined duration is applied between electrodes provided at both ends of the piezo elements, the piezo elements expand for the duration of voltage application and deform a lateral wall of the ink channel. As a result, the volume of the ink channel is constricted according to the expansion and constriction of the piezo element, and ink corresponding to this amount of constriction becomes an ink droplet that is ejected from each nozzle #1 to #180 of each color.

===Printing Operation===

Figure 8:
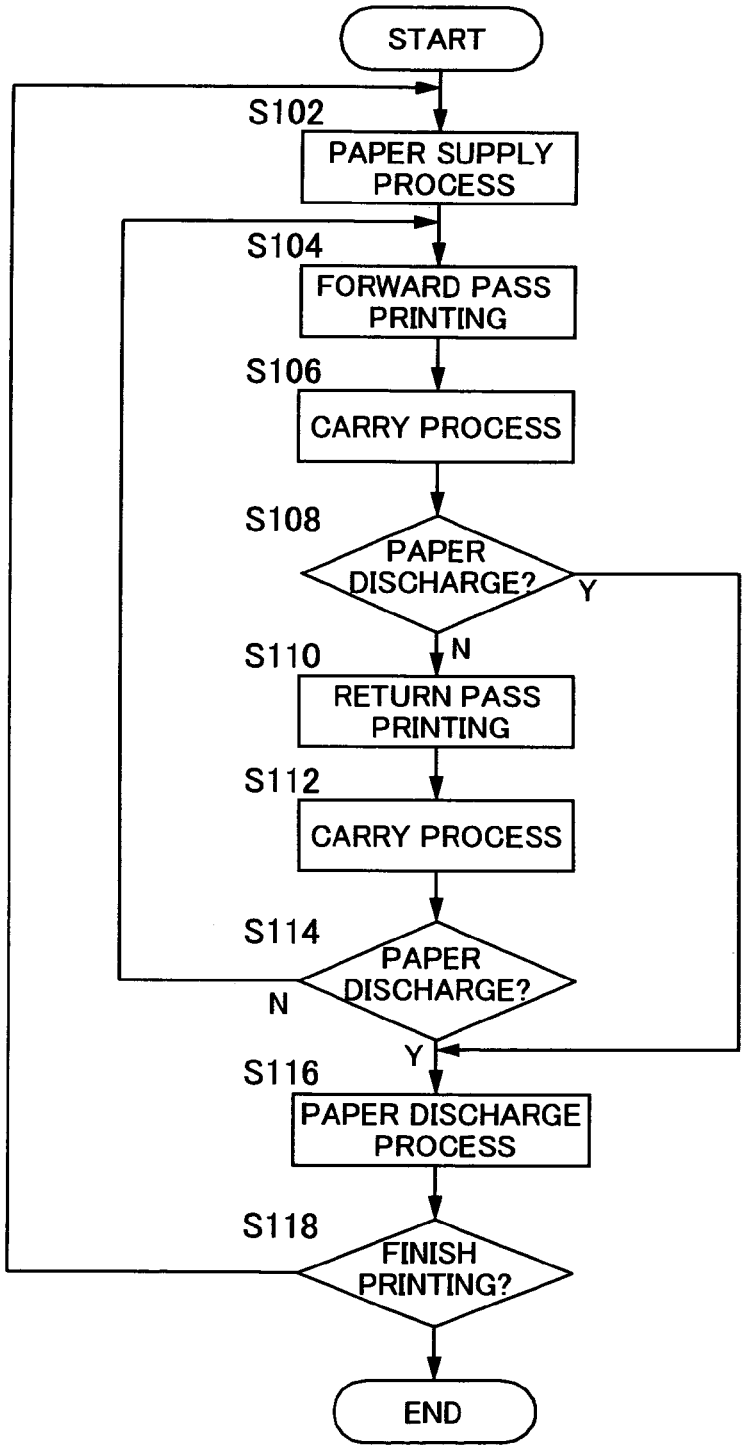
FIG. 8 is a flow chart describing an example of print processing.

The following is a description concerning a printing operation of the above-described inkjet printer 1. Here, an example of "bidirectional printing" is explained. FIG. 8 is a flowchart showing an example of a processing procedure of the printing operation of the inkjet printer 1. The controller 126 reads out the program stored in the main memory 127 or the EEPROM 129, and performs the processes described below in accordance with this program.

When the controller 126 receives print data from the computer 152, in order to perform printing in accordance with the print data, first, the controller 126 performs a paper supplying process (S102). The paper supplying process is a process for supplying the medium S to be printed into the inkjet printer 1, and carrying it to a print start position (also referred to as "indexing position"). The controller 126 rotates the paper-supply roller 13 to send the medium S to be printed up to the carry roller 17A. The controller 126 rotates the carry roller 17A to position the medium S that has been sent from the paper-supply roller 13 at the print start position.

Next, the controller 126 performs a printing process in which the medium S is printed while moving the carriage 41 relatively with respect to the medium S. It should be noted that the "printing operation" is performed by this printing process. Here, first, forward pass printing in which ink is ejected from the head 21 is performed while moving the carriage 41 in one direction along the guide rail 46 (S104). The controller 126 moves the carriage 41 by driving the carriage motor 42, and ejects ink by driving the head 21 in accordance with the print data. The ink ejected from the head 21 reaches the medium S, forming dots.

After printing in this manner, next a carry process of carrying the medium S by a predetermined amount is carried out (S106). It should be noted that the "carry operation" is performed in this carry process. In this carry process, the controller 126 rotates the carry roller 17A by driving the carry motor 15, and carries the medium S in the carrying direction relative to the head 21 by the predetermined amount. With this carry process, the head 21 can print onto a region that is different from the region printed on before.

After performing the carry process in this manner, a paper discharge judgment is performed, in which whether the paper should be discharged or not is determined (S108). Here, a paper discharge process is performed if there is no more data to be printed on the medium S currently being printed (S116). On the other hand, if there is data left to be printed onto the medium S that is currently being printed, then no paper discharge process is performed and return pass printing is performed (S110). In this return pass printing, printing is performed by moving the carriage 41 along the guide rail 46 in the opposite direction to the previous forward pass printing. Also here, the controller 126 moves the carriage 41 by rotationally driving the carriage motor 42 in the opposite direction as before, ejects ink by driving the head 21 based on the print data, and performs printing.

After the return pass printing has been performed, a carry process is performed (S112), and then a paper discharge judgment is performed (S114). Here, if there is data left to be printed onto the medium S that is currently being printed, then no paper discharge process is performed, the process returns to step S104, and the forward pass printing is performed again (S104). On the other hand, a paper discharge process is performed if there is no more data to be printed onto the medium S that is currently being printed (S116).

After the paper discharge process has been carried out, next a print completion judgment is carried out in which it is determined whether or not printing is completed (S118). Here, based on the print data from the computer 152, it is checked whether or not there is a further medium S to be printed left. If there is a further medium S to be printed left, then the process returns to step S102, another paper feed process is carried out, and printing is started. On the other hand, if no further medium S to be printed is left, then the printing process is terminated.

===Linear Encoder===

<Configuration of Encoder>

Figure 9:
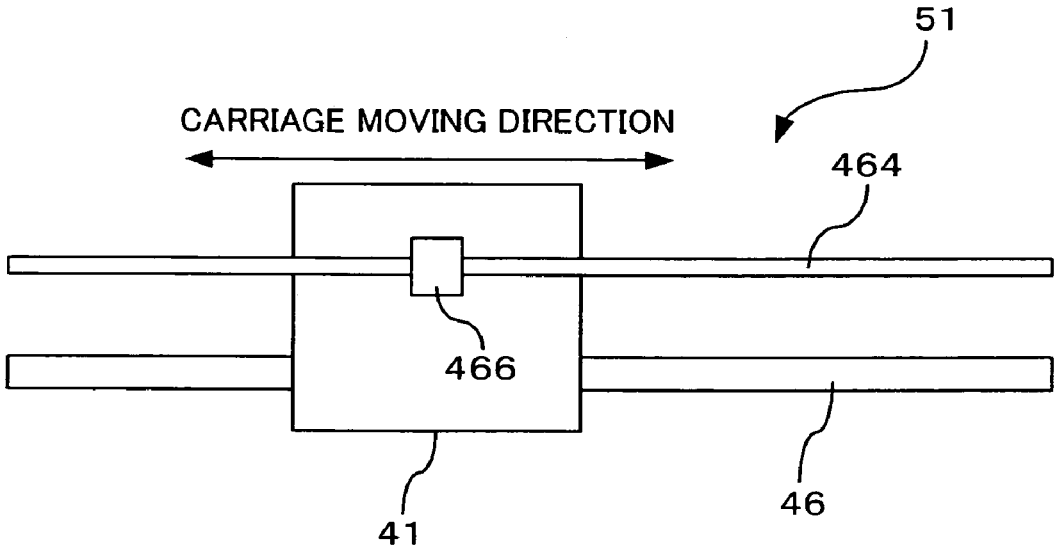
FIG. 9 is a diagram schematically describing the configuration of a linear encoder.

FIG. 9 schematically shows the configuration of the linear encoder 51. The linear encoder 51 is provided with a linear encoder code plate 464 and a detecting section 466. As shown in FIG. 4, the linear encoder code plate 464 is attached to the frame side inside the inkjet printer 1. On the other hand, the detecting section 466 is attached to the carriage 41 side. When the carriage 41 moves along the guide rail 46, the detecting section 466 moves relatively along the linear encoder code plate 464. Accordingly, the detecting section 466 detects the amount that the carriage 41 has moved.

<Configuration of the Detecting Section>

Figure 10:
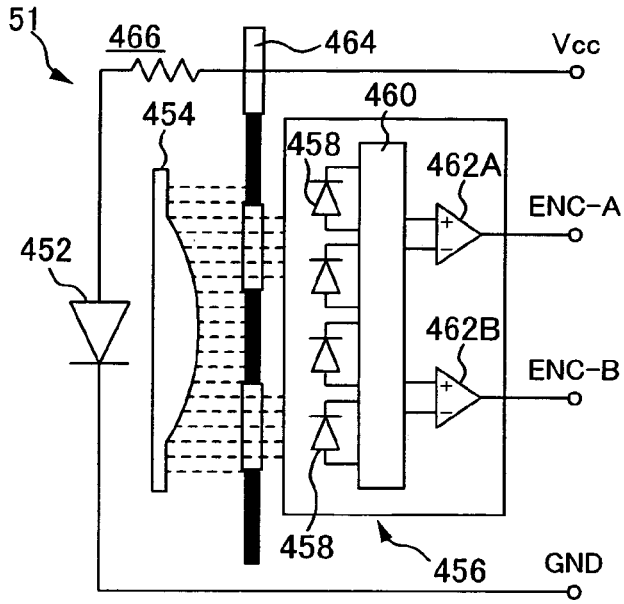
FIG. 10 is a diagram schematically describing the configuration of a detecting section of the linear encoder.

FIG. 10 schematically shows the configuration of the detecting section 466. The detecting section 466 is provided with a light-emitting diode 452, a collimating lens 454, and a detection processing section 456. The detection processing section 456 has a plurality of (for instance, four) photodiodes 458, a signal processing circuit 460, and for example two comparators 462A and 462B.

The light-emitting diode 452 emits light when a voltage Vcc is applied via resistors to both ends of the light-emitting diode 452. This light is condensed into parallel light by the collimating lens 454 and passes through the linear encoder code plate 464. The linear encoder code plate 464 is provided with slits at a predetermined spacing (for example, 1/180 inch (one inch=2.54 cm)).

The parallel light that passes through the linear encoder code plate 464, then passes through stationary slits (not shown) and is incident onto the photodiodes 458, where it is converted into electrical signals. The electrical signals that are output from the four photodiodes 458 are subjected to a signal processing in the signal processing circuit 460, and the signals that are output from the signal processing circuit 460 are compared in the comparators 462A and 462B, and the results of these comparisons are output as pulses. Pulses ENC-A and ENC-B that are output from the comparators 462A and 462B become the output of the linear encoder 51.

<Output Signals>

Figure 11A:
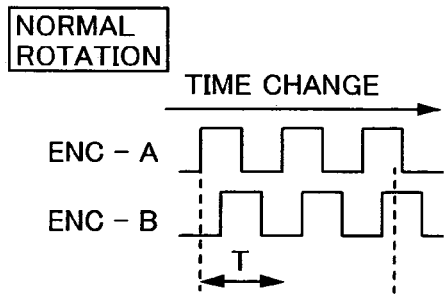
FIG. 11A is a timing chart showing the output waveform of the linear encoder during normal rotation.
Figure 11B:
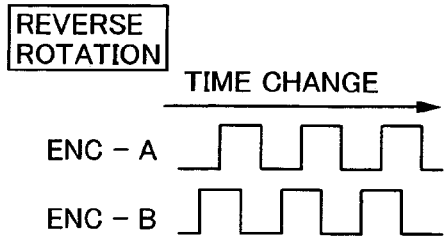
FIG. 11B is a timing chart showing the output waveform of the linear encoder during reverse rotation.

FIGS. 11A and 11B are timing charts showing waveforms of two output signals of the detecting section 466 when the carriage motor 42 is rotating forward and when it is rotating in reverse. As shown in FIGS. 11A and 11B, the phases of the pulse ENC-A and the pulse ENC-B are shifted by 90 degrees both when the carriage motor 42 is rotating forward and when it is rotating in reverse. When the carriage motor 42 is rotating forward, that is, when the carriage 41 is moving along the guide rail 46, then, as shown in FIG. 11A, the phase of the pulse ENC-A leads the phase of the pulse ENC-B by 90 degrees. On the other hand, when the carriage motor 42 is rotating in reverse, then, shown in FIG. 11B, the phase of the pulse ENC-A is delayed by 90 degrees with respect to the phase of the pulse ENC-B. A single cycle T of the pulse ENC-A and the pulse ENC-B is equivalent to the time during which the carriage 41 is moved by the slit spacing of the linear encoder code plate 464.

Then, the rising edges of the output pulses ENC-A and ENC-B of the linear encoder 51 are detected, and the number of detected edges is counted. The rotational position of the carriage motor 42 is calculated based on the counted number. With respect to the calculation, when the carriage motor 42 is rotating forward, a "+1" is added for each detected edge, and when it is rotating in reverse, a "−1" is added for each detected edge. Each cycle of the pulses ENC-A and ENC-B is equal to the time from when one slit of the linear encoder code plate 464 passes through the detecting section 466 to when the next slit passes through the detecting section 466, and the phases of the pulse ENC-A and the pulse ENC-B are shifted by 90 degrees. Accordingly, a count number of "1" of the above calculation corresponds to ¼ of the slit spacing of the linear encoder code plate 464. Therefore, if the above counted number is multiplied by ¼ of the slit spacing, then the amount that the carriage motor 42 has moved from the rotational position corresponding to the count number "0" can be obtained based on this product. The resolution of the linear encoder 51 at this time is ¼ the slit spacing of the linear encoder code plate 464.

===Drive Circuit of Head===

Figure 12:
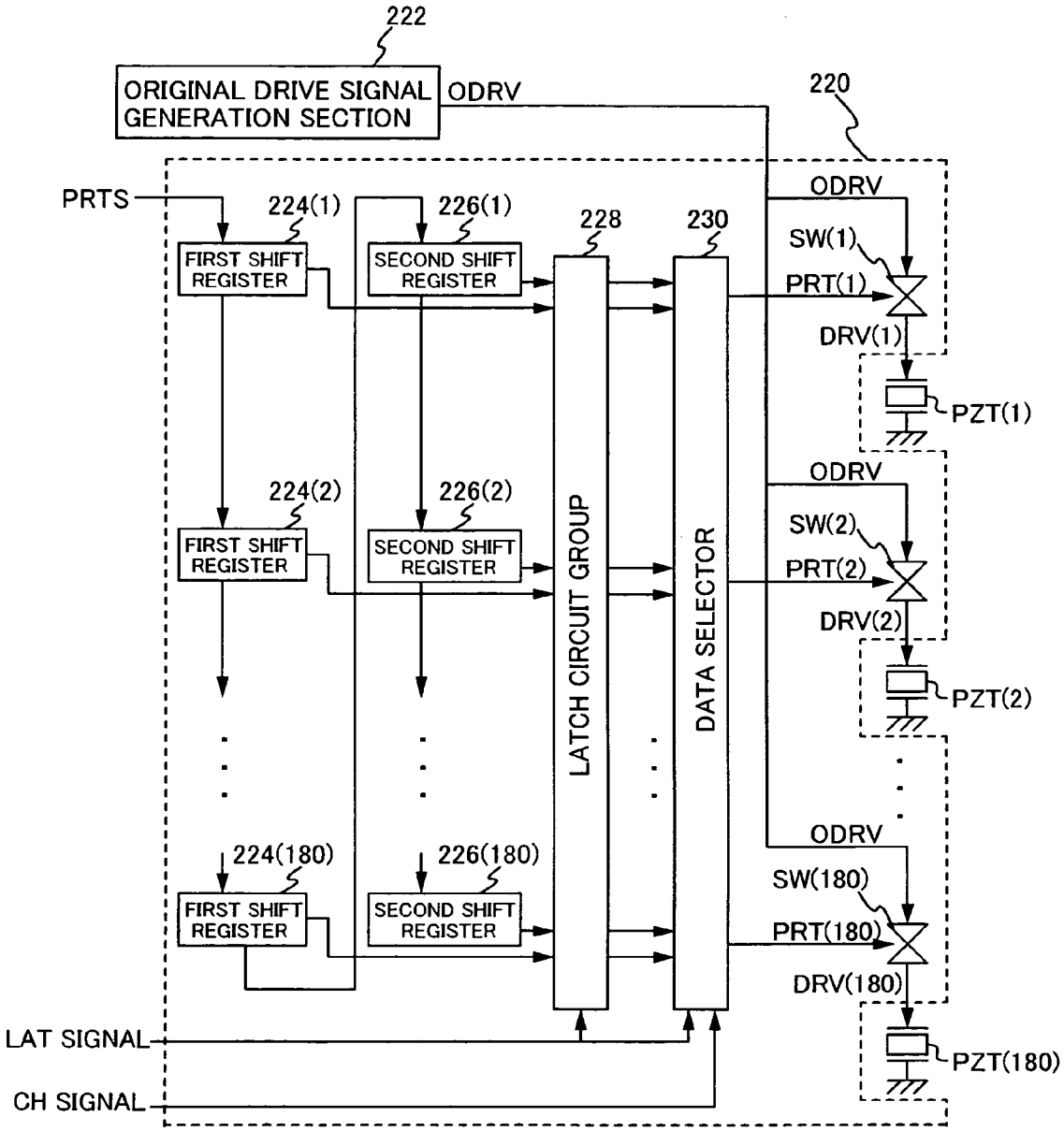
FIG. 12 is a diagram describing an example of a drive circuit of a head.
Figure 13:
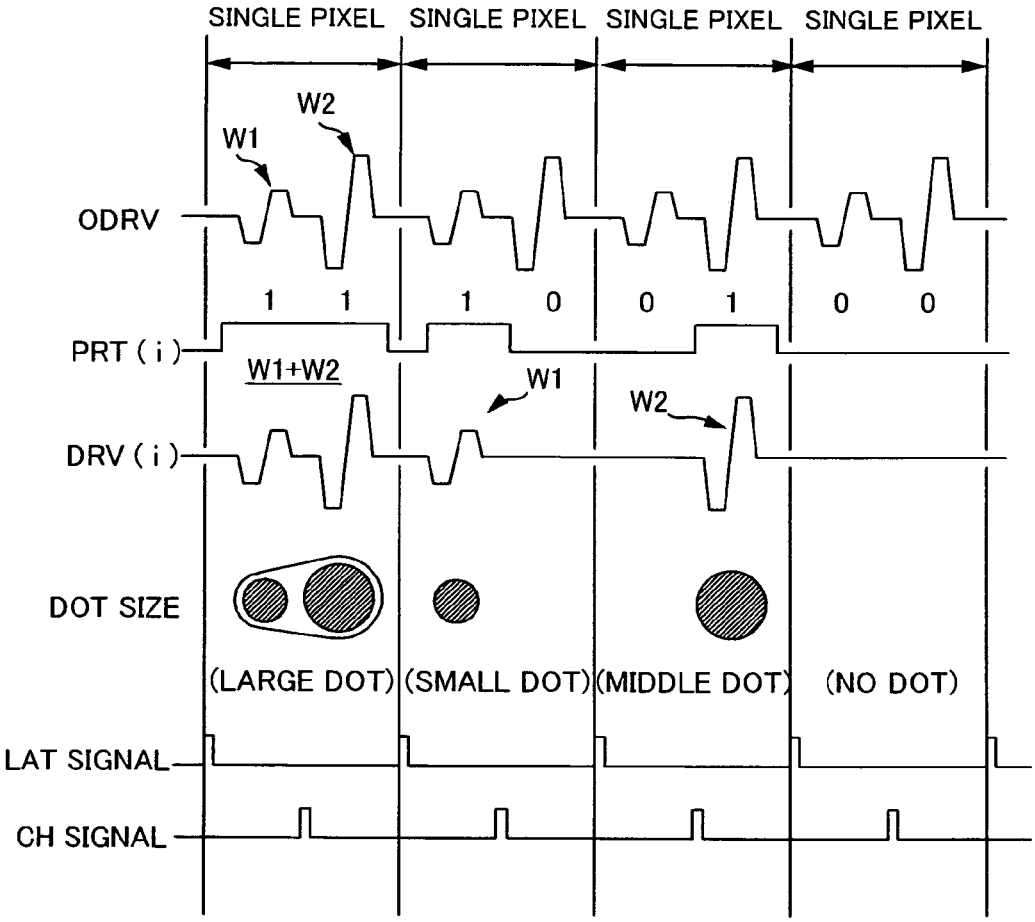
FIG. 13 is a timing chart of each of the signals.

FIG. 12 shows an example of a drive circuit 220 of the head 21. Furthermore, FIG. 13 is a timing chart illustrating the signals of the drive circuit 220.

The drive circuit 220 is provided for letting ink be ejected from the nozzles #1 to #180 provided at the head 21, and drives 180 piezo elements PZT (1) to (180) provided respectively at the nozzles #1 to #180. The piezo elements PZT (1) to (180) are driven based on a print signal PRTS that is input to this drive circuit 220. It should be noted that, in FIG. 12, the numbers in parentheses indicated at the end of each of the signals or components denote the nozzle numbers 1 to 180 corresponding to the signals or components.

In this embodiment, such drive circuit 220 is separately provided for each of the nozzle groups 211Y, 211M, 211C, and 211K provided at the head 21. That is, four nozzle drive circuits 220 are provided in respective correspondence with the yellow nozzle group 211Y, the magenta nozzle group 211M, the cyan nozzle group 211C, and the black nozzle group 211K.

The configuration of the drive circuit 220 is described. As shown in FIG. 12, the drive circuit 220 is provided with an original drive signal generating section 222 for generating an original drive signal ODRV, 180 first shift registers 224(1) to (180), 180 second shift registers 226(1) to (180), a latch circuit group 228, a data selector 230, and 180 switches SW (1) to (180).

The original drive signal generating section 222 generates an original drive signal ODRV that is commonly used for each of the nozzles #1 to #180. The original drive signal ODRV is a signal for driving each of the piezo elements PZT (1) to (180) which are provided in respective correspondence with each of the nozzles #1 to #180. As shown in FIG. 13, this original drive signal ODRV is a signal that has a plurality of pulses in a main-scanning period of one pixel (within a time which the carriage 41 passes through the spacing for one pixel), that is, in this embodiment, a first pulse W1 and a second pulse W2. In the original drive signal ODRV, a plurality of these pulses (the first pulse W1 and the second pulse W2) are repeatedly generated at a predetermined cycle. The original drive signal ODRV generated by the original drive signal generating section 222 is output toward the switches SW (1) to (180).

On the other hand, the print signal PRTS (refer to FIG. 12) is a data signal including 180 sets of 2-bit data for driving each of the piezo elements (1) to (180), and is a signal that indicates, for example, whether or not ink is to be ejected from each of the nozzles #1 to #180, and the size of the ink that is to be ejected. These print signal PRTS are serially transmitted to the drive circuit 220, and is input to the 180 first shift registers 224 (1) to (180). Then, the print signal PRTS is input to the second shift register 226 (1) to (180). Herein, data of the first bit, among the 180 sets of 2-bit data, is input in each of the first shift registers 224 (1) to (180). Furthermore, data of the second bit, among the 180 sets of 2-bit data, is input each in the second shift registers 226 (1) to (180).

The latch circuit group 228 latches data stored in the first shift registers 224 (1) to (180) and the second shift registers 226 (1) to (180), and obtains the data as signals indicating "0 (low)" or "1 (high)". Then, the latch circuit group 228 outputs each of the extracted signals which are based on data stored in the first shift register 224 (1) to (180) and the second shift register 226 (1) to (180) to the data selector 230. The latch timing of the latch circuit group 228 is controlled by a latch signal (LAT) that is input to this latch circuit group 228. More specifically, when pulses as shown in FIG. 13 are input to the latch circuit group 228 as the latch signal (LAT), the latch circuit group 228 latches data stored in the first shift registers 224 (1) to (180) and the second shift registers 226 (1) to (180). The latch circuit group 228 latches data each time pulses are input as the latch signals (LAT).

On the other hand, the data selector 230 selects signals corresponding to either one of the first shift register 224 (1) to (180) and the second shift register 226 (1) to (180), among the signals (signals indicating "0 (low)" or "1 (high)") that are output from the latch circuit group 228, and outputs the signals as print signals PRT (1) to (180) respectively to the switches SW (1) to (180). The signals selected by the data selector 230 are switched based on both of a latch signal (LAT signal) and a change signal (CH signal) that are input to this data selector 230.

Herein, when pulses as shown in FIG. 13 are input to the data selector 230 as the latch signal (LAT signal), the data selector 230 selects signals corresponding to data stored in the second shift registers 226 (1) to (180), and outputs the signals as the print signals PRT (1) to (180) respectively to the switches SW (1) to (180). Furthermore, if pulses as shown in FIG. 13 are input to the data selector 230 as a change signal (CH signal), then the data selector 230 switches signals to be selected from signals corresponding to data stored in the second shift registers 226 (1) to (180) to signals corresponding to data stored in the first shift registers 224 (1) to (180), and outputs the signals as the print signals PRT (1) to (180) to the switches SW (1) to (180). Then, when pulses are input again as a latch signal (LAT signal), the data selector 230 switches signals to be selected from signal corresponding to data stored in the first shift registers 224 (1) to (180) to signals corresponding to data stored in the second shift registers 226 (1) to (180), and outputs the signals as print signals PRT (1) to (180) to the switches SW (1) to (180).

Herein, as shown in FIG. 13, in a latch signal (LAT signal), a pulse is generated at a cycle of one pixel unit. Furthermore, as shown in FIG. 13, in a change signal (CH signal), a pulse is generated at a timing that is at the middle of each cycle of one pixel. Accordingly, 2-bit data each corresponding to one pixel is serially transmitted to the switches SW (1) to (180). More specifically, 2-bit data such as "00", "01", "10", and "11" is input to the switches SW (1) to (180) respectively as the print signals PRT (1) to (180) at the each cycle of one pixel.

The switches SW (1) to (180) determine whether or not to let the original drive signal ODRV which is input from the original drive signal generating section pass through, based on the print signals PRT (1) to (180) which are output from the data selector 230, that is, the 2-bit data such as "00", "01", "10", and "11". More specifically, if a level of a print signal PRT (i) is "1 (high)", a drive pulse (the first pulse W1 or the second pulse W2) corresponding to the original drive signal ODRV is led to pass through to be a drive signal DRV (i). On the other hand, if the level of a print signal PRT (i) is "0 (low)", then the switches SW (1) to (180) block a drive pulse (the first pulse W1 or the second pulse W2) corresponding to the original drive signal ODRV.

Accordingly, as shown in FIG. 13, the drive signal DRV (i) that is input from the switches SW (1) to (180) to the piezo elements PZT (1) to (180) varies in accordance with the print signals PRT (1) to (180) input from the data selector 230 to the switch SW (1) to (180), that is, the 2-bit data such as "00", "01", "10", and "11".

Herein, if "10" is input to the switch SW (i) as the print signal PRT (i), then only the first pulse W1 passes through the switch SW (i) and is input to the piezo element PZT (i). The piezo element PZT (i) is driven with this first pulse W1, and an ink droplet of a small size (hereinafter, also referred to as "small ink droplet") is ejected from the nozzle. In this way, a dot of a small size (small dot) is formed on the medium S.

Furthermore, when "01" is input to the switch SW (i) as the print signal PRT (i), only the second pulse W2 passes through the switch SW (i) and is input to the piezo element PZT (i). The piezo element PZT (i) is driven by this second pulse W2, and an ink droplet of a size that is larger than the ink droplet of the previous small size (hereinafter, also referred to as "middle ink droplet") is ejected from the nozzle. In this way, a dot of a middle size (middle dot) is formed on the medium S.

Furthermore, when "11" is input to the switch SW (i) as the print signal PRT (i), both of the first pulse W1 and the second pulse W2 pass through the switch SW (i) and are input to the piezo element PZT (i). The piezo element PZT (i) is driven with the first pulse W1 and the second pulse W2, and a small ink droplet and a middle ink droplet are ejected from the nozzle. Here, the small ink droplet and the middle ink droplet are ejected successively with a predetermined interval. In this way, a small dot formed with the small ink droplet and a middle dot formed with the middle ink droplet are formed on the medium S. The small dot and the middle dot form a dot of a size that looks large (large dot) on the medium S.

Furthermore, if "00" is input to the switch SW (i) as the print signal PRT (i), then neither the first pulse W1 nor the second pulse W2 passes through the switch SW (i), and no drive pulse is input to the piezo element PZT (i). In this way, no ink droplet is ejected from the nozzle, and no dot is formed on the medium S.

<PTS Signal>

The latch signal (LAT signal) and the change signal (CH signal) that are input to the latch circuit group 228 or the data selector 230 are both generated based on a PTS (pulse timing signal) signal. The PTS signal is a signal that defines a timing at which a pulse is generated in the latch signal (LAT signal) and the change signal (CH signal). A pulse of the PTS signal is generated based on output pulse ENC-A and ENC-B from the linear encoder 51 (a detecting section 466). In other words, the pulse of the PTS signal is generated in accordance with the amount that the carriage 41 has moved. It should be noted, this PTS signal corresponds to the "first timing defining signal" and the "second timing defining signal".

Figure 14:
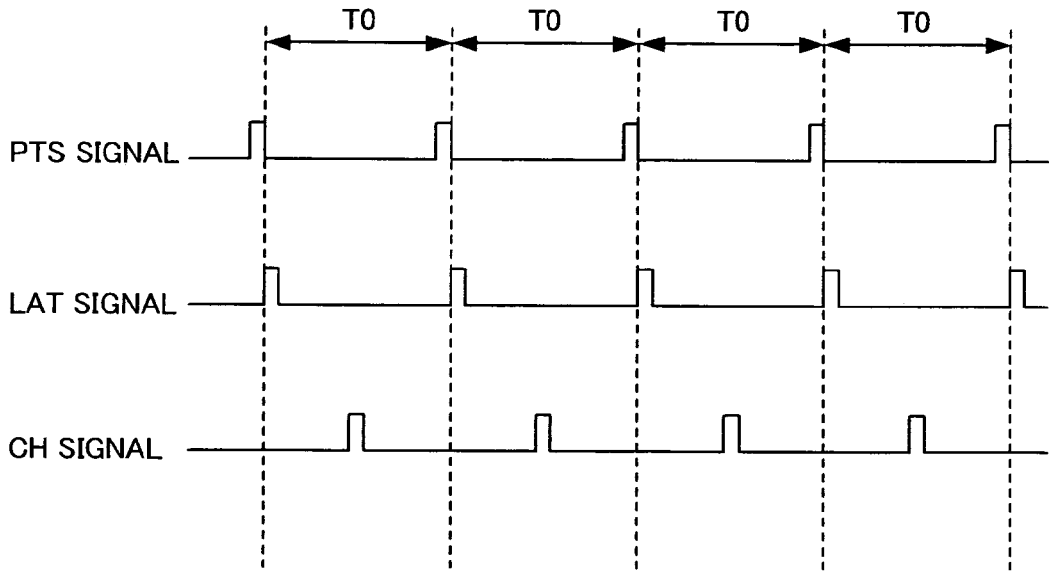
FIG. 14 is a timing chart of each of the signals.

FIG. 14 illustrates in detail the relationship among timings of the PTS signal, the latch signal (LAT signal), and the change signal (CH signal). In the PTS signal, pulses are generated at a predetermined cycle T0. In the latch signal (LAT signal) and the change signal (CH signal), pulses are respectively generated based on the pulses generated in the PTS signal. After a pulse is generated in the PTS signal, a pulse for the latch signal (LAT signal) is immediately generated in response to that pulse. On the other hand, when a predetermined time has passed after a pulse is generated in the PTS signal, a pulse in the change signal (CH signal) is generated. The pulses in the latch signal (LAT signal) and the change signal (CH signal) are generated every time a pulse is generated in the PTS signal.

The PTS signal is generated by the controller 126. The controller 126 generates pulses for the PTS signal based on the output pulses ENC-A and ENC-B from the linear encoder 51 (the detecting section 466), and appropriately changes a timing and a cycle for generation of pulses, based on print data sent from the computer 152. The PTS signal that has been generated by the controller 126 is output to the head drive section 132. The head drive section 132 generates the latch signal (LAT signal) and the change signal (CH signal) based on the PTS signal from the controller 126, and the original drive signal ODRV is generated at the original drive signal generating section 222.

It should be noted that the controller 126 that generates the PTS signal corresponding to the first timing defining signal and the second timing defining signal, and outputs the PTS signal to the head drive section 132 corresponds to the "signal output section".

===Print Modes===

<Interlaced Mode>

Figure 15A:
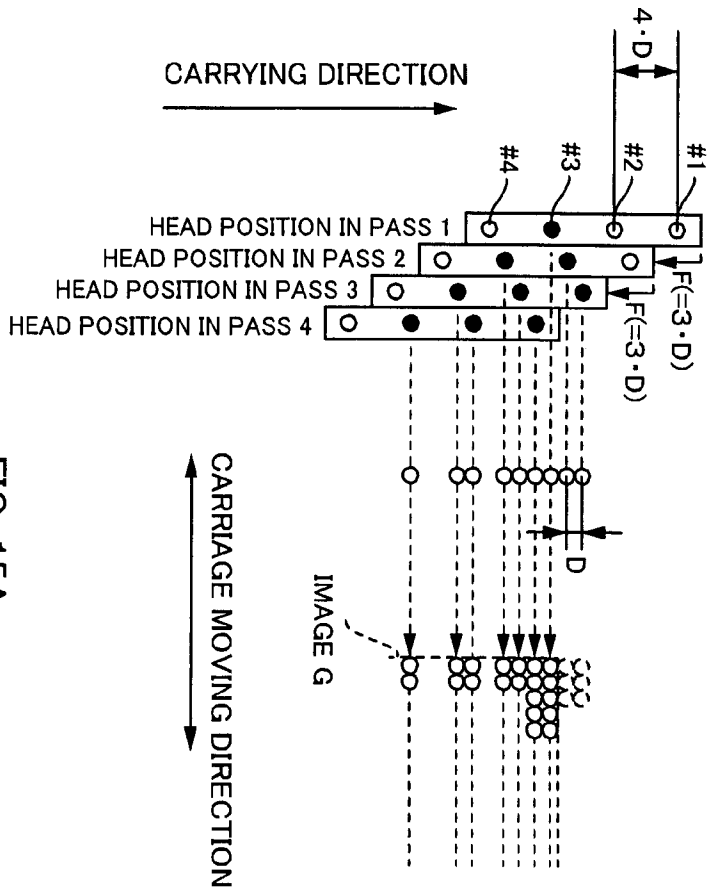
FIG. 15A is an explanatory diagram describing an example of image printing process in an interlaced mode.
Figure 15B:
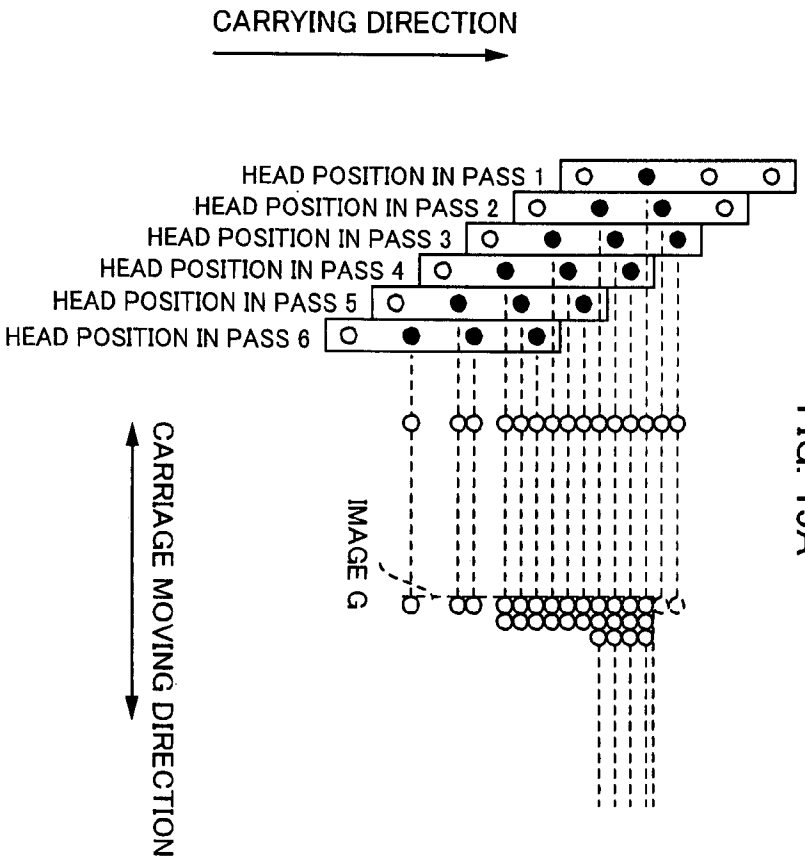
FIG. 15B is an explanatory diagram describing an example of image printing process in an interlaced mode.

FIGS. 15A and 15B schematically illustrate a method for printing an image G by forming dots on a medium S by an interlaced mode. Here, for the sake of convenience in explaining, it is shown that the nozzle group 211 for ejecting ink moves along the medium S, but FIGS. 15A and 15B show the relative positional relationship between the nozzle group 211 and the medium S, and the medium S moves in the carrying direction in the actual state. In FIGS. 15A and 15B, the nozzles shown by black circles are nozzles that eject ink, and the nozzles shown by white circles are nozzles that do not eject ink. FIG. 15A shows the positions of the nozzle group 211 (head 21) and the manner in which dots are formed in passes 1 to 4, and FIG. 15B shows the positions of the nozzle group 211 (head 21) and manner in which dots are formed in passes 1 to 6.

Here, "pass" means an operation in which the head 21 including the nozzle group 211 is moved one time in the movement direction due to the movement of the carriage 41. In the "interlaced mode", by repeatedly performing such a "pass", dots are formed arranged in the movement direction of the carriage 41 in each pass, and the image G is printed by forming successive raster lines constituting the image G to be printed. It should be noted that "raster line" refers to a row of pixels arranged in the movement direction of the carriage 41 and is also referred to as "scanning line". Furthermore, "pixels" are the square shaped boxes that are determined virtually on the medium S in order to define the positions where ink droplets are caused to land so as to record dots.

In the interlaced mode, every time the medium S is carried in the carrying direction by a constant carry amount F, each nozzle records a raster line immediately above the raster line recorded in the immediately preceding pass. In order to perform recording with a constant carry amount in this manner, the number N (an integer) of nozzles that can eject ink is coprime to k, and the carry amount F is set to N·D.

Here, it is shown how the image G is formed using the nozzles #1 to #4 of the nozzles #1 to #180 of the nozzle group 211. It should be noted that since the nozzle pitch of the nozzle group 211 is 4D, not all the nozzles can be used so that the condition for the interlaced mode, that is "N and k are coprime", is satisfied. Accordingly, here a simplified case is explained in which formation of the image G is performed in the interlaced mode using three nozzles #1 to #3. Furthermore, since three nozzles are used, the medium S is carried by a carry amount of 3·D. As a result, for example, using the nozzle group 211 with a nozzle pitch of 180 dpi (4·D), dots are formed on the paper with a dot spacing of 720 dpi (=D).

This diagram shows the manner in which continuous raster lines are formed, with the first raster line being formed by the nozzle #1 in pass 3, the second raster line being formed by the nozzle #2 in pass 2, the third raster line being formed by the nozzle #3 in pass 1, and the fourth raster line being formed by the nozzle #1 in pass 4. It should be noted that only the nozzle #3 ejects ink in the pass 1, and only the nozzle #2 and the nozzle #3 eject ink in the pass 2. The reason for this is that if ink is ejected from all of the nozzles in pass 1 and pass 2, continuous raster lines cannot be formed on the medium S. In pass 3 and thereafter, the three nozzles (#1 to #3) eject ink, and the paper is carried by a constant carry amount F (=3·D), and continuous raster lines are formed with a dot spacing D. Thus, raster lines are formed successively in each pass, and the image G is printed.

Figure 16A:
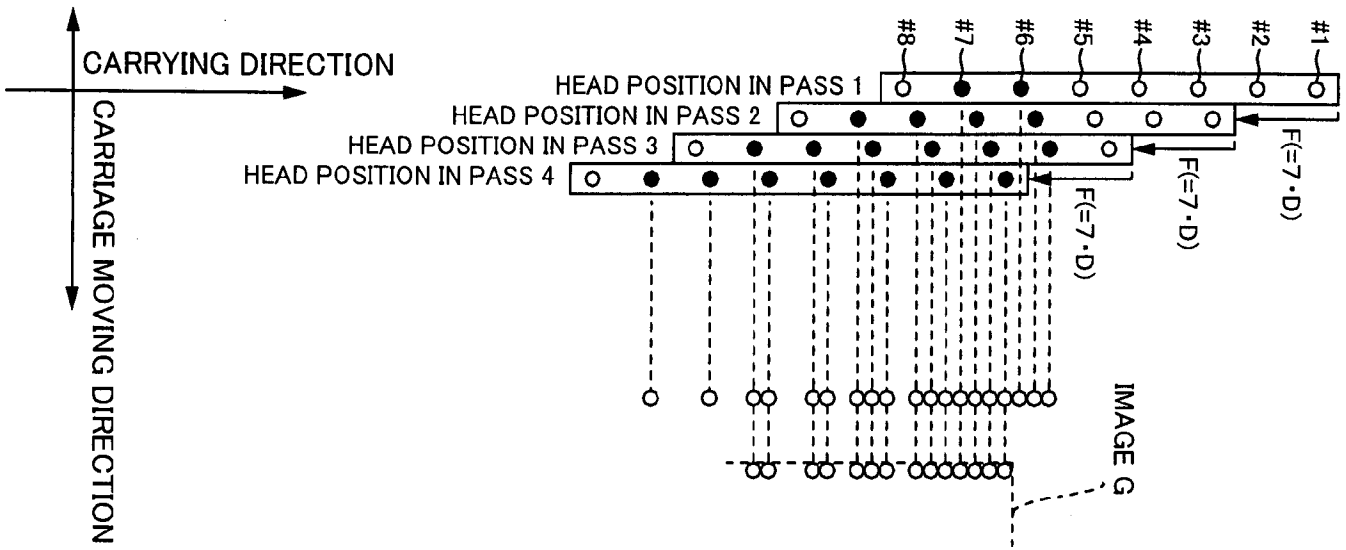
FIG. 16A is an explanatory diagram describing an image printing process in another interlaced mode.
Figure 16B:
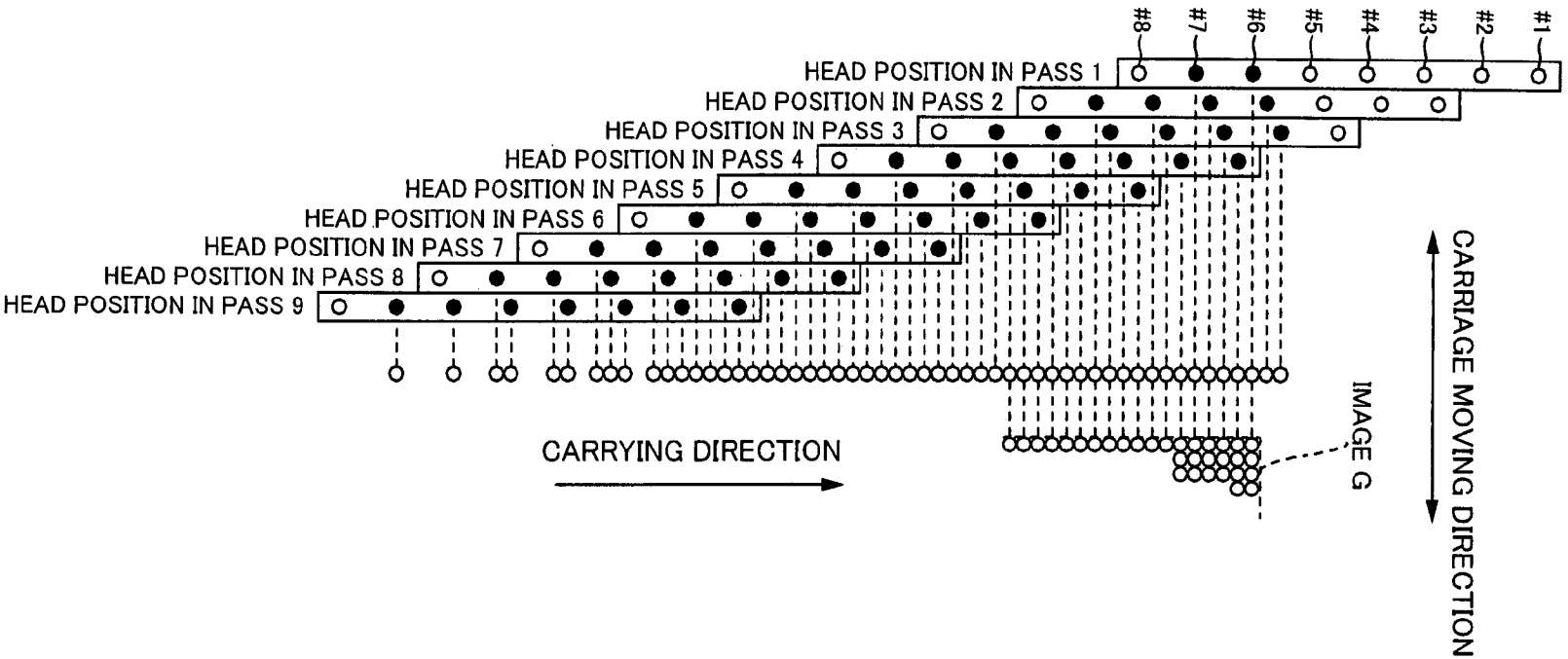
FIG. 16B is an explanatory diagram describing image printing process in another interlaced mode.

FIGS. 16A and 16B describe other methods in the interlaced mode. Here, the number of nozzles used is different. Since the nozzle pitch and so forth are same as in the case of the above-described explanatory diagrams, description thereof is omitted. FIG. 16A shows the positions of the nozzle group 211 and the manner in which dots are formed in passes 1 to 4, and FIG. 16B shows the positions of the nozzle group 211 and the manner in which dots are formed in passes 1 to 9.

These figures illustrate an example in which #1 to #8 of the nozzles #1 to #180 of the nozzle group 211 are used to print an image G on a medium S. Here, since the nozzle pitch of the nozzle group 211 is 4D, not all the nozzles can be used so that condition for the interlaced mode, that is, "N and k are coprime", is satisfied. Accordingly, a simplified case is explained here in which interlaced mode is performed by using seven nozzles #1 to #7. Since seven nozzles #1 to #7 are used, the carry amount of the medium S is set to "7·D".

This diagram shows the manner in which continuous raster lines are formed, with the first raster line being formed by the nozzle #2 in pass 3, the second raster line being formed by the nozzle #4 in pass 2, the third raster line being formed by the nozzle #6 in pass 1, and the fourth raster line being formed by the nozzle #1 in pass 4. In pass 3 and thereafter, the seven nozzles (#1 to #7) eject ink and the medium S is carried by a constant carry amount F (=7·D), and thus continuous raster lines are formed with a dot spacing of D.

Compared with the above-described interlaced mode, the number of nozzles used for ejecting ink is larger. Therefore, the number N of nozzles that eject ink is increased, so that the carry amount F during a single carry is increased, and thus the printing speed is increased. In this manner, in the interlaced mode, it is advantageous to increase the number of nozzles that can eject ink because this increases the printing speed.

<Overlap Mode>

Figure 17A:
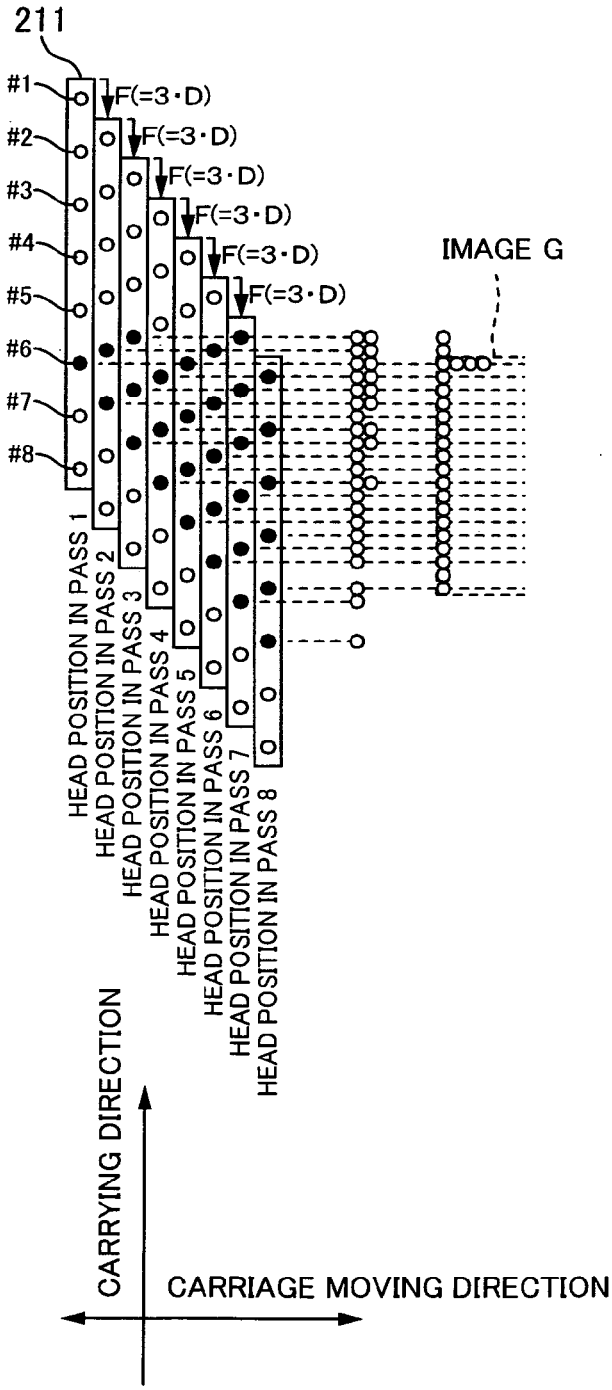
FIG. 17A is an explanatory diagram describing an example of image printing process in an overlap mode.
Figure 17B:
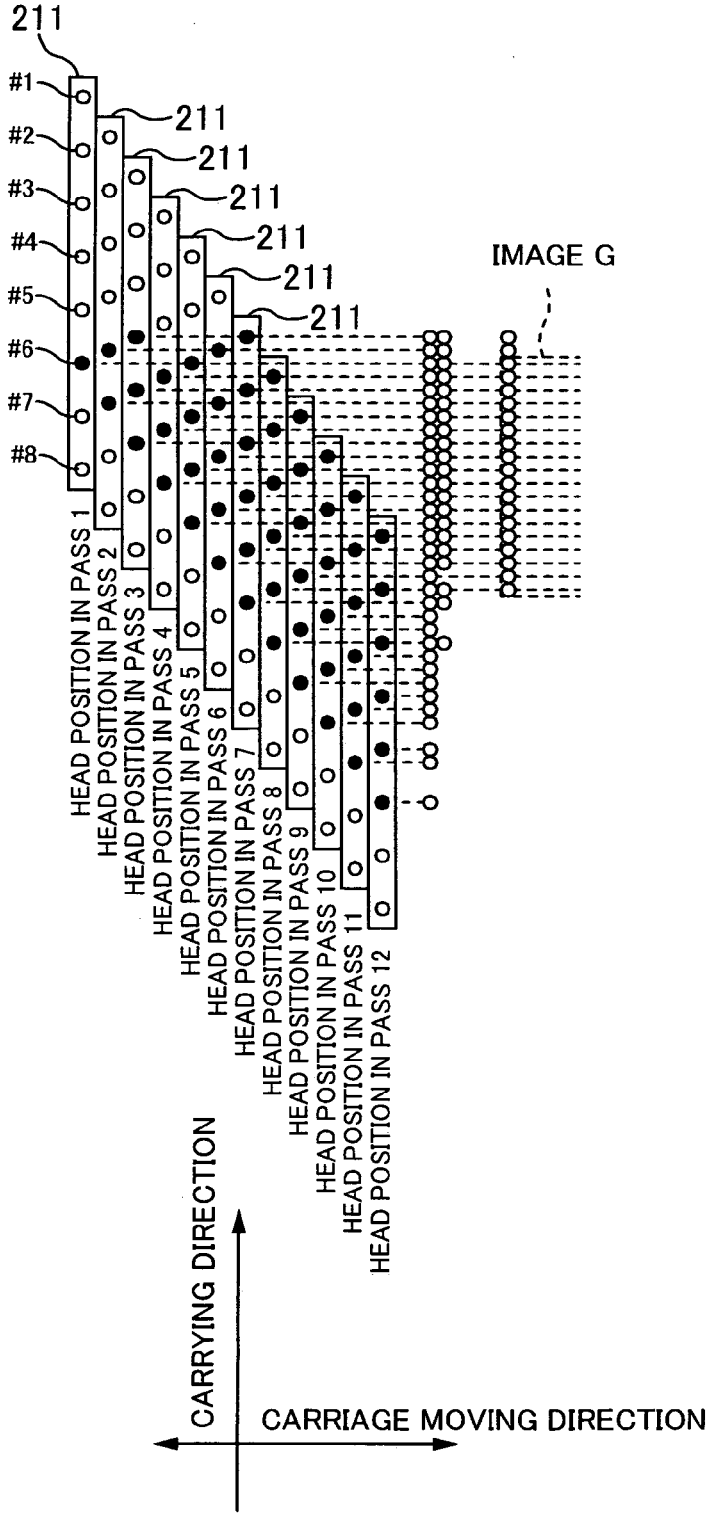
FIG. 17B is an explanatory diagram describing an example of image printing process in an overlap mode.

FIGS. 17A and 17B schematically illustrate a method for printing an image G on a medium S by an overlap mode. FIG. 17A shows the positions of the nozzle group 211 and the manner in which dots are formed in passes 1 to 8, and FIG. 17B shows the positions of the nozzle group 211 and the manner in which dots are formed in passes 1 to 12. In the above-described interlaced mode, a single raster line was formed by a single nozzle. However, in the overlap mode, a single raster line, for example, is formed by two or more nozzles.

In the overlap mode, each time the medium S is carried in the carrying direction by a constant carry amount F, each of the nozzles form dots intermittently at every several dots. Then, by another nozzle forming dots, in another pass, so as to complement the intermittent dots that have already been formed, a single raster line is completed by a plurality of nozzles. The overlap number M is defined as the number of passes M required to complete a single raster line. In FIGS. 17A and 17B, since each nozzle forms dots intermittently at every other dot, dots are formed in every pass either at the uneven numbered pixels or at the even numbered pixels. Since a single raster line is formed by two nozzles, the overlap number M=2. It should be noted that, the overlap number M=1 in case of the above-described interlaced mode.

In the overlap mode, the following conditions (1) to (3) are required in order to perform the recording with a constant carry amount:

(1) N/M is an integer.

(2) N/M is coprime to k.

(3) The carry amount F is set to (N/M)·D.

In FIGS. 17A and 17B, the number of nozzles of the nozzle group 211 is 180. However, since the nozzle pitch of the nozzle group 211 is 4D (k=4), not all the nozzles can be used, in order to fulfill the condition that "N/M and k are coprime", which is a condition for printing in the overlap mode. Thus, here, an example is simply shown in which the image G is printed using the nozzles #1 to #6 of the nozzles #1 to #180 of the nozzle group 211. Since six nozzles are used, the medium S is carried by a carry amount of 3·D. As a result, for example, using a nozzle group with a nozzle pitch of 180 dpi (4·D), dots are formed on the medium S with a dot spacing of 720 dpi (=D). Furthermore, in a single pass, each of the nozzles form dots in the scanning direction intermittently at every other dot. In FIGS. 17A and 17B, raster lines are already completed in which two dots are drawn in the carriage movement direction. For example, in FIG. 17A, the first through the sixth raster lines have already been completed. Raster lines in which only one dot is drawn are raster lines in which dots have been formed intermittently at every other dot. For example, in the seventh through the tenth raster lines, dots are formed intermittently at every other dot. It should be noted that the seventh raster line in which dots have been formed intermittently at every other dot, is completed by the nozzle #1 forming dots to fill it up in pass 9.

FIGS. 17A and 17B show the manner in which continuous raster lines are formed, with the first raster line being formed by the nozzle #4 in pass 3 and the nozzle #1 in pass 7, the second raster line being formed by the nozzle #5 in pass 2 and the nozzle #2 in pass 6, the third raster line being formed by the nozzle #6 in pass 1 and the nozzle #3 in pass 5, and the fourth raster line being formed by the nozzle #4 in pass 4 and the nozzle #1 in pass 8. It should be noted that in passes 1 to 6, some of the nozzles in #1 to #6 are nozzles that do not eject ink. The reason for this is that if ink is ejected from all of the nozzles in passes 1 to 6, continuous raster lines cannot be formed on the medium S. In the pass 7 and thereafter, the six nozzles (#1 to #6) eject ink and the medium S is carried by a constant carry amount F (=3·D), and thus continuous raster lines are formed with a dot spacing of D.

The following shows a summary of the formation position in the scanning direction of the dots that are formed in the respective passes.

| | Pass | | | | | | | |
|---|---|---|---|---|---|---|---|---|
| | 1 | 2 | 3 | 4 | 5 | 6 | 7 | 8 |
| Recorded pixel | odd | even | odd | even | even | Odd | even | odd |

Here, "odd" refers to a state in which dots are formed at odd-numbered pixels of the pixels (pixels in a raster line) arranged in the carriage movement direction. Furthermore, "even" in the table refers to a state in which dots are formed at even-numbered pixels of the pixels arranged in a scanning direction. For example, in pass 3, each of the nozzles forms dots at odd-numbered pixels. When a single raster line is formed by M nozzles, k×M times of passes are required in order to complete the number of raster lines corresponding to the nozzle pitch. For example, in this embodiment, a single raster line is formed by two nozzles, so that 8 (4×2) passes are required in order to complete four raster lines. As can be seen from the table, in the four passes during the first half, dots are formed in the order of odd-even-odd-even. As a result, when the four passes during the first half have finished, dots are formed at even-numbered pixels in raster lines adjacent to raster lines in which dots are formed at odd-numbered pixels. In the four times of passes during the second half, dots are formed in the order of even-odd-even-odd. In other words, in the four passes in the second half, dots are formed in reverse order with respect to the four passes in the first half. As a result, dots are formed so as to complement gaps between dots that have been formed in passes during the first half.

Also in the overlap mode, as in the above-described interlaced mode, when the number N of nozzles that can eject ink is increased, the carry amount F during a single carry is increased, and thus the printing speed is increased. Therefore, in the overlap mode, it is advantageous to increase the number of nozzles that can eject ink because this increases the printing speed.

===Conventional Problems===

As described above, in the aforementioned inkjet printer 1, when it forms a "large dot" for a pixel that configures an image to be printed, two dots are formed by ejecting ink two times for that pixel. In other words, two dots including one "small dot" and one "middle dot" are formed by ejecting a small ink droplet and a middle ink droplet one time each, two times in total. When ink is ejected a plurality of times for the same pixel, there occurs a significant displacement between the positions on a medium S onto which the ink is ejected first (here, small ink droplet) and the ink ejected subsequently (here, middle ink droplet) respectively land. When such displacement occurs, dots are not arranged in a balanced manner, and sometimes adversely affects the image quality, causing uneven print density or graininess in the image to be printed.

Figure 18:
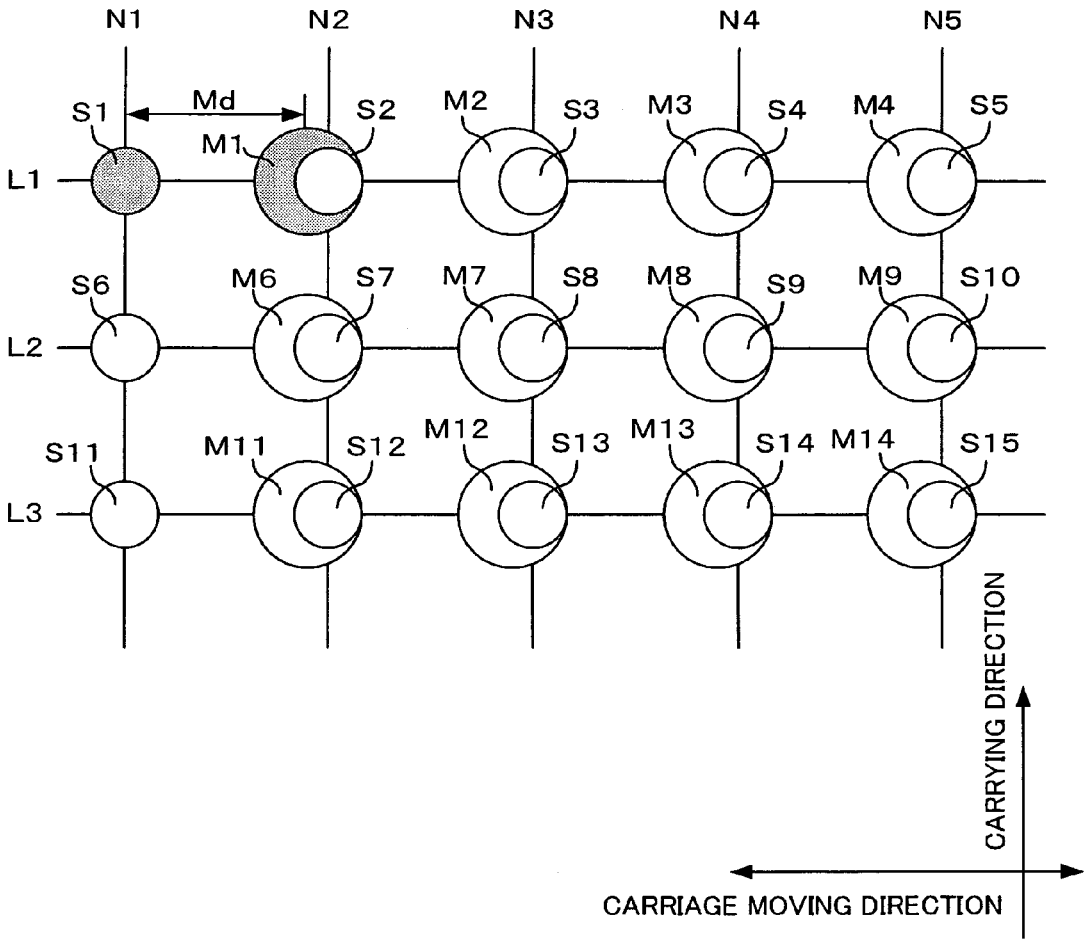
FIG. 18 is a diagram for describing conventional problems.

FIG. 18 illustrates an example of a case in which dots are not arranged in a balanced manner. Lateral lines L1 to L3 show positions corresponding to the lateral direction of pixels configuring an image to be printed. Longitudinal lines N1 to N5 show positions the longitudinal direction corresponding to the pixels configuring the image to be printed. Specifically, the respective positions at which the lateral lines L1 to L3 and the longitudinal lines N1 to N5 mutually intersect represent the positions corresponding to the pixels configuring the image to be printed. When an image is printed, ink is ejected toward those positions at which the lateral lines L1 to L3 and the longitudinal lines N1 to N5 mutually intersect.

Here, it is assumed that a "large dot" is formed for a pixel configuring an image to be printed. Small ink droplets are ejected toward the positions corresponding to each of the pixels, that is, the positions at which the lateral lines L1 to L3 intersect the longitudinal lines N1 to N5. Accordingly, the small ink droplets respectively land on the positions at which the lateral lines L1 to L3 intersect the longitudinal lines N1 to N5, thus forming the small dots S1 to S15 respectively at each intersecting position.

On the other hand, since middle ink droplets are ejected at a delayed timing with respect to small ink droplets, middle ink droplets land on positions displaced by a predetermined distance Md (refer to the positional relation between the small dot S1 and the middle dot M1) from the positions which correspond to each of the pixels, that is, the positions at which the lateral lines L1 to L3 intersect the longitudinal lines N1 to N5. Therefore, middle ink droplets respectively land on the positions displaced by the predetermined distance Md from the positions at which the lateral lines L1 to L3 intersect the longitudinal lines N1 to N5, thus forming the middle dots M1 to M14 respectively at those displaced positions. It should be noted that each of the numerals attached to the small dots S1 to S15 and the middle dots M1 to M14 show dots that are formed for the same pixel.

As described above, if the middle dots M1 to M14 are formed in positions displaced from the positions corresponding to each of the pixels, that is, the positions at which the lateral lines L1 to L3 intersect the longitudinal lines N1 to N5, it is possible that such middle dots exactly overlap the small dots S2 to S5, S7 to S10, S12 to S15 that are formed for other pixels. When the middle dots M1 to M14 exactly overlap the small dots S2 to S5, S7 to S10, S12 to S15 that are formed for other pixels, the image quality of the printed image may be adversely affected, causing graininess or uneven print density, for example. Therefore, it has been required to arrange dots in a balanced manner to prevent the image quality of the printed image from being adversely affected.

===Improving Method===

<Outline>

In the inkjet printer 1 according to this embodiment, in order to solve the above-mentioned problems, part of ink of ink ejected for pixels constituting an image to be printed is ejected toward positions corresponding to the pixels as in the conventional technique, whereas the other part of ink is ejected not toward the positions corresponding to the pixels, but toward positions displaced from the positions corresponding to the pixels. Subsequently, dots can be arranged in a balanced manner, improving uneven print density or graininess, thus improving the image quality of the printed image.

IMPROVEMENT EXAMPLE

Figure 19:
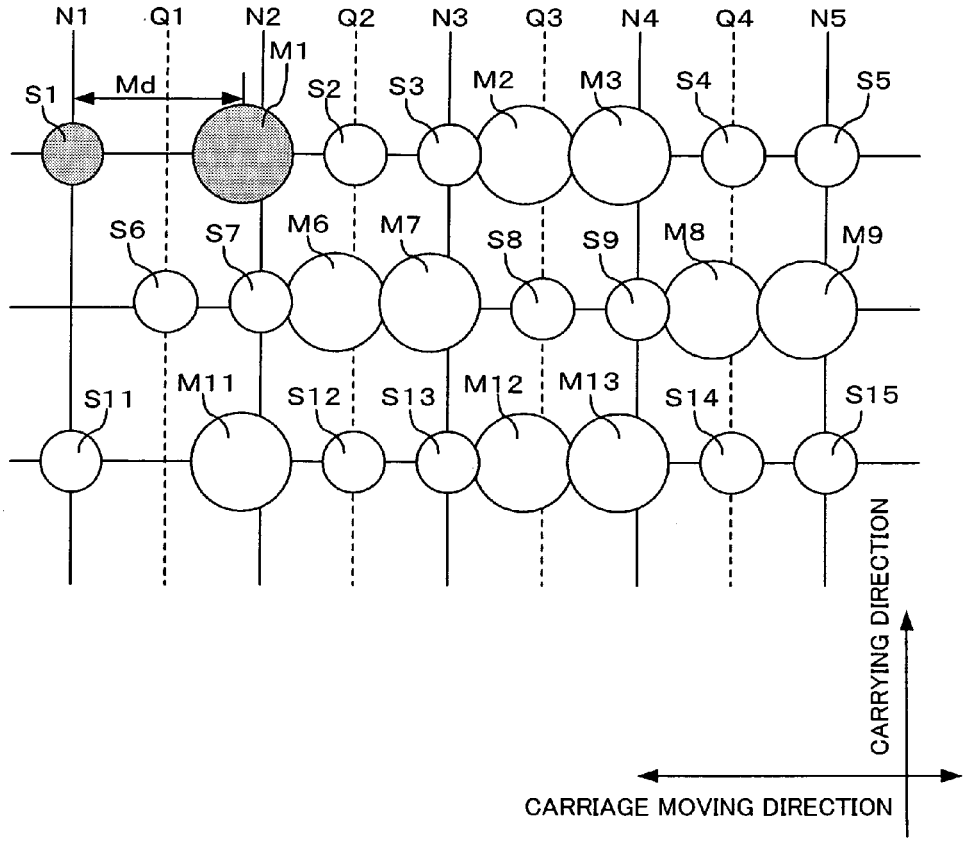
FIG. 19 is a diagram for describing a method for resolving the problems of the present invention.

FIG. 19 describes how dots are arranged when an image is printed by the inkjet printer 1 according to the present embodiment. It should be noted that the lateral lines L1 to L3 show positions in the lateral direction corresponding to pixels configuring an image to be printed. The longitudinal lines N1 to N5 show positions in the longitudinal direction corresponding to the pixels configuring the image to be printed. In other words, the respective positions at which the lateral lines L1 to L3 and the longitudinal lines N1 to N5 mutually intersect represent the positions corresponding to the pixels configuring the image to be printed.

Here, ink is ejected for, in addition to the positions corresponding to each of the pixels, positions displaced from the positions corresponding to each of the pixels, namely, in this embodiment, the positions at which the lateral lines L1 to L3 intersect the longitudinal lines Q1 to Q4 that are respectively set in the spaces created by the longitudinal lines N1 to N5.

With ink (small ink droplets and middle ink droplets) being ejected for the positions corresponding to each of the pixels, as shown in the FIG. 19, the small dots S1, S3, S5, S7, S9, S11, S13, and S15 are formed respectively in the positions representing the positions corresponding to the pixels. Also, in positions displaced by a predetermined distance Md from the positions corresponding to each of the pixels, the middles dots M1, M3, M7, M9, M11 and M13 are formed respectively. Moreover, with ink (small ink droplets and middle ink droplets) being ejected for positions displaced from the positions corresponding to each of the pixels, the small dots S2, S4, S6, S8, S12, and S14 are formed respectively in the positions displaced from the positions corresponding to each of the pixels, namely, the positions at which the lateral lines L1 to L3 intersect the longitudinal lines Q1 to Q4. In addition, in the positions displaced by the predetermined distance Md from those displaced positions, the middles dots M2, M4, M6, M8, and M12 are formed respectively.

As described above, by ejecting ink for the positions displaced from the positions corresponding to each of the pixels (positions at which the lateral lines L1 to L3 intersect the longitudinal lines Q1 to Q4), in addition to the positions corresponding to each of the pixels, the small dots S1 to S15 and the middle dots M1 to M13 can be formed being arranged in a balanced manner. As a result, it is possible to improve uneven print density or graininess, thus improving the image quality of the printed image.

<Method for Ejecting Ink toward Displaced Positions>

In the inkjet printer 1 according to this embodiment, in order to eject ink for, in addition to positions corresponding to each of the pixels, positions displaced from the positions corresponding to the pixels, the controller 126 outputs to the head drive section 132 two types of PTS signals in which pulses are generated at a different timing. In this embodiment, the controller 126 outputs two types of signals, a first PTS signal and a second PTS signal, as the PTS signals. The controller 126 appropriately selects one of the first PTS signal and the second PTS signal, and outputs the selected signal to the head drive section 132, thus switching ejection of ink toward the positions corresponding to each of the pixels and the positions displaced from the positions corresponding to each of the pixels.

Figure 20:
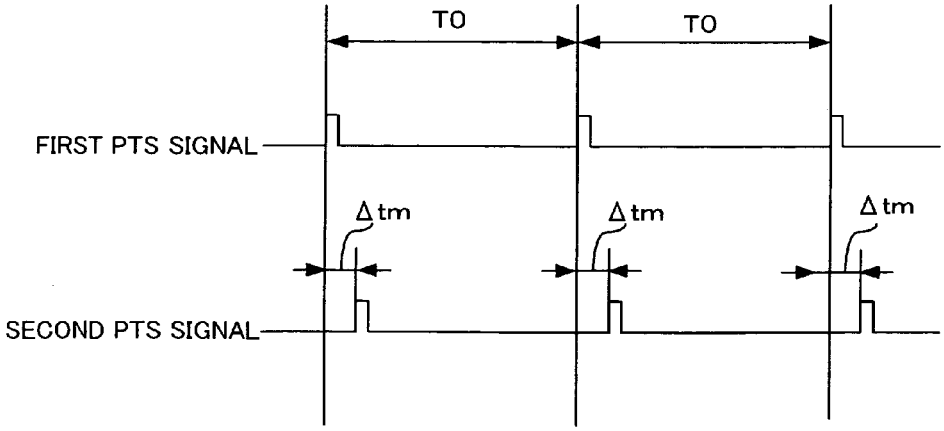
FIG. 20 is a diagram describing two types of PTS signals.

FIG. 20 shows the first PTS signal and the second PTS signal output by the controller 126 of this embodiment. The first PTS signal and the second PTS signal differ in the timing at which pulses are generated. Pulses are generated in the second PTS signal at the timing delayed from the timing of the first PTS signal by a time difference Δtm. This time difference Δtm is set to cause ink to be ejected toward the positions displaced from the positions corresponding to each of the pixels configuring an image to be printed. In other words, by delaying the timing for ejecting ink from the nozzles by the time difference Δtm, it becomes possible to eject ink toward the positions displaced from the positions corresponding to each of the pixels configuring the image to be printed. The time difference Δtm is set so as to meet the displacement amount between the position corresponding to each of the pixels configuring the image to be printed and the positions displaced from those positions. That is, for example, in the case shown in FIG. 19, the time difference Δtm is set so that the positions on which ink lands is displaced by the spacing between the longitudinal line N1 and the longitudinal line Q1.

It should be noted that the first PTS signal and the second PTS signal correspond to the first timing defining signal and the second timing defining signal, respectively. The controller 126 that generates the first PTS signal and the second PTS signal and outputs the signals to the head drive section 132 corresponds to the signal output section.

===Example of Dot Arrangement <1>===

Figure 21A:
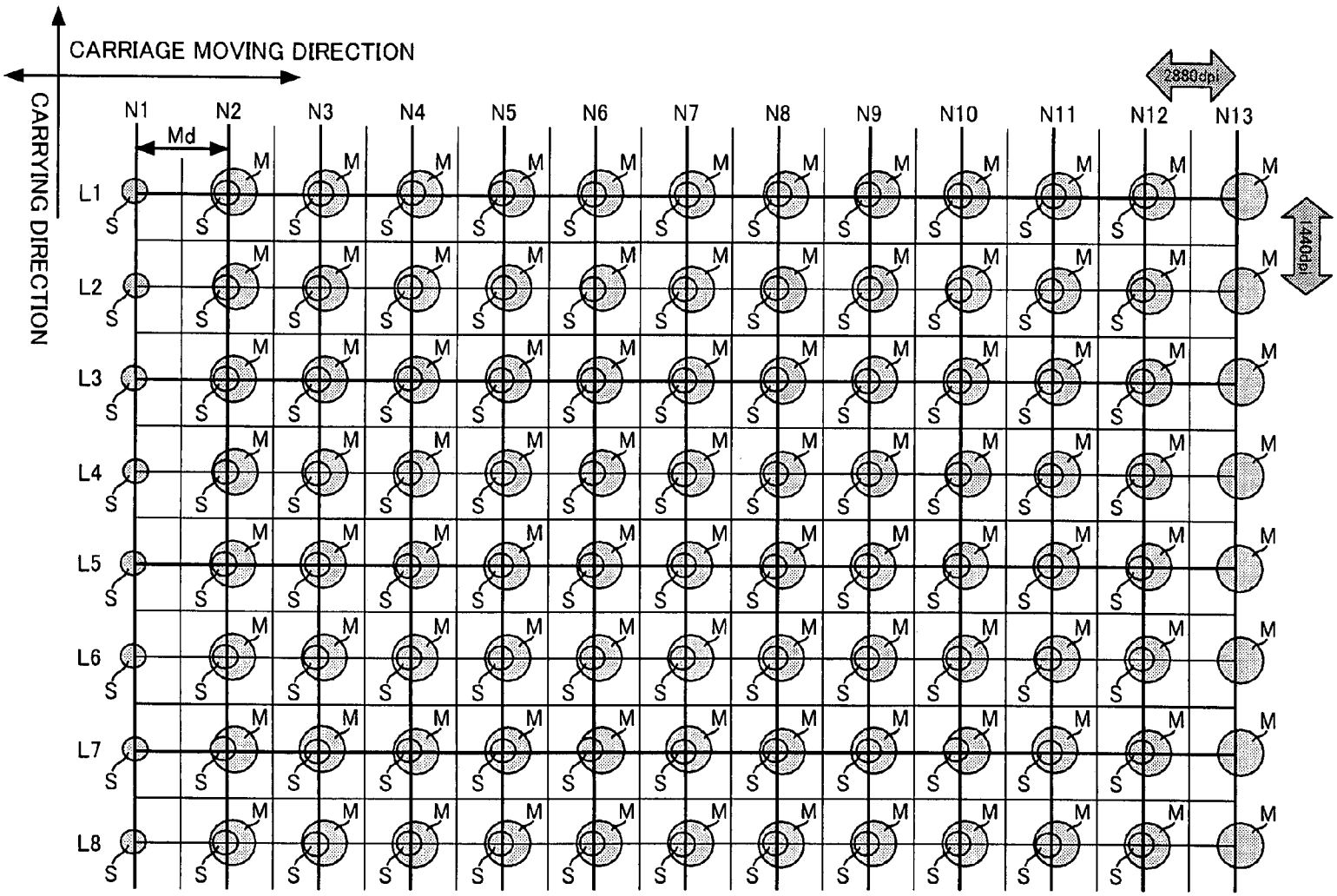
FIG. 21A is a diagram describing an example of a dot arrangement before improvement.
Figure 21B:
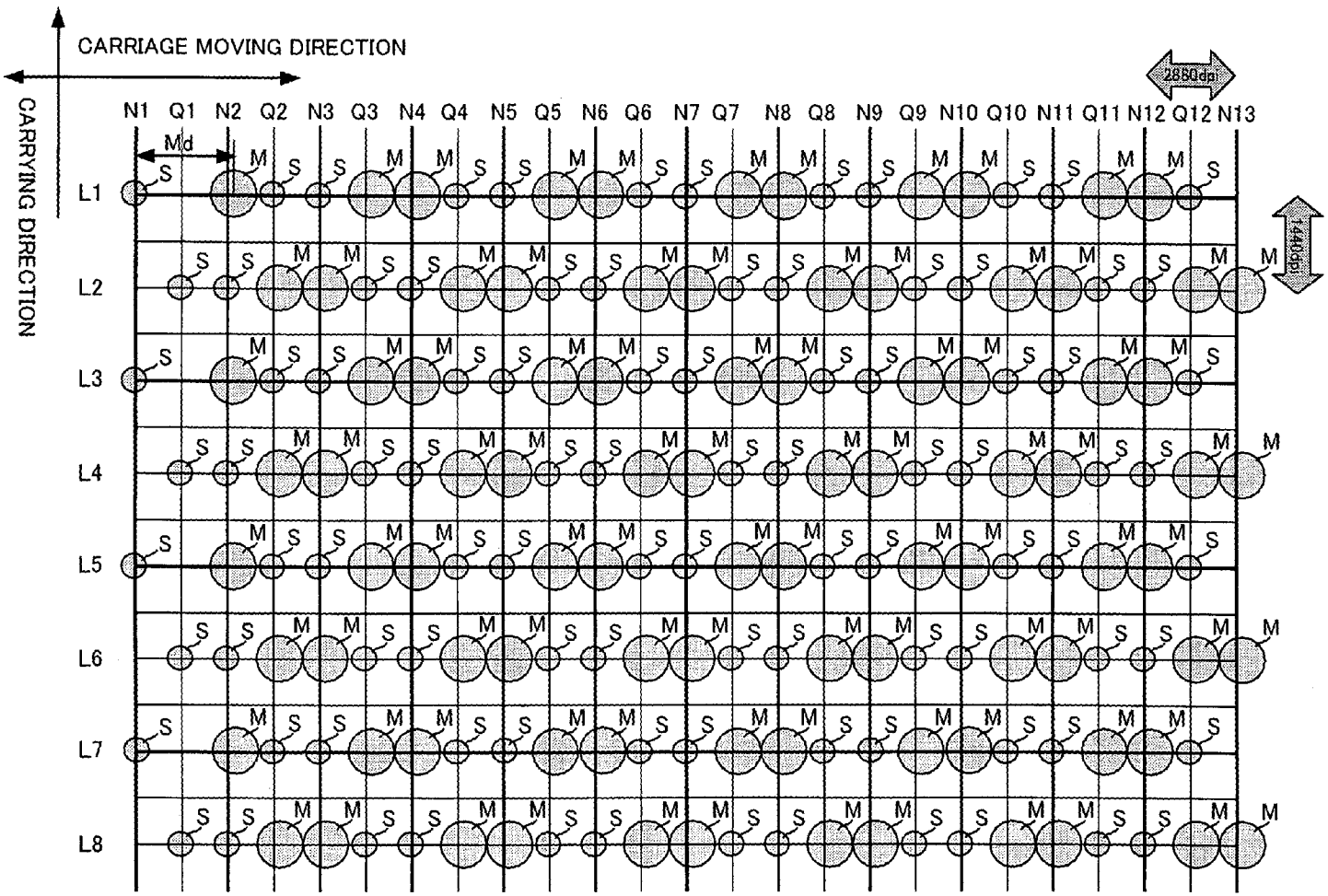
FIG. 21B is a diagram describing an example of a dot arrangement after improvement.

FIG. 21A shows an example of how dots are arranged before an improvement. FIG. 21B shows an example of how dots are arranged after an improvement. Here, a case is described as an example in which an image whose resolution is 2880 dpi (horizontally)×1440 dpi (vertically) is printed. It should be noted that the spacing of pixels configuring the image is 1/2880×25.4 (mm)=8.81 (μm) for the lateral direction (carriage movement direction) and 1/1440×25.4 (mm)=17.6 (μm) for the longitudinal direction (carrying direction). In FIG. 21A, the lateral lines L1 to L8 show the positions in the lateral direction corresponding to the pixels configuring the image to be printed. The longitudinal lines N1 to N13 show the positions in the longitudinal direction corresponding to the pixels configuring the image to be printed. In other words, those positions at which the lateral lines L1 to L8 and the longitudinal lines N1 to N13 mutually intersect respectively represent the positions corresponding to the pixels configuring the image to be printed.

Before the improvement, ink is ejected toward the positions corresponding to each of the pixels configuring the image to be printed. Therefore, if a "large dot" is formed for each pixel, for example, as shown in FIG. 21A, small ink droplets ejected first are ejected toward the positions corresponding to each of the pixels (positions at which the lateral lines L1 to L8 intersect the longitudinal lines N1 to N13), and respectively land on those positions, thus forming small dots S. Middle ink droplets subsequently ejected at a delayed timing land on positions displaced by the predetermined distance Md from the positions corresponding to each of the pixels (positions at which the lateral lines L1 to L8 intersect the longitudinal lines N1 to N13), thus forming middle dots M respectively at those displaced positions.

Here, when the displacement width Md between the position in which the small dot S is formed and the position in which the middle dot M is formed is close to the pixel spacing, in other words, the spacing between the longitudinal lines N1 and N2, as shown in FIG. 21A, the central position of the middle dot M is very close to that of the small dot S, creating a large overlapping area. In such case, the image quality may be adversely affected, due to uneven print density or graininess in the printed image, for example.

In order to improve the dot arrangement as described above, in this embodiment, dots are arranged as illustrated in FIG. 21B. Here, ink is ejected for, in addition to the positions corresponding to each of the pixels configuring the image to be printed (positions at which the lateral lines L1 to L8 intersect the longitudinal lines N1 to N13), positions displaced from the positions corresponding to each of the pixels. It should be noted that the positions displaced from the positions corresponding to each of the pixels represent the positions at which the lateral lines L1 to L8 intersects the longitudinal lines Q1 to Q12 that are respectively set in the spaces created by the longitudinal lines N1 to N13.

In order to form "large dots", small ink droplets ejected first are ejected toward, in addition to the positions corresponding to each of the pixels (positions at which the lateral lines L1 to L8 intersect the longitudinal lines N1 to N13), the positions displaced from the positions corresponding to each of the pixels (positions at which the lateral lines L1 to L3 intersect the longitudinal lines Q1 to Q4). As a result, small dots S are formed in, in addition to the positions corresponding to each of the pixels (positions at which the lateral lines L1 to L8 intersect the longitudinal lines N1 to N13), the positions displaced from the positions corresponding to each of the pixels (positions at which the lateral lines L1 to L8 intersect the longitudinal lines Q1 to Q12).

Middle ink droplets subsequently ejected land on, as shown in FIG. 21B, positions displaced by the predetermined distance Md from the positions corresponding to each of the pixels (positions at which the lateral lines L1 to L8 intersect the longitudinal lines N1 to N13), or the positions displaced from the positions corresponding to each of the pixels (positions at which the lateral lines L1 to L8 intersect the longitudinal lines Q1 to Q12). Consequently, middle dots M are formed in, in addition to the positions displaced by the predetermined distance Md from the positions corresponding to the pixels (positions at which the lateral lines L1 to L8 intersect the longitudinal lines N1 to N13), the positions displaced by the predetermined distance Md from the positions displaced from the positions corresponding to the pixels (positions at which the lateral lines L1 to L8 intersect the longitudinal lines Q1 to Q12).

As described above, small dots S and middle dots M are formed in, in addition to the positions corresponding to each of the pixels (positions at which the lateral lines L1 to L8 intersect the longitudinal lines N1 to N13) or the positions displaced by the predetermined distance Md from those positions, the positions displaced from the positions corresponding to each of the pixels (positions at which the lateral lines L1 to L8 intersect the longitudinal lines Q1 to Q12) or the positions displaced by the predetermined distance Md from those displaced positions. As a result, it is possible to adjust the dot arrangement by a spacing narrower than the spacing of the pixels configuring the image to be printed. Consequently, it is possible to regulate the dot arrangement at a resolution (in this case, 5760 (dpi)) higher than the resolution of an image to be printed (in this case, 2880 (dpi)). In other words, it is possible to print an image at a resolution higher than the resolution of the image to be printed. Therefore, the image quality of the printed image can be improved, by improving uneven print density or graininess.

<Actual Dot Size and Spacing>

Figures 21C, 21D:
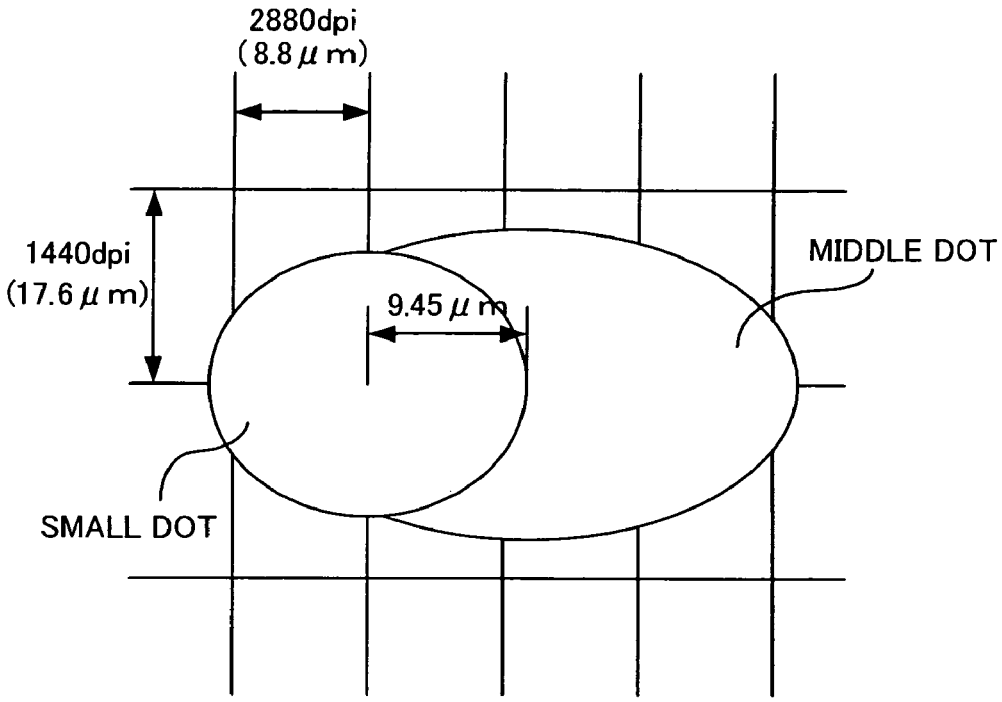
FIG. 21C is a diagram describing an image printing method.
FIG. 21D is a diagram describing the actual sizes and the spacing of dots.

FIG. 21C shows an example of the actual size and spacing of dots. As shown in FIG. 21C, the sizes of actual dots, both the small dot S and the middle dot M, are very large. For example, the small dot S is formed with its diameter being approximately 22 (μm), and the middle dot M is formed with its diameter being approximately 30 (μm). The spacing between the small dot S and the middle dot M (predetermined distance Md) is, in this case, approximately 9.45 (μm). Therefore, even if the central position of the small dot S is displaced from that of the middle dot M, a large overlapping area is created.

<Printing Method>

The following is a description of a printing method to arrange dots as illustrated in FIG. 21B. A case is described here as an example in which an image is printed in the overlap mode using 180 nozzles including the nozzles #1 to #180 arranged in the carrying direction as shown in FIG. 7. FIG. 21D shows an example of printing process for each of the pixels in the overlap mode. Each box corresponds to the position onto which a small ink droplet is ejected when printing an image. The boxes have the numerals "1" to "32", respectively. Each numeral indicated in each box shows in what ordinal number of pass ink is ejected toward the position corresponding to that box. N1 to N4 and Q1 to Q4 correspond to the longitudinal lines N1 to N4 and Q1 to Q4 shown in FIG. 21B. Also, L1 to L8 correspond to the lateral lines L1 to L8 shown in FIG. 21B.

If the resolution in the carrying direction of the image to be printed is 1440 (dpi), and the nozzle spacing is 180 (dpi), then "K=8". If one raster line is formed using four nozzles, the overlap number M is "4". Since the nozzle number N is "180", N/M is "45". Here, since "k" is coprime to N/M, the carry amount F is N/M×D ("D" is the pixel spacing in the carrying direction of the image to be printed), namely, "45×D" in this case.

When printing is performed in the overlap mode with the carry amount F, it is possible to eject ink for the position corresponding to each box in the ordinal number of pass indicated in that box. Specifically, ink can be ejected in the first pass toward the position at which the longitudinal line N1 intersects the lateral line L1. Also, ink can be ejected in the 26th pass toward the position at which the longitudinal line Q3 intersects the lateral line L6. In this manner, an image can be printed by ejecting ink for each position in the overlap mode.

===Example of Dot Arrangement <2>===

Figure 22A:
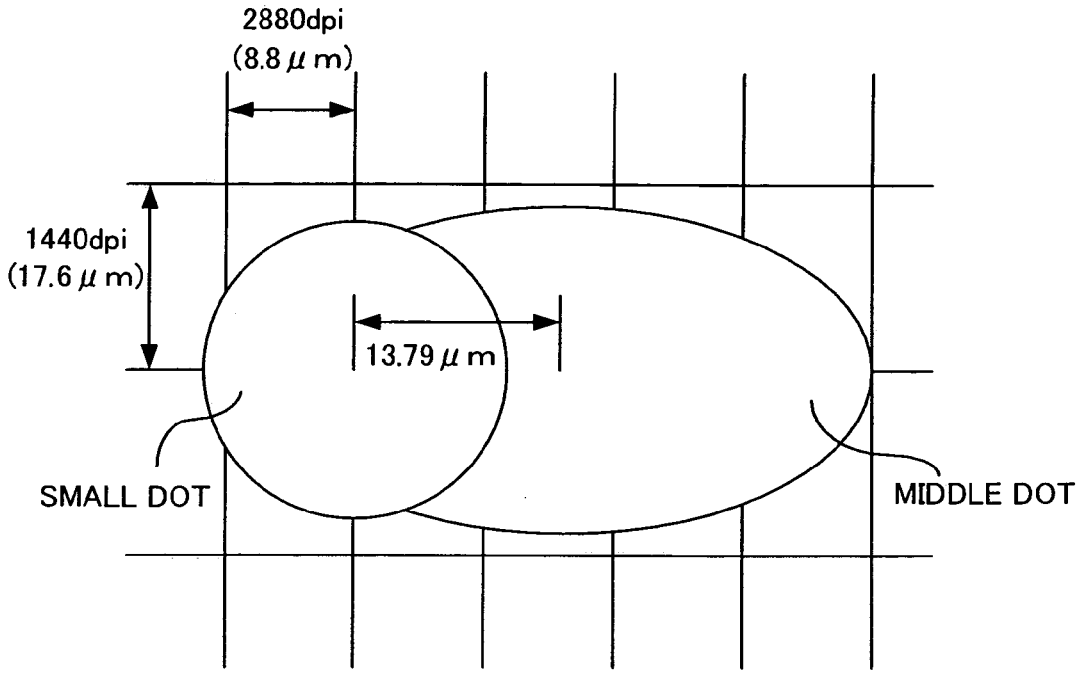
FIG. 22A is a diagram describing the spacing between dots.
Figure 22B:
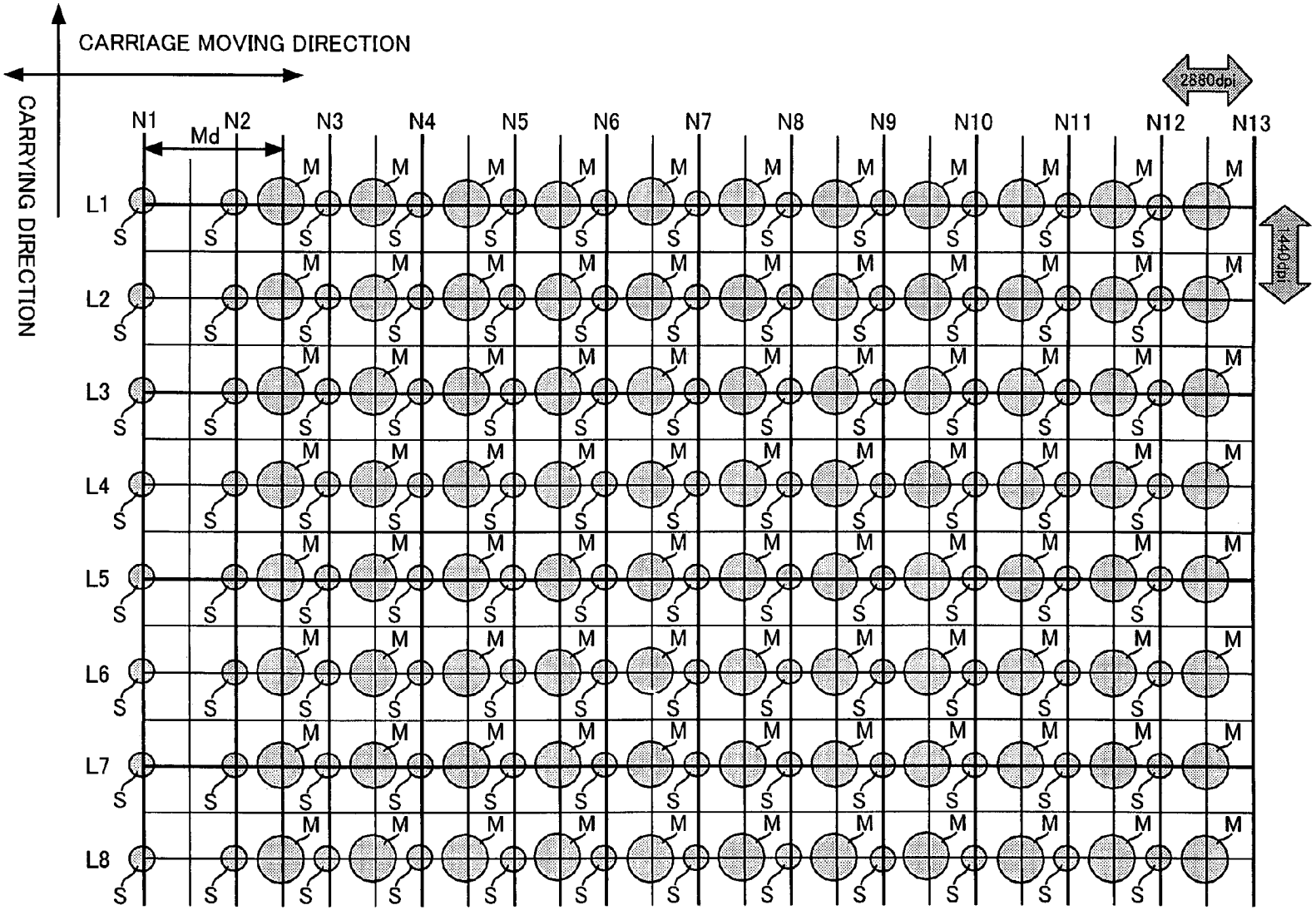
FIG. 22B is a diagram describing an example of a dot arrangement before improvement.
Figure 22C:
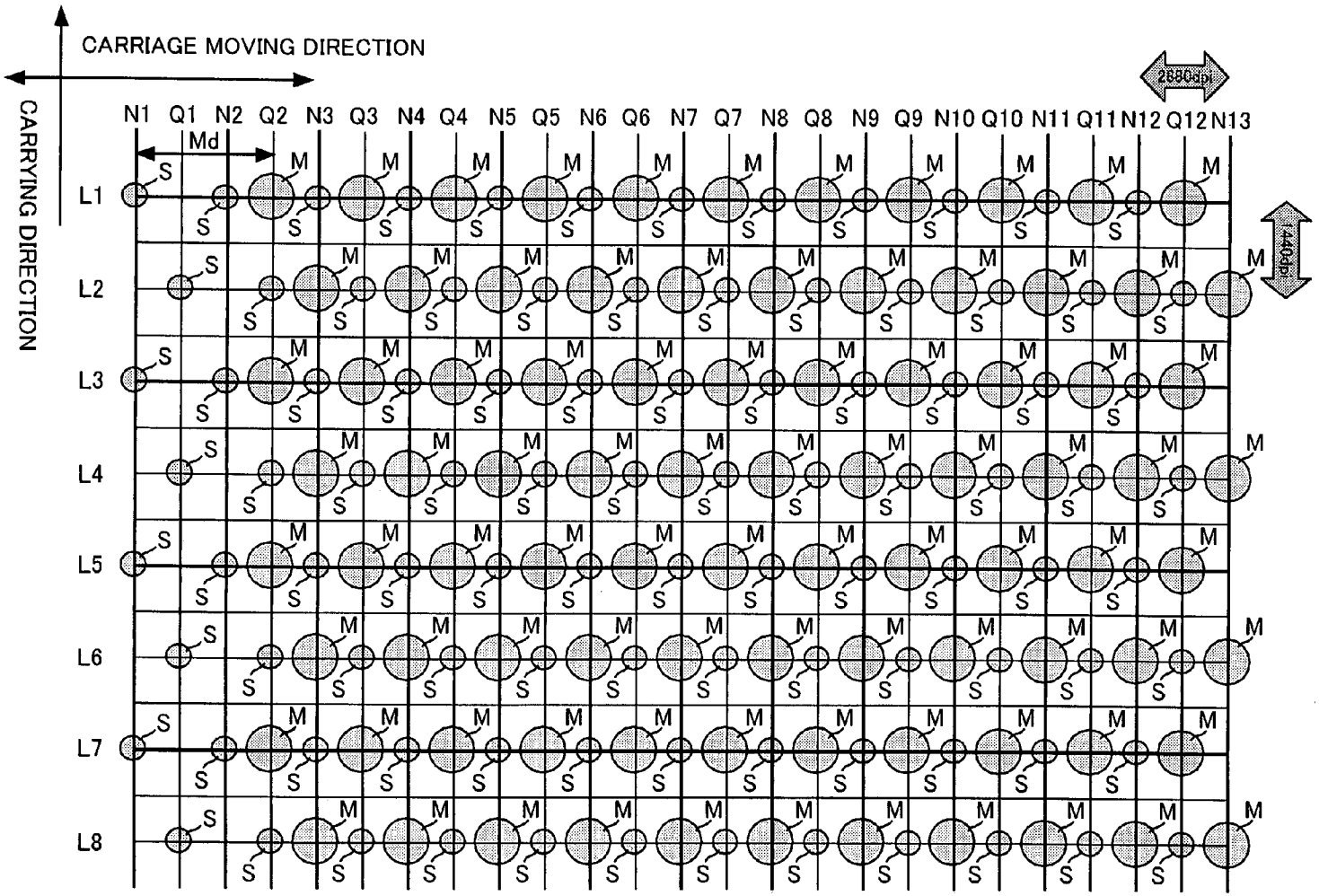
FIG. 22C is a diagram describing an example of a dot arrangement after improvement.

Next, an example of dot arrangement at a different spacing between the small dot S and the middle dot M is described. FIG. 22A describes the dot spacing. FIG. 22B shows how dots are arranged before the improvement. FIG. 22C shows how dots are arranged after the improvement. It should be noted that the lateral lines L1 to L8 shown in FIGS. 22B and 22C show positions in the lateral direction corresponding to pixels configuring an image to be printed, and the longitudinal lines N1 to N13 show positions in the longitudinal direction corresponding to the pixels configuring the image to be printed. In other words, those positions at which the lateral lines L1 to L8 and the longitudinal lines N1 to N13 mutually intersect respectively represent the positions corresponding to the pixels configuring the image to be printed.

In this case, the spacing between the small dot S and the middle dot M is set, as shown in FIG. 22A, to 13.79 (μm). With such a spacing between the small dot S and the middle dot M, dots formed by the known inkjet printer are arranged in a state as shown in FIG. 22B. Specifically, in the known inkjet printer, ink is ejected toward the positions corresponding to each of the pixels configuring the image to be printed, so that small dots S that are formed by ink ejected first (small ink droplets) are formed in each of the positions corresponding to each of the pixels (positions at which the lateral lines L1 to L8 intersect the longitudinal lines N1 to N13). On the other hand, middle dots M that are formed by ink subsequently ejected (middle ink droplets) are formed in positions displaced by the predetermined distance Md (=13.79 (μm)) from the positions corresponding to each of the pixels (positions at which the lateral lines L1 to L8 intersect the longitudinal lines N1 to N13).

Here, since the displacement width Md between the position in which the small dot S is formed and the position in which the middle dot M is formed, is approximately 1.5 times the spacing of the pixels configuring the image to be printed, the central position of the middle dot M is located just in the middle of two small dots S that are adjacent to each other. As a result, as shown in FIG. 22A, the respective central positions of the small dot S and the middle dot M are arranged in a balanced manner, mutually spaced away. However, with this dot arrangement, lines are created in which only the small dots S are intensively arranged in the carrying direction or the middle dots M are intensively arranged in the carrying direction, for this reason uneven print density or graininess in the printed image may occur.

Therefore, in order to further improve the dot arrangement, in this embodiment, the positions of the small dot S and the middle dot M are adjusted more finely. An example of how dots are arranged after the adjustment at this time is shown in FIG. 22C. In this case, as shown in FIG. 22C, ink is ejected for, in addition to positions corresponding to each of the pixels (positions at which the lateral lines L1 to L8 intersect the longitudinal lines N1 to N13) configuring an image to be printed, positions displaced from the positions corresponding to each of the pixels. It should be noted that, the positions displaced from the positions corresponding to each of the pixels represent the positions at which each of the lateral lines L1 to L8 intersects the longitudinal lines Q1 to Q12 that are respectively set in the spaces created by the longitudinal lines N1 to N13.

Consequently, the small dots S are formed, in addition to the positions corresponding to each of the pixels (positions at which the lateral lines L1 to L8 intersect the longitudinal lines N1 to N13), the positions displaced from the positions corresponding to each of the pixels (positions at which the lateral lines L1 to L8 intersect the longitudinal lines Q1 to Q12). Also, the middle dots M are formed, in addition to the positions displaced by the predetermined distance Md (=13.79 (μm)) from the positions corresponding to each of the pixels (positions at which the lateral lines L1 to L8 intersect the longitudinal lines N1 to N13), the positions displaced by the predetermined distance Md from the positions displaced from the positions corresponding to each of the pixels (positions at which the lateral lines L1 to L8 intersect the longitudinal lines Q1 to Q12).

Here, the position in which the dot is formed changes alternately every line (one raster line) of the lateral lines L1 to L8. Specifically, in the first lateral line L1, small dots S are formed in the positions corresponding to each of the pixels (positions at which the lateral line L1 intersects the longitudinal lines N1 to N12), and the middle dots M are formed in the positions displaced by the predetermined distance Md from the positions corresponding to each of the pixels. On the other hand, in the second lateral line L2, small dots S are formed in the positions displaced from the positions corresponding to each of the pixels (positions at which the lateral line L2 intersects the longitudinal lines Q1 to Q12), and middle dots M are formed in the positions displaced by the predetermined distance Md from those displaced positions. These dot arrangements are repeated alternately between the odd-numbered lateral lines L1, L3, L5, and L7, and the even-numbered lateral lines L2, L4, L6, and L8. As a result, as shown in the FIG. 22C, it is possible form a state in which the small dots S and the middle dots M are arranged in a balanced manner in the carrying direction, without forming any lines in which only small dots S or middle dots M are arranged.

By adjusting the arrangement of the small dot S and the middle dot M at a spacing narrower than the spacing of the pixels configuring the image to be printed, it is possible to regulate the dot arrangement at a resolution (in this case, 5760 (dpi)) higher than the resolution of the image to be printed (in this case, 2880 (dpi)). Therefore, it is possible to print an image at a resolution higher than the resolution of the image to be printed. Accordingly, the image quality of the printed image can be improved by improving the uneven print density or graininess.

<Printing Method>

Figures 22D, 23A:
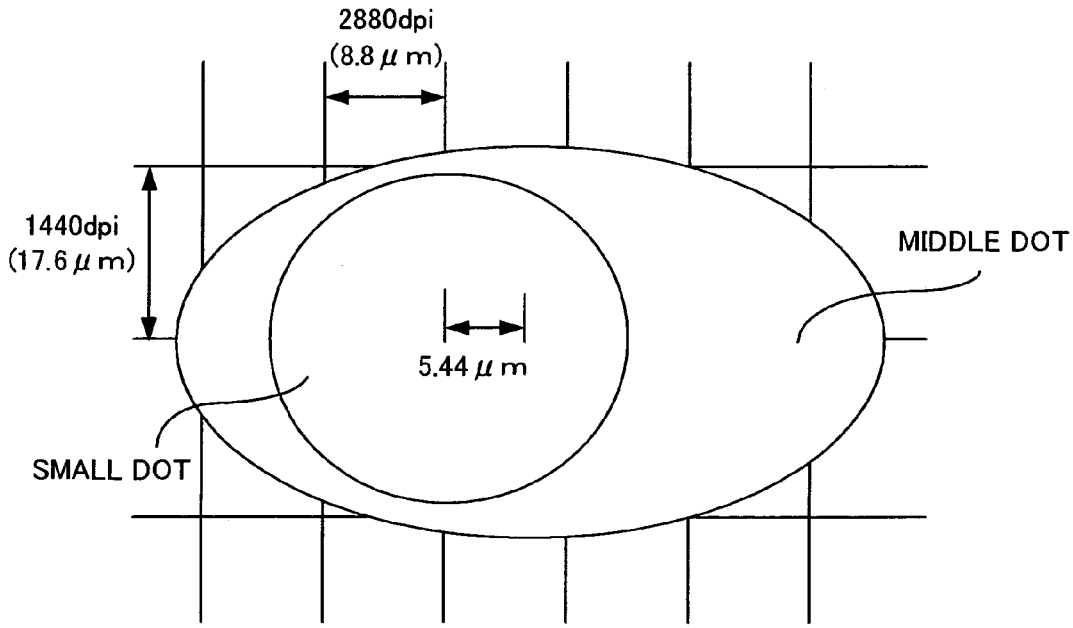
FIG. 22D is a diagram describing an image printing method.
FIG. 23A is a diagram describing the spacing between dots.

FIG. 22D describes an example of the printing method to arrange dots as shown in FIG. 22C. An example is described here in which an image is printed in the overlap mode. Each box shown in FIG. 22D each corresponds to the position onto which a small ink droplet is ejected when printing an image. The numerals "1" to "32" indicated in each of the boxes show in what ordinal number of pass ink is ejected toward the position corresponding to the relevant box. N1 to N4 and Q1 to Q4 correspond to the longitudinal lines N1 to N4 and Q1 to Q4 shown in FIG. 22C. Also, L1 to L8 correspond to the lateral lines L1 to L8 shown in FIG. 22C.

When the resolution in the carrying direction of the image to be printed is 1440 (dpi), and the nozzle spacing is 180 (dpi), then "K=8". When one raster line is formed by four nozzles, the overlap number M is "4". Since the nozzle number N is "180", "N/M" is "45". Here, since "k" is coprime to N/M, the carry amount F become "N/M"×D ("D" is the pixel spacing in the carrying direction of the image to be printed), in other words, "45×D" in this case.

When printing is performed in the overlap mode with this carry amount F, it is possible to eject ink for the position corresponding to each box in the number of pass indicated in that box. Specifically, ink can be ejected in the first pass toward the position at which the longitudinal line N1 intersects the lateral line L1. Also, ink can be ejected in the 16th pass toward the position at which the longitudinal line Q2 intersects the lateral line L4. In this manner, an image can be printed by ejecting ink for each position in the overlap mode.

===Example of Dot Arrangement <3>===

Figure 23B:
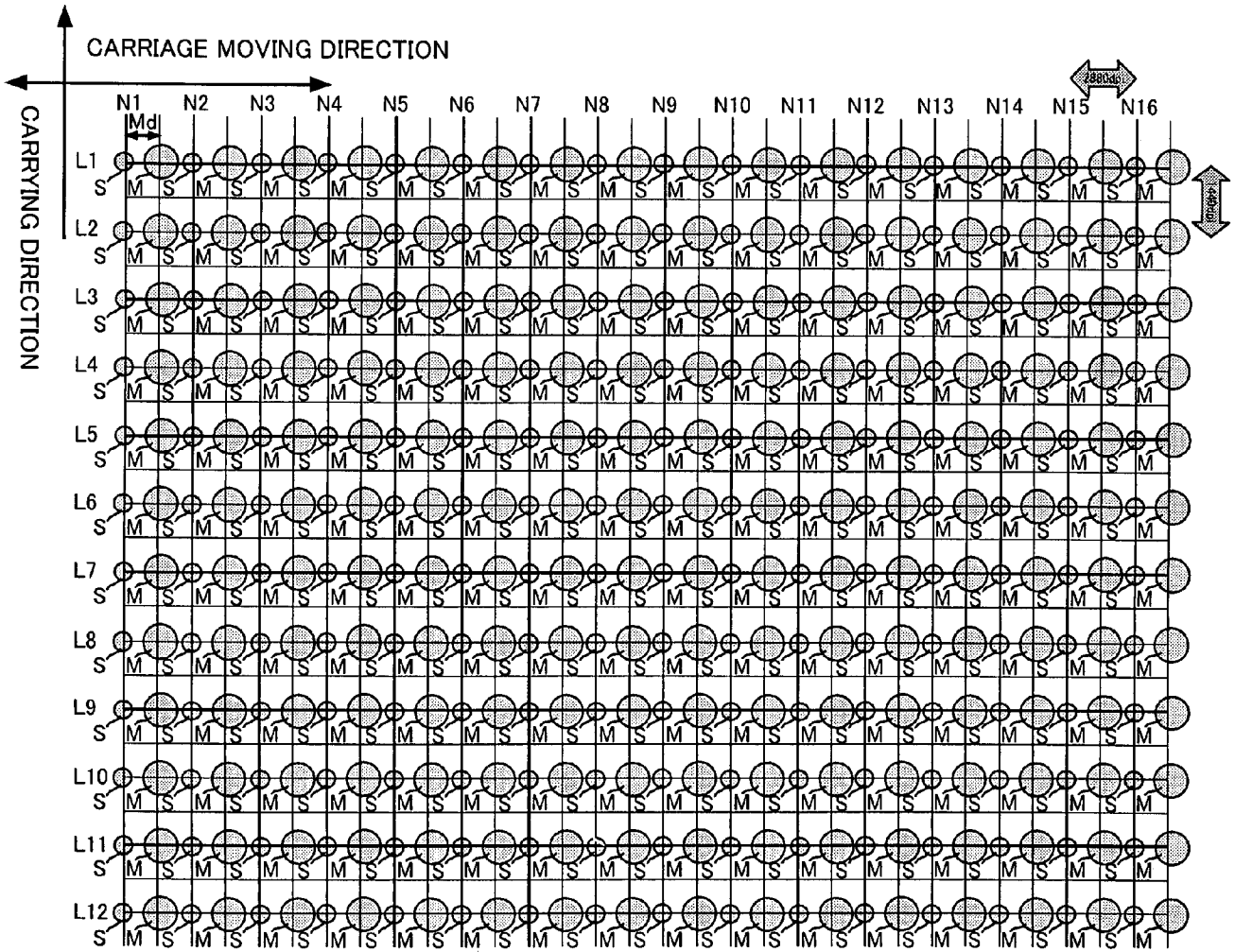
FIG. 23B is a diagram describing an example of a dot arrangement before improvement.
Figure 23C:
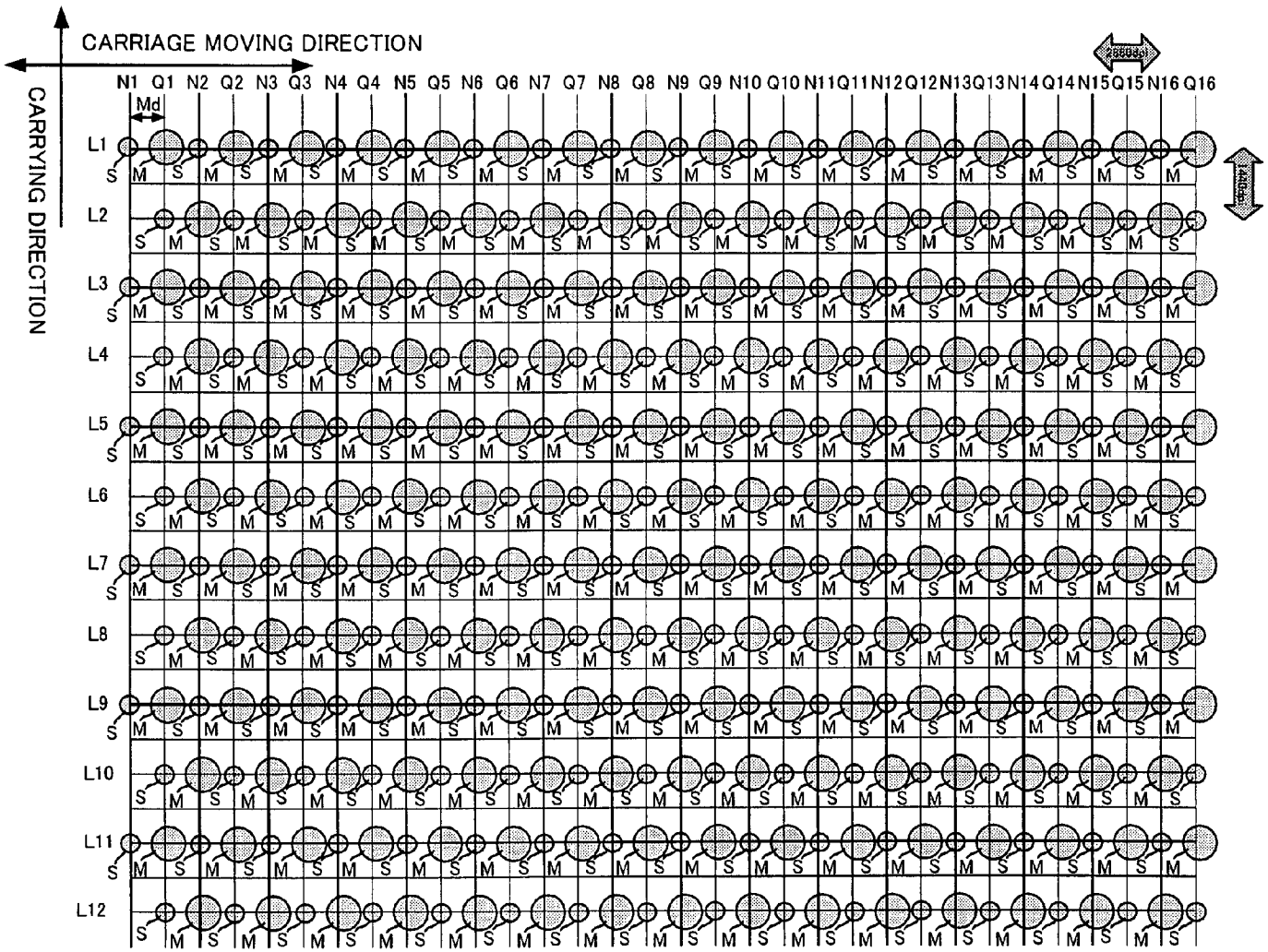
FIG. 23C is a diagram describing an example of a dot arrangement after improvement.

Next, a case is described in which the spacing between the small dot S and the middle dot M is narrow. FIG. 23A shows the dot spacing. FIG. 23B shows how dots are arranged before the improvement. FIG. 23C shows how dots are arranged after the improvement. It should be noted that the lateral lines L1 to L12 shown in FIGS. 23B and 23C represent positions in the lateral direction corresponding to pixels configuring an image to be printed, and the longitudinal lines N1 to N16 represent positions in the longitudinal direction corresponding to the pixels configuring an image to be printed. In other words, the positions at which the lateral lines L1 to L12 and the longitudinal lines N1 to N16 mutually intersect respectively represent the positions corresponding to pixels configuring the image to be printed.

In this case, the spacing between the central positions of the small dot S and the middle dot M is set, as shown in FIG. 23A, to be extremely narrow, i.e., 5.44 (μm). Since the central positions of the small dot S and the middle dot M are very close as above, the overlapping area of both of these dots is extremely large. In such case, dots formed by the known inkjet printer are arranged as shown in FIG. 23B. Small dots S are respectively formed in positions corresponding to each of the pixels (positions at which the lateral lines L1 to L12 intersect the longitudinal lines N1 to N16). On the other hand, middle dots M are formed in positions displaced by the predetermined distance Md (=5.44 (μm)) from the positions corresponding to each of the pixels (positions at which the lateral lines L1 to L12 intersect the longitudinal lines N1 to N16).

Since the displacement width Md between the position in which the small dot S is formed and the position in which the middle dot M is formed is approximately a half the spacing of the pixels configuring the image to be printed, the central position of the middle dot M is located at a position near the middle in between two small dots S that are adjacent to each other. As a result, as shown in FIG. 23B, the respective central positions of the small dot S and the middle dot M are arranged in a balanced manner, mutually spaced apart. However, with this dot arrangement, lines are created in which only small dots S are intensively arranged in the carrying direction or only middle dots M are intensively arranged in the carrying direction, for this reason uneven print density or graininess may occur in the printed image.

Therefore, in order to further improve the dot arrangement, in this embodiment, the positions of the small dot S and the middle dot M are adjusted more finely. An example of how dots are arranged after the adjustment is shown in FIG. 23C. In this case, as shown in FIG. 23C, ink is ejected for, in addition to the positions corresponding to the pixels configuring the image to be printed (positions at which the lateral lines L1 to L12 intersect the longitudinal lines N1 to N16), the positions displaced from the positions corresponding to the pixels (positions at which the lateral lines L1 to L12 intersect the longitudinal lines Q1 to Q15).

Consequently, small dots S are formed in, in addition to the positions corresponding to each of the pixels (positions at which the lateral lines L1 to L12 intersect the longitudinal lines N1 to N16), the positions displaced from the positions corresponding to each of the pixels (positions at which the lateral lines L1 to L12 intersect the longitudinal lines Q1 to Q15). Also, middle dots M are formed in, in addition to the positions displaced by the predetermined distance Md (=5.44 (μm)) from the positions corresponding to each of the pixels (positions at which the lateral lines L1 to L12 intersect the longitudinal lines N1 to N16), the positions displaced by the predetermined distance Md from the positions displaced from the positions corresponding to each of the pixels (positions at which the lateral lines L1 to L12 intersect the longitudinal lines Q1 to Q15).

Here, the position in which the dot is formed changes alternately every line (one raster line) of the lateral lines L1 to L12. Specifically, in the first lateral line L1, the small dots S are formed in the positions corresponding to each of the pixels (positions at which the lateral line L1 intersects the longitudinal lines N1 to N16), and the middle dots M are formed in the positions displaced by the predetermined distance Md from the positions corresponding to each of the pixels. On the other hand, in the second lateral line L2, small dots S are formed in the positions displaced from the positions corresponding to each of the pixels (positions at which the lateral line L2 intersects the longitudinal lines Q1 to Q16), and middle dots M are formed in the positions displaced by the predetermined distance Md from those displaced positions. These dot arrangements are repeated alternately between the odd-numbered lateral lines L1, L3, L5, L7, L9, and L11 and the even-numbered lateral lines L2, L4, L6, L8, L10, and L12. As a result, as shown in FIG. 23C, no line is formed in which only small dots S or middle dots M are arranged in the carrying direction, thus it is possible to arrange small dots S and middle dots M in a balanced manner.

By adjusting the arrangement of the small dot S and the middle dot M with a spacing narrower than the spacing of the pixels configuring the image to be printed, and regulating the dot arrangement at a resolution (in this case, 5760 (dpi)) higher than the resolution of the image to be printed (in this case, 2880 (dpi)), it is possible to print the image at a resolution higher than the resolution of the image to be printed. Accordingly, the image quality of the printed image can be improved by improving uneven print density or graininess.

<Printing Method>

FIG. 23D describes an example of the printing method to arrange dots as shown in FIG. 23C. An example described here is a case in which an image is printed in the overlap mode. Each box shown in FIG. 23D corresponds to the position onto which a small ink droplet is ejected when printing an image. The numeral indicated in each box shows in what ordinal number of pass ink is ejected toward the position corresponding to that box. N1 to N8 and Q1 to Q8 correspond to the longitudinal lines N1 to N8 and Q1 to Q8 shown in FIG. 23C. Also, L1 to L12 correspond to the lateral lines L1 to L12 shown in FIG. 23C.

When printing is performed with the conditions of the overlap number M being "8" and "N/M=11", ink can be ejected for the position corresponding to each box in the number of pass indicated in each box. Specifically, ink can be ejected in the first pass toward the position at which the longitudinal line N1 intersects the lateral line L1. Also, ink can be ejected in the 92nd pass for the pixel corresponding to the longitudinal line Q3 and the lateral line L6. In this manner, an image can be printed by ejecting ink for each position to form each dot in the overlap mode.

It should be noted that in this example, the position onto which the small ink droplet is ejected changes alternately every pass. Specifically, in the odd-numbered passes (gray color portions in FIG. 23D) small ink droplets are ejected toward the positions corresponding to each of the pixels configuring the image to be printed, and in the even-numbered passes (white color portions in FIG. 23C) small ink droplets are ejected toward the positions displaced from the positions corresponding to each of the pixels configuring the image to be printed. As a result, the position onto which small ink droplets are ejected changes every line (one raster line) of the lateral lines L1 to L12.

===Example of Dot Arrangement <4>===

Figure 24A:
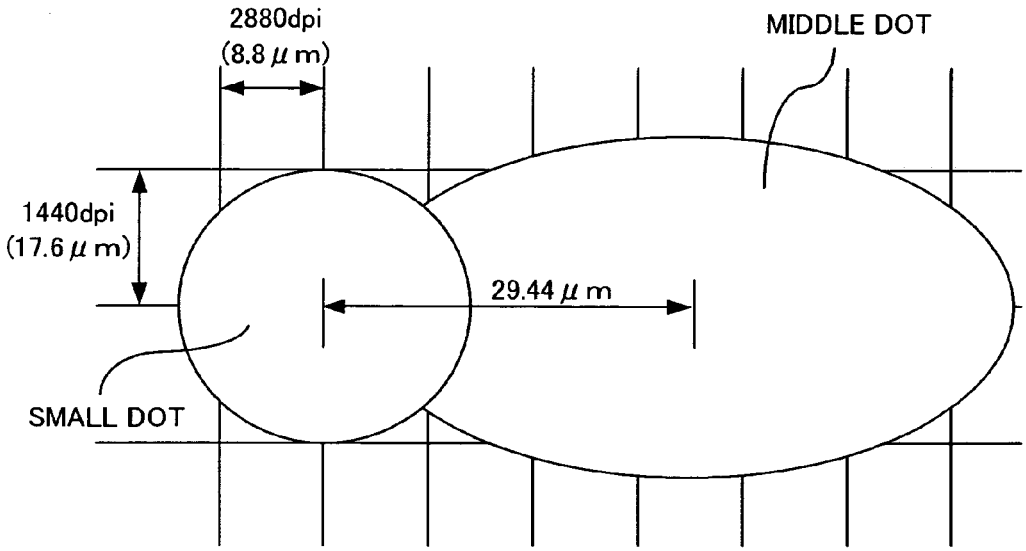
FIG. 24A is a diagram describing the spacing between dots.
Figure 24B:
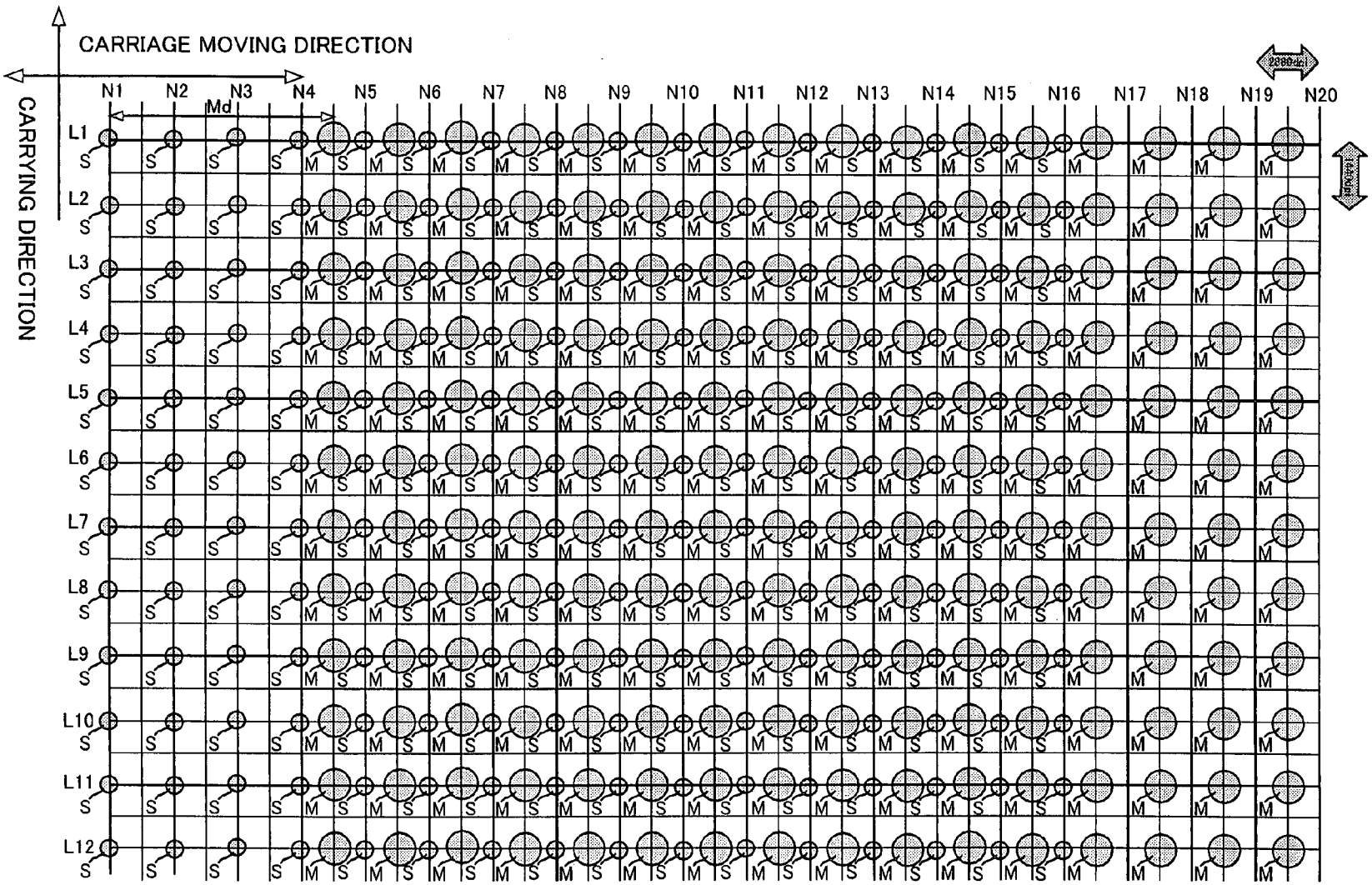
FIG. 24B is a diagram describing an example of a dot arrangement before improvement.
Figure 24C:
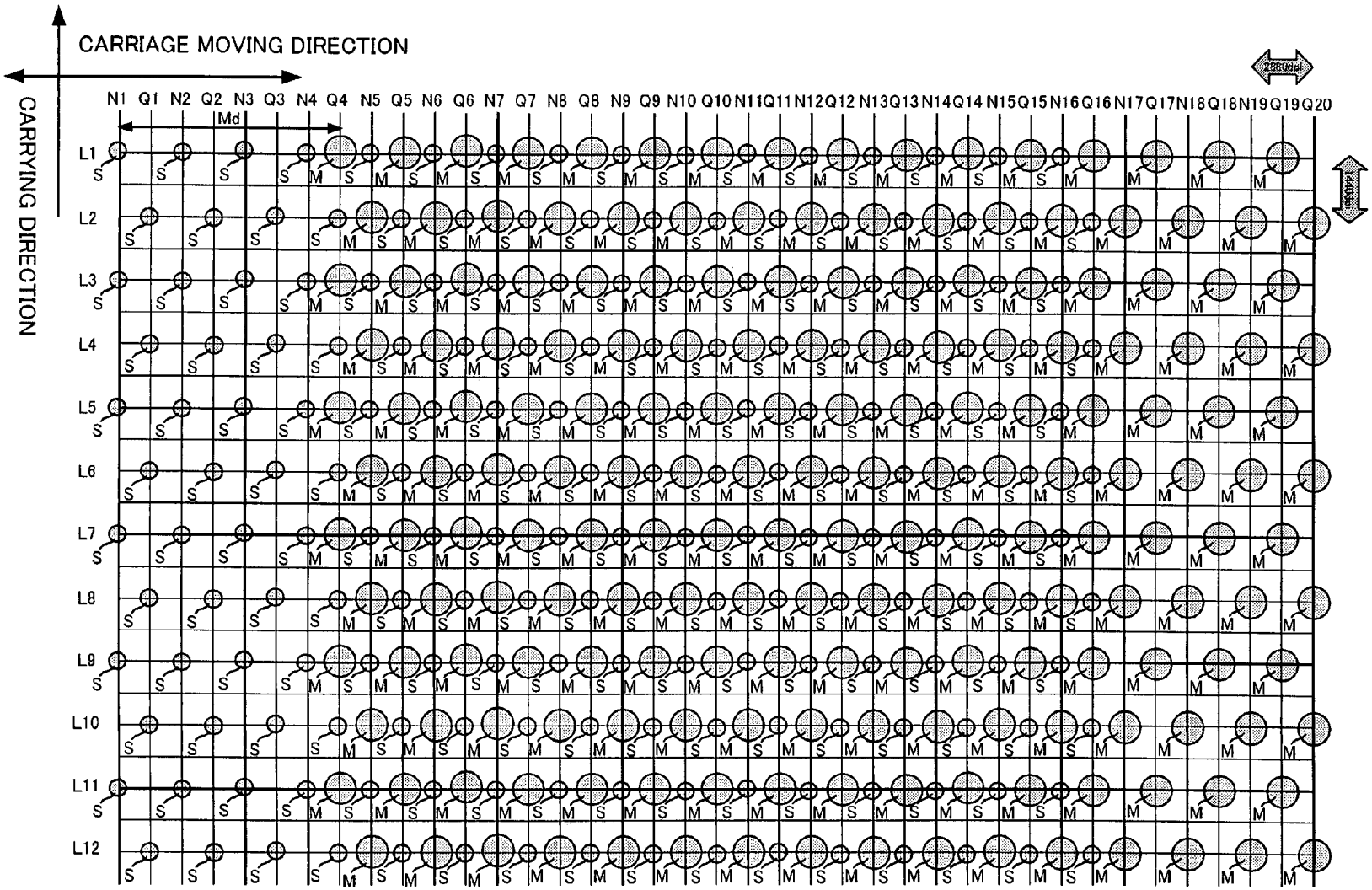
FIG. 24C is a diagram describing an example of a dot arrangement after improvement.

Next, an example of a case is described in which the spacing between the small dot S and the middle dot M is wide. FIG. 24A shows the dot spacing. FIG. 24B shows how dots are arranged before improvement. FIG. 24C shows how dots are arranged after improvement. It should be noted that the lateral lines L1 to L12 shown in FIGS. 24B and 24C show positions in the lateral direction corresponding to pixels configuring an image to be printed, and the longitudinal lines N1 to N20 show positions in the longitudinal direction corresponding to the pixels configuring the image to be printed. In other words, the respective positions at which the lateral lines L1 to L12 mutually intersect the longitudinal lines N1 to N20 represent the positions corresponding to the pixels configuring the image to be printed.

In this case, as shown in FIG. 24A, the spacing between the central positions of the small dot S and the middle dot M is set to be very wide as 29.44 (μm). Since the central position of the small dot S is very distant from that of the middle dot M, the overlapping area of both of these dots is small. In such case, dots formed by the known inkjet printer are arranged in a state as shown in FIG. 24B. Small dots S are respectively formed in the positions corresponding to each of the pixels (positions at which the lateral lines L1 to L12 intersect the longitudinal lines N1 to N20). On the other hand, middle dots M are formed in positions displaced by the predetermined distance Md (=29.44 (μm)) from the positions corresponding to each of the pixels (positions at which the lateral lines L1 to L12 intersect the longitudinal lines N1 to N20).

Here, since the displacement width Md between the position in which the small dot S is formed and the position in which the middle dot M is formed is a width approximately 3.5 times the spacing of the pixels configuring the image to be printed, the central position of the middle dot M is located at a position near the middle of two small dots S that are adjacent to each other. As a result, as shown in FIG. 24A, the respective central positions of the small dot S and the middle dot M are arranged in a balanced manner, mutually spaced apart. However, with this dot arrangement, lines are created in which only the small dots S are intensively arranged in the carrying direction or only the middle dots M are intensively arranged in the carrying direction, which makes it possible to cause uneven print density or graininess in the printed image.

Therefore, in order to further improve the dot arrangement, in this embodiment, the positions of the small dot S and the middle dot M are adjusted more finely. An example of how dots are arranged after the adjustment is shown in FIG. 24C. In this case, as shown in FIG. 24C, ink is ejected for, in addition to the positions corresponding to each of the pixels configuring the image to be printed (positions at which the lateral lines L1 to L12 intersect the longitudinal lines N1 to N20), the positions displaced from the positions corresponding to each of the pixels (positions at which the lateral lines L1 to L12 intersect the longitudinal lines Q1 to Q19).

Consequently, the small dots S are formed, in addition to the positions corresponding to each of the pixels (positions at which the lateral lines L1 to L12 intersect the longitudinal lines N1 to N20), the positions displaced from the positions corresponding to each of the pixels (positions at which the lateral lines L1 to L12 intersect the longitudinal lines Q1 to Q19). Further, the middle dots M are formed in, in addition to the positions displaced by the predetermined distance Md (=29.44 (μm)) from the positions corresponding to each of the pixels (positions at which the lateral lines L1 to L12 intersect the longitudinal lines N1 to N20), the positions displaced by the predetermined distance Md from the positions displaced from the positions corresponding to each of the pixels (positions at which the lateral lines L1 to L12 intersect the longitudinal lines Q1 to Q19).

Here, the position in which the dot is formed changes alternately every line (one raster line) of the lateral lines L1 to L12. Specifically, in the first lateral line L1, the small dots S are formed in the positions corresponding to each of the pixels (positions at which the lateral line L1 intersects the longitudinal lines N1 to N20), and the middle dots M are formed in the positions displaced by the predetermined distance Md from the positions corresponding to each of the pixels. On the other hand, in the second lateral line L2, small dots S are formed in the positions displaced from the positions corresponding to each of the pixels (positions at which the lateral line L2 intersects the longitudinal lines Q1 to Q19), and middle dots M are formed in the positions displaced by the predetermined distance Md from those displaced positions. These dot arrangements are repeated alternately between the odd-numbered lateral lines L1, L3, L5, L7, L9, and L11 and the even-numbered lateral lines L2, L4, L6, L8, L10, and L12. As a result, as shown in the FIG. 24C, no line is formed in which only small dots S are arranged in the carrying direction or only middle dots M are arranged in the carrying direction, thus it is possible to arrange small dots S and middle dots M in a balanced manner.

By adjusting the arrangement of the small dot S and the middle dot M at a spacing narrower than the spacing of the pixels configuring an image to be printed, and regulating the dot arrangement at a resolution (in this case, 5760 (dpi)) higher than the resolution of the image to be printed (in this case, 2880 (dpi)), it is possible to print the image at a resolution higher than the resolution of the image to be printed. Accordingly, the image quality of the printed image can be improved by improving uneven print density or graininess.

With respect to the printing method, printing can be performed by the same method as in "Example of Dot Formation <3>", that is, the method explained with reference to FIG. 23D.

===Example of Dot Arrangement <5>===

Figure 25A:
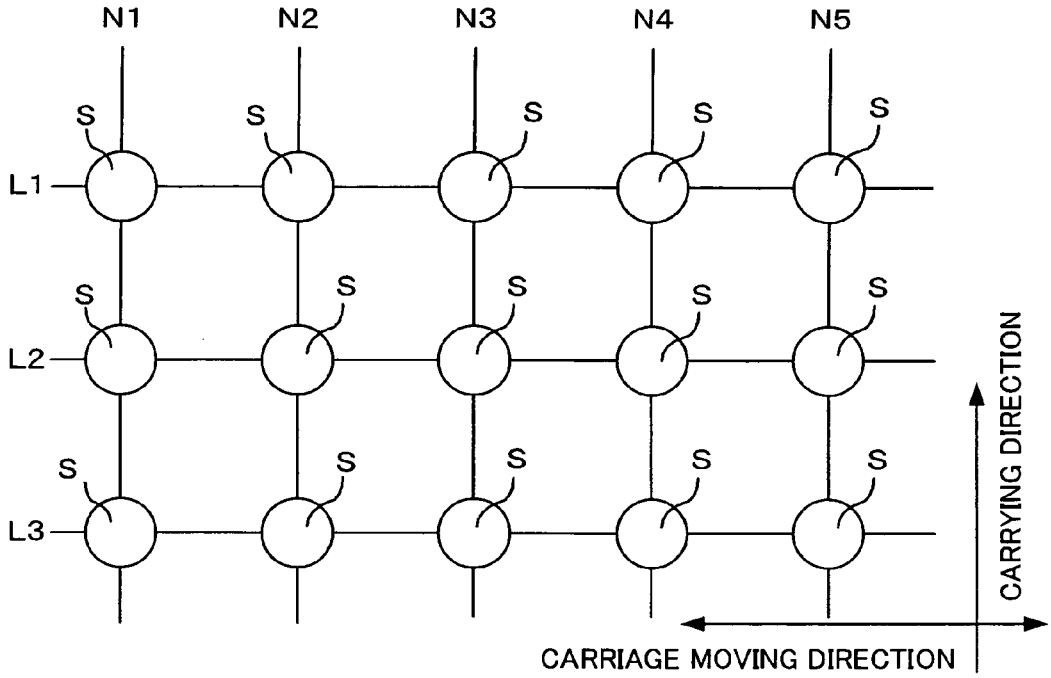
FIG. 25A is a diagram describing an example of a dot arrangement before improvement.
Figure 25B:
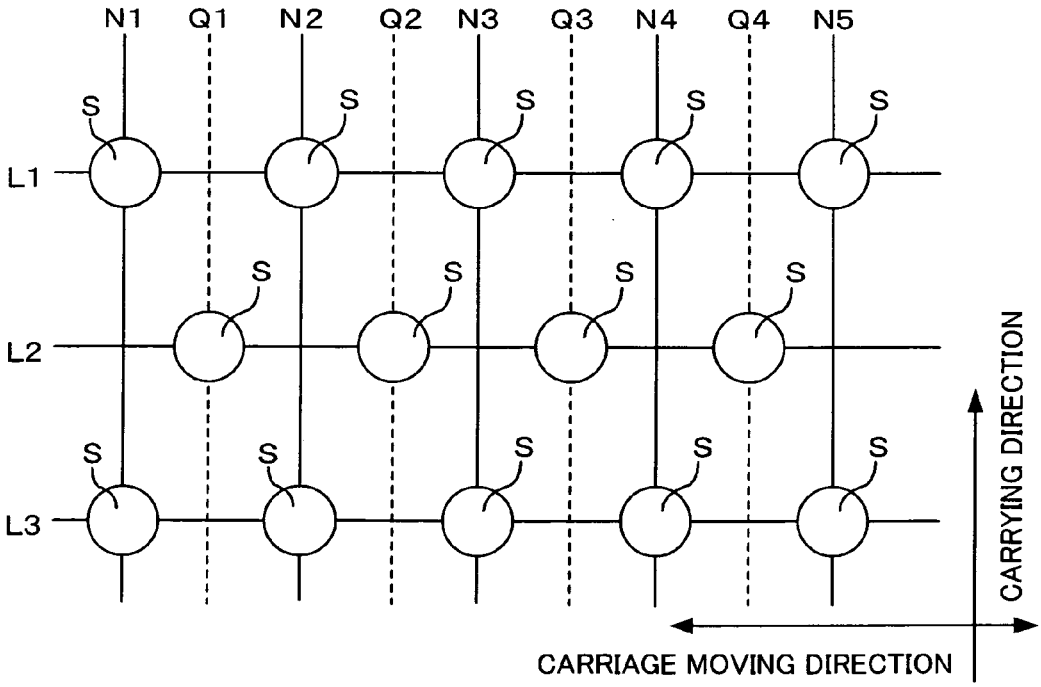
FIG. 25B is a diagram describing an example of a dot arrangement after improvement.

Next, an example of a case is described in which only small dots S are formed. FIG. 25A shows an example of how dots are arranged before improvement. FIG. 25B describes an example of how dots are arranged after improvement. It should be noted that the lateral lines L1 to L3 show positions in the lateral direction corresponding to the pixels configuring an image to be printed, and the longitudinal lines N1 to N5 show positions in the longitudinal direction corresponding to the pixels configuring the image to be printed. In other words, the respective positions at which the lateral lines L1 to L3 intersect the longitudinal lines N1 to N5 represent the positions corresponding to the pixels configuring the image to be printed.

Before improvement, as shown in FIG. 25A, small ink droplets are ejected toward the positions corresponding to each of the pixels, forming small dots S respectively in the positions corresponding to each of the pixels (positions at which the lateral lines L1 to L3 intersect the longitudinal lines N1 to N5). After improvement, as shown in FIG. 25B, when ejecting small ink droplets, ink is ejected for, in addition to the positions corresponding to each of the pixels configuring the image to be printed (positions at which the lateral lines L1 to L3 intersect the longitudinal lines N1 to N5), the positions displaced from the positions corresponding to each of the pixels (positions at which the lateral lines L1 to L3 intersect the longitudinal lines Q1 to Q4).

Accordingly, the small dots S are formed in, in addition to the positions corresponding to each of the pixels (positions at which the lateral lines L1 to L3 intersect the longitudinal lines N1 to N5), the positions displaced from the positions corresponding to each of the pixels (positions at which the lateral lines L1 to L3 intersect the longitudinal lines Q1 to Q4).

Here, the position in which the dot is formed changes alternately every line (one raster line) of the lateral lines L1 to L3. Specifically, in the first lateral line L1, the small dots S are formed in the positions corresponding to each of the pixels (positions at which the lateral line L1 intersects the longitudinal lines N1 to N5). On the other hand, in the second lateral line L2, small dots S are formed in the positions displaced from the positions corresponding to each of the pixels (positions at which the lateral line L2 intersects the longitudinal lines Q1 to Q4). These dot arrangements are repeated alternately between the odd-numbered lateral lines L1, L3 and the even-numbered lateral line L2. As a result, as shown in the FIG. 25B, it is possible to arrange the small dots S in a balanced manner in the carrying direction, without forming a line in which small dots S are intensively arranged in the carrying direction.

As described above, even for the case in which only small dots S are formed, by adjusting the dot arrangement with a spacing narrower than the spacing of the pixels configuring the image to be printed, it is possible to print an image by regulating the dot arrangement at a resolution higher than that of the image to be printed. Accordingly, the image quality of the printed image can be improved, by improving uneven print density or graininess.

===Processing of Controller===

The controller 126 determines for each pass whether ink should be ejected for positions corresponding to pixels configuring an image to be printed, or positions displaced from the positions corresponding to the pixels configuring the image to be printed, based on the control data attached to print data sent from the computer 152.

Here, the control data is generated by the printer driver 164 installed on the computer 152. When performing rasterization process in which the data such as binary data or multi-value data obtained through the halftone processing at the halftone processing section 170 is changed in the order to be transferred to the inkjet printer 1 at the rasterization processing section 172, the printer driver 164 generates for each pass control data that instructs whether ink should be ejected for the positions corresponding to the pixels configuring the image to be printed, or the positions displaced from the positions corresponding to the pixels configuring the image to be printed. The control data is attached to the print data transferred to the inkjet printer 1.

The controller 126 determines which of the first PTS signal and the second PTS signal should be output based on the control data from the computer 152. In other words, when ink is ejected for the positions corresponding to the pixels configuring the image to be printed, the controller 126 selects the first PTS signal as a signal to be output, and when ink is ejected for the positions displaced form the positions corresponding to the pixels configuring the image to be printed, the controller 126 selects the second PTS signal as a signal to be output.

Figure 26:
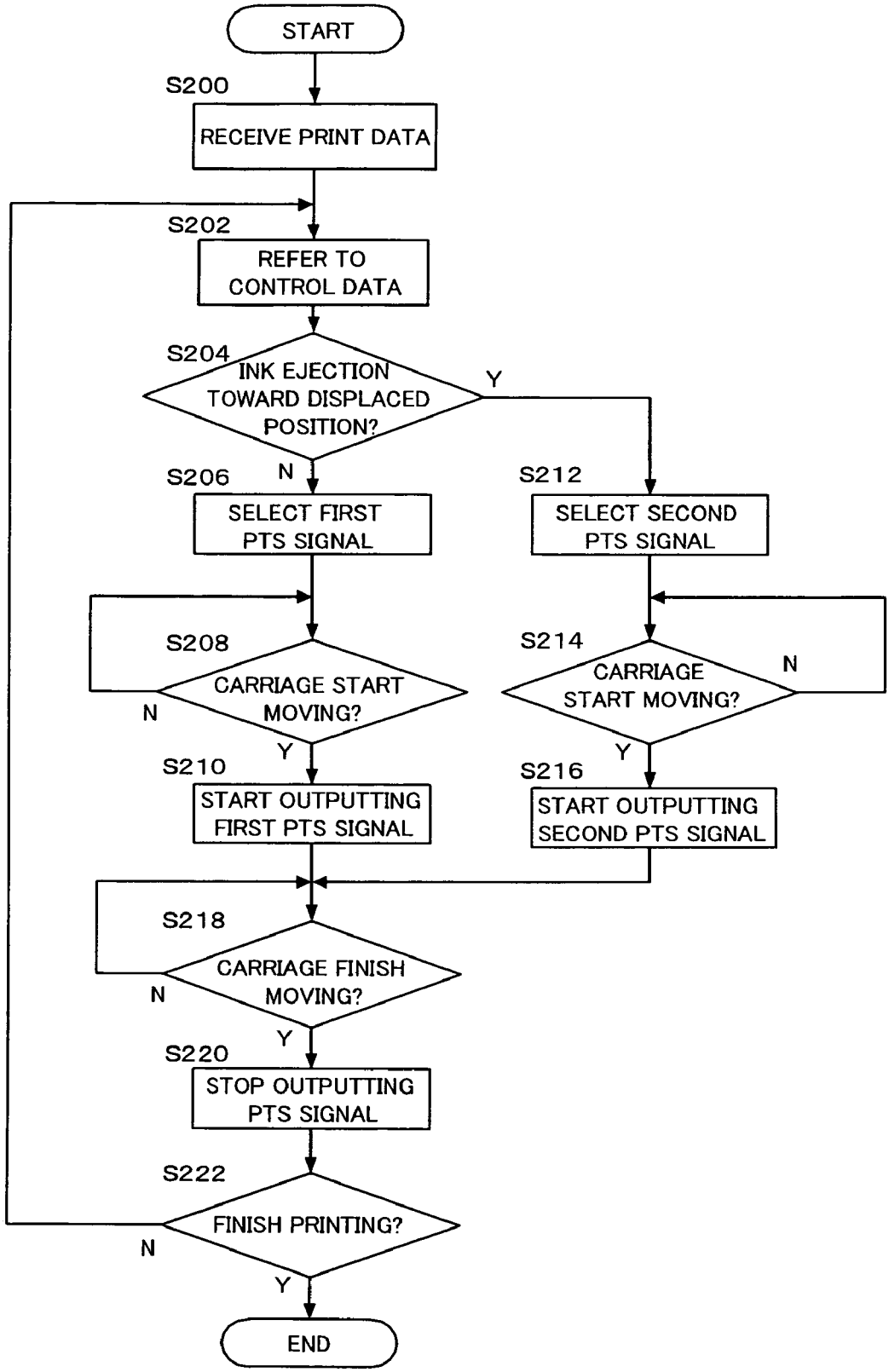
FIG. 26 is a flow chart describing an example of the processing procedure of a controller.

FIG. 26 is a flow chart showing an example of a processing procedure of the controller 126. After receiving print data from the computer 152 (S200), next the controller 126 refers to control data sent attached to the print data (S202). Here, the controller 126 initially obtains information to determine, with respect to the pass for which the printing process is to be executed first, whether ink should be ejected for positions corresponding to pixels forming an image to be printed, or positions displaced from the positions corresponding to the pixels configuring the image to be printed.

Next, the controller 126 checks whether or not it is necessary to eject ink for the positions displaced from the positions corresponding to the pixels configuring the image to be printed, in the pass for which the printing process is to be executed next, based on the obtained information (S204). Here, if it is not necessary to eject ink for the displaced positions, next, the process proceeds to step S206, and the controller 126 selects the first PTS signal as the PTS signal to be output to the head drive section 132 (S206). On the other hand, when it is necessary to eject ink for the displaced positions, the process proceeds to step S212, and the controller 126 selects the second PTS signal as the PTS signal to be output to the head drive section 132 (S212).

After selecting the signal to be respectively output to the head drive section 132 in this way, next, the controller 126 checks whether or not the carriage 41 has started moving (S208, S214). Here, if the carriage 41 has not started moving yet, the process returns to step S208 or S214 again, and the controller 126 checks again whether or not the carriage 41 has started moving (S208, S214). This checking is repeatedly performed until the carriage 41 starts moving.

Here, if the carriage 41 has started moving, next, the process proceeds to step S210 or step S216, and the controller 126 commences starts outputting the first PTS signal or the second PTS signal to the head drive section 132 (S210, S216).

After the controller 126 has started outputting of the first PTS signal or the second PTS signal in this way, next, the process proceeds to step S218 and the controller 126 checks whether or not the carriage 41 has finished moving (S218). Here, if the carriage 41 has not finished moving yet, the process returns to step S218 again, and the controller 126 checks again whether or not the carriage 41 has finished moving (S218). This checking is repeatedly performed until the carriage 41 finishes moving.

Here, if the carriage 41 has finished moving, the controller 126 finishes outputting the first PTS signal or the second PTS signal (S220). After the controller 126 finishes outputting the first PTS signal or the second PTS signal in this way, next, the process proceeds to step S222, and the controller 126 checks whether or not the printing has been completed (S222). Here, if the printing has been completed, the controller 126 finishes the process. On the other hand, if the printing has not been completed, the process returns to step S202, and the controller 126 again refers to the control data (S202). Then, the controller 126 checks whether or not it is necessary to eject ink for the positions displaced from the positions corresponding to the pixels configuring the image to be printed in the pass for which the printing process is to be executed next (S204). In this manner, the controller 126 determines for each pass whether ink should be ejected toward the position corresponding to the pixels configuring the image to be printed, or ink should be ejected toward the positions displaced from the positions corresponding to the pixels configuring the image to be printed, based on the control data attached to the print data sent from the computer 152, switches the first PTS signal and the second PTS signal as appropriate, and outputs the signal to the head drive section 132.

===Regarding the Case of Bidirectional Printing===

In the foregoing embodiments, that is, examples of dot arrangements <1> through <4>, a case is described as an example in which printing is performed by ejecting ink from nozzles to form dots, when the carriage 41 moves in one direction. However, the present invention can be also applied to so-called bidirectional printing, in which when the carriage 41 moves bidirectionally, ink is ejected from nozzles to form dots both in the forward pass and the return pass, thus performing printing.

In case of this bidirectional printing, there is a case that in the forward pass, small ink droplets are first ejected from the nozzles, and middle ink droplets are subsequently ejected, whereas in the return pass, middle ink droplets are first ejected from the nozzles, and small ink droplets are subsequently ejected. In such case, in the return pass, middle ink droplets are ejected toward positions corresponding to the pixels configuring an image to be printed or positions displaced from those positions. Consequently, middle dots are formed in the positions corresponding to the pixels configuring the image to be printed or the positions displaced from those positions. Further, small dots are formed in the positions displaced by a predetermined distance Md from the positions corresponding to the pixels configuring the image to be printed, or the positions displaced by the predetermined distance Md from the positions displaced from the positions corresponding to the pixels configuring the image to be printed.

As described so far, even when performing bidirectional printing, by controlling the dot arrangement at a resolution higher than the resolution of image to be printed, it is possible to print an image at a resolution higher than the resolution of the image to be printed. Accordingly, the image quality of the printed image can be improved by improving uneven print density or graininess.

===Other Embodiments===

So far, an embodiment of the present invention is described using the above-described inkjet printer 1 as an example of a printing apparatus. However the foregoing embodiment is for the purpose of elucidating the present invention, and is not to be interpreted as limiting the present invention. The invention can be altered and improved without departing from the gist thereof, and it goes without saying that the invention includes functional equivalents. In particular, the embodiments mentioned below are also included in the printing apparatus.

Further, in this embodiment, part or the whole of the configuration realized by hardware may be replaced with software, and on the contrary, part of the configuration realized by the software may be replaced with the hardware.

Further, part of the process performed on the side of the printing apparatus (the inkjet printer 1) may be performed on the side of the computer 152, and a certain dedicated processing device may be interposed between the printing apparatus (the inkjet printer 1) and the computer 152 for performing part of the process with the processing device.

<Regarding the Printing Apparatus>

Other than the aforementioned inkjet printer 1, any type of printing apparatus that ejects ink to perform printing may be used as the printing apparatus, for example, bubble-jet printers or the like.

<Regarding the Position Displaced from the Position Corresponding to Pixel>

In the foregoing embodiment, a case is described as an example in which the position displaced from the position corresponding to the pixel configuring the image to be printed is a position in the middle of the pixels configuring the image to be printed. However, there is no limitation to this. In other words, any position is possible as long as such position is displaced from the position corresponding to the pixel configuring the image to be printed. For example, the displaced position may be displaced from the position corresponding to the pixel configuring the image to be printed by a spacing wider than the spacing between the pixels. It is also possible that the displaced position is displaced from the position corresponding to the pixel configuring the image to be printed by the width equivalent to one-third, one-fourth, or one-fifth of the spacing between the pixels.

<Regarding the First Timing Defining Signal and the Second Timing Defining Signal>

In the foregoing embodiment, the PTS signal is described as an example of the first timing defining signal and the second timing defining signal. However, the first timing defining signal and the second timing defining signal are not limited to the PTS signal, and any signal that defines a periodical timing for nozzles to eject ink may be used.

Further, in the foregoing embodiment, the PTS signal that corresponds to the first timing defining signal and the second timing defining signal is generated by the controller 126 of the printer 1, and output to the head drive section 132 from the relevant controller 126. However, there is no limitation to this. It is not necessarily required that the first timing defining signal and the second timing defining signal are generated by the controller 126 of the printer 1, and they may be generated by a separate circuit other than the controller 126 of the printer 1, for example, an exclusive PTS generation circuit or the like.

<Regarding the Second Timing Defining Signal>

In the foregoing embodiment, a case is described as an example in which one type of signal (the second PTS signal) is output as the second timing defining signal, however there is no limitation to this. It is also possible that two or more types of signals that respectively define different timings are output. Specifically, it is possible that one type of a plurality of types of the second timing defining signals is a signal for defining the timing of the ink ejection toward the position displaced from the position corresponding to the pixel configuring the image to be printed by the distance equivalent to one-third of the spacing between the pixels, and another type of signal is for defining the timing of ink ejection toward the position displaced from the position corresponding to the pixel configuring the image to be printed by the distance equivalent to two-thirds of the spacing between the pixels.

If it is possible to separately switch two or more types of signals that define different timings as appropriate and output them, it becomes possible to control dot arrangement in a further finer manner. Accordingly, dot arrangement can be controlled in a far higher resolution than the resolution of the image to be printed. In other words, for example, when the resolution of the image to be printed is 2880 (dpi), if dot arrangement can be controlled by the distance equivalent to one-third of the spacing between the pixels configuring the image, it is possible to control the dot arrangement at the resolution of three times of 2880 (dpi), that is, 8640 (dpi). As a result, the image quality of the printed image can be significantly improved by further improvement of uneven print density or graininess.

<Regarding the Case in which Ink is Ejected Two or More Times from Nozzles>

In the foregoing embodiment, as a case in which ink is successively ejected two or more times according to the timing defined by the first timing defining signal (the first PTS signal) or the second timing defining signal (the second PTS signal), a case is described in which a small ink droplet and a middle ink droplet are ejected one time each, two times in total. However, there is no limitation to this. That is, the times of ink ejection are not limited to two times, and may be three or more times. Also, it is not always necessary that ink droplets of different weights are ejected, and ink droplets of the same weight may be ejected a plurality of times.

<Regarding the Dots>

In the foregoing embodiment, dots in a substantial circular shape were formed as the dots to be formed, but the dots of the present invention may be formed in an elliptical shape or other shapes. In other words, dots may have any shape or form, as long as they configure pixels of an image to be printed.

<Regarding the Ink Ejection Mechanism>

In the foregoing embodiment, a mechanism of ejecting ink using piezo elements as the piezoelectric devices is explained, however the mechanism of ejecting ink of the present invention is not limited to the mechanism for ejecting ink by this method, and as long as it is a mechanism of ejecting ink any method may be employed as a mechanism of ejecting ink, for example, such as a method of ejecting ink by generating bubbles in the nozzles through heat or the like, or any other method.

<Regarding the Predetermined Direction>

In the above-described embodiment, the carrying direction shown in each of the figures was illustrated as the "predetermined direction" of the present invention, but the "predetermined direction" is not limited to this direction, and as long as it is a direction in which the medium is carried by the carry mechanism, any direction is suitable.

<Regarding the Ink>

The ink that is used may be pigment ink or may be other various types of ink such as dye ink.

As for the color of the ink, in addition to the above-mentioned yellow (Y), magenta (M), cyan (C), and black (K), it is also possible to use ink of other colors, such as light cyan (LC), light magenta (LM), dark yellow (DY), or, red, violet, blue, or green, for example.

<Regarding the Print Data>

In the foregoing embodiment, the print data is generated by the printer driver 164 installed on the computer 152. However, the print data may be generated by any section other than the printer driver 164.

Moreover, in the foregoing embodiment, the print data is generated by an external computer 152 and sent from this computer 152 to the inkjet printer 1, but there is no limitation to this, and print data may be generated inside the inkjet printer 1.

<Regarding the Carry Mechanism>

In the foregoing embodiment, a configuration provided with the paper carry motor 15, the carry roller 17A, the paper-discharge roller 17B, and so forth was disclosed as the carry mechanism, but the carry mechanism of the present invention is not limited to such a mechanism, and any mechanism may be used, as long as it is a mechanism that can carry the medium S.

<Regarding the Printer Driver>

In the foregoing embodiment, the printer driver 164 is installed on the computer 152 that is capable of communicating with the inkjet printer 1, but there is no limitation to this. The printer driver 164 may be installed on the inkjet printer 1.

In addition, in the foregoing embodiment, the printer driver 164 is provided with the resolution conversion processing section 166, the color conversion processing section 168, the halftone processing section 170, and the rasterization processing section 172. However, the printer driver 164 is not required to have these processing sections. In other words, any section corresponds to the printer driver, as long as such section has a function to convert the image data received from the application program 160 into the print data that can be interpreted by the inkjet printer 1.

<Regarding the Medium>

The medium S may be any of plain paper, matte paper, cut paper, glossy paper, roll paper, print paper, photo paper, and roll-type photo paper or the like. In addition to these, the medium S can also be a film material such as a OHP film, a glossy film, a cloth material, or a metal plate material or the like. In other words, any medium may be used, as long as ink can be ejected onto it.

The invention claimed is:

1. A printing apparatus, comprising:

(A) a carry mechanism that carries a medium along a predetermined direction;

(B) a nozzle that performs a moving and ejecting operation for ejecting ink toward the medium while moving relatively with respect to the medium in an intersecting direction that intersects the predetermined direction, during an interval of a carry operation by the carry mechanism, the nozzle ejecting a first ink droplet and ejecting, after the first ink droplet has been ejected, a second ink droplet that has a size different from a size of the first ink droplet, the second ink droplet being ejected in between two first ink droplets ejected in one moving and ejecting operation; and (C) a signal output section that outputs a first timing defining signal defining periodically in a predetermined period an ejecting timing for ejecting the first ink droplet from the nozzle toward a position corresponding to a pixel configuring an image to be printed, and a second timing defining signal defining periodically in a predetermined period an ejecting timing for ejecting the first ink droplet from the nozzle toward a position displaced in the intersecting direction from the position corresponding to a pixel configuring an image to be printed, wherein the signal output section outputs either the first timing defining signal or the second timing defining signal in one moving and ejecting operation, and wherein one raster line is formed by at least one or more times of the first timing defining signal and at least one or more times of the second timing defining signal being used in two or more moving and ejecting operations, and by a plurality of dots being formed with the first ink droplet and the second ink droplet on the medium.

2. A printing apparatus according to claim 1, wherein the first timing defining signal and the second timing defining signal are output alternately from the signal output section.

3. A printing apparatus according to claim 1, wherein a displacement width between the position corresponding to the pixel and the displaced position is narrower than a spacing between pixels configuring an image to be printed.

4. A printing apparatus according to claim 1, wherein ink is ejected successively two or more times from the nozzle according to a certain timing defined by at least one of the first defining timing signal and the second defining timing signal.

5. A printing apparatus according to claim 1, wherein the moving and ejecting operation for ejecting ink to be ejected toward a position corresponding to a certain pixel configuring the image and a position displaced from such position is different from the moving and ejecting operation for ejecting ink to be ejected toward a position corresponding to another pixel adjacent to the certain pixel in a moving direction of the nozzle and a position displaced from such position.

6. A printing apparatus according to claim 1, comprising a plurality of the nozzles.

7. A printing method comprising:

using the printing apparatus according to claim 1.

8. A printing system comprising:

a computer; and the printing apparatus according to claim 1, capable of communicating with the computer.

9. A printing apparatus according to claim 3, wherein the displacement width is a half of the spacing between pixels configuring an image to be printed.

10. A printing apparatus according to claim 4, wherein of the ink ejected successively two or more times from the nozzle according to the certain timing, ink ejected first is ejected toward the position corresponding to the pixel or the displaced position.

11. A printing apparatus according to claim 4, wherein when ink is ejected successively two or more times from the nozzle according to the certain timing, a spacing between a position on the medium on which ink ejected first lands and a position on the medium on which ink ejected last lands is wider than a spacing between pixels configuring an image to be printed.

12. A printing apparatus according to claim 4, wherein when ink is ejected successively two or more times from the nozzle according to the certain timing, the quantity of ink ejected each time differs.

13. A printing apparatus comprising:

(A) a carry mechanism that carries a medium along a predetermined direction;

(B) a nozzle that performs a moving and ejecting operation for ejecting ink toward the medium while moving relatively with respect to the medium in an intersecting direction that intersects the predetermined direction, during an interval of a carry operation by the carry mechanism, the nozzle ejecting a first ink droplet and ejecting after the first ink droplet has been ejected a second ink droplet that has a size different from a size of the first ink droplet, the second ink droplet being ejected in between two first ink droplets ejected in one moving and ejecting operation; and (C) a signal output section that outputs a first timing defining signal defining periodically in a predetermined period an ejecting timing for ejecting the first ink droplet from the nozzle toward a position corresponding to a pixel configuring an image to be printed, and a second timing defining signal defining periodically in a predetermined period an ejecting timing for ejecting the first ink droplet from the nozzle toward a position displaced in the intersecting direction from the position corresponding to a pixel configuring an image to be printed, wherein the signal output section outputs either the first timing defining signal or the second timing defining signal in one moving and ejecting operation, wherein (D) one raster line is formed by at least one or more times of the first timing defining signal and at least one or more times of the second timing defining signal being used in two or more moving and ejecting operations, and by a plurality of dots being formed with the first ink droplet and the second ink droplet on the medium, (E) the first timing defining signal and the second timing defining signal are output alternately from the signal output section, (F) a displacement width between the position corresponding to the pixel and the displaced position is narrower than a spacing between pixels configuring an image to be printed, (G) the displacement width is a half of the spacing between pixels configuring an image to be printed, (H) ink is ejected successively two or more times from the nozzle according to a certain timing defined by at least one of the first defining timing signal and the second defining timing signal, (I) of the ink ejected successively two or more times from the nozzle according to the certain timing, ink ejected first is ejected toward the position corresponding to the pixel or the displaced position, (J) when ink is ejected successively two or more times from the nozzle according to the certain timing, a spacing between a position on the medium on which ink first ejected lands and a position on the medium on which ink ejected last lands is wider than a spacing between pixels configuring an image to be printed, (K) when ink is ejected successively two or more times from the nozzle according to the certain timing, the quantity of ink ejected each time differs, (L) the moving and ejecting operation for ejecting ink to be ejected toward a position corresponding to a certain pixel configuring the image and a position displaced from such position, is different from the moving and ejecting operation for ejecting ink to be ejected toward a position corresponding to another pixel adjacent to the certain pixel in a moving direction of the nozzle, and a position displaced from such position, and (M) the printing apparatus is provided with a plurality of the nozzles.

* * * * *